US005785810A

United States Patent [19]

Salminen

[11] Patent Number: 5,785,810

[45] Date of Patent: Jul. 28, 1998

[54] WOOD PULP PROCESSING APPARATUS AND METHOD

[76] Inventor: Reijo K. Salminen, 373 Coye Rd, Bellingham, Wash. 98226

[21] Appl. No.: 198,284

[22] Filed: Feb. 18, 1994

Related U.S. Application Data

[63] Continuation-in-part of Ser. No. 20,324, Feb. 19, 1993, abandoned, which is a continuation-in-part of Ser. No. 898,944, Jun. 11, 1992, Pat. No. 5,482,594, which is a continuation-in-part of Ser. No. 748,271, Aug. 24, 1991, abandoned, and Ser. No. 20,194, Feb. 19, 1993, abandoned, which is a continuation-in-part of Ser. No. 898,944, Jun. 11, 1992, Pat. No. 5,482,594, which is a continuation-in-part of Ser. No. 748,271, Aug. 24, 1991, abandoned.

[51] Int. Cl.[6] ..... D21C 9/02

[52] U.S. Cl. ..... 162/60; 162/65

[58] Field of Search ..... 162/60, 65, 57, 162/61, 189, 190, 29, 30.1, 70, 78, 90, 79; 210/406, 416, 400

[56] References Cited

U.S. PATENT DOCUMENTS

| | | | |
|---|---|---|---|
| 4,070,234 | 1/1978 | Anderson et al. | 162/60 |
| 4,154,644 | 5/1979 | Ericsoon | 162/60 |
| 4,303,470 | 12/1981 | Weredith | 162/57 |
| 4,946,556 | 8/1990 | Prough | 162/60 |
| 4,946,881 | 8/1990 | Funk | 162/60 |
| 4,964,733 | 10/1990 | Fridicksson et al. | 366/336 |

OTHER PUBLICATIONS

The Bleaching of Pulp, Third Edition (1979), Tappi Press, Atlanta, GA. pp. 52, 197, 322, 404–406, 408–409, 525 and 531.

*Primary Examiner*—Brenda A. Lamb
*Attorney, Agent, or Firm*—Robert B. Hughes

[57] ABSTRACT

A system for dewatering/washing wood pulp and also for bleaching the same. Pulp from a digester is directed into a dewatering/washing apparatus which comprises a high pressure vessel in which there is a table assembly having a perforate support surface for receiving the pulp thereon. A pressure differential is applied across the table assembly so that liquid is removed from the pulp. Also, a processing chemical and/or compound for bleaching is directed into the pulp at a final stage in the washer so as to be retained in the pulp. The pulp is then directed to a pressurized processing vessel where the compound and/or chemical reacts with the pulp. The pulp so treated in the processing vessel is then directed through a second washing station where the pulp is dewatered and has a compound and/or chemical introduced thereon, after which the pulp is transmitted to a second pressure vessel. This process is continued until the bleaching process is completed.

18 Claims, 32 Drawing Sheets

PRIOR ART (e) and (f) to Evaporator (= 3.0 tons of liquid per ton of pulp)

Washing at
10 percent
Consistency

Washing at
25 percent
Consistency

Fig 29 A
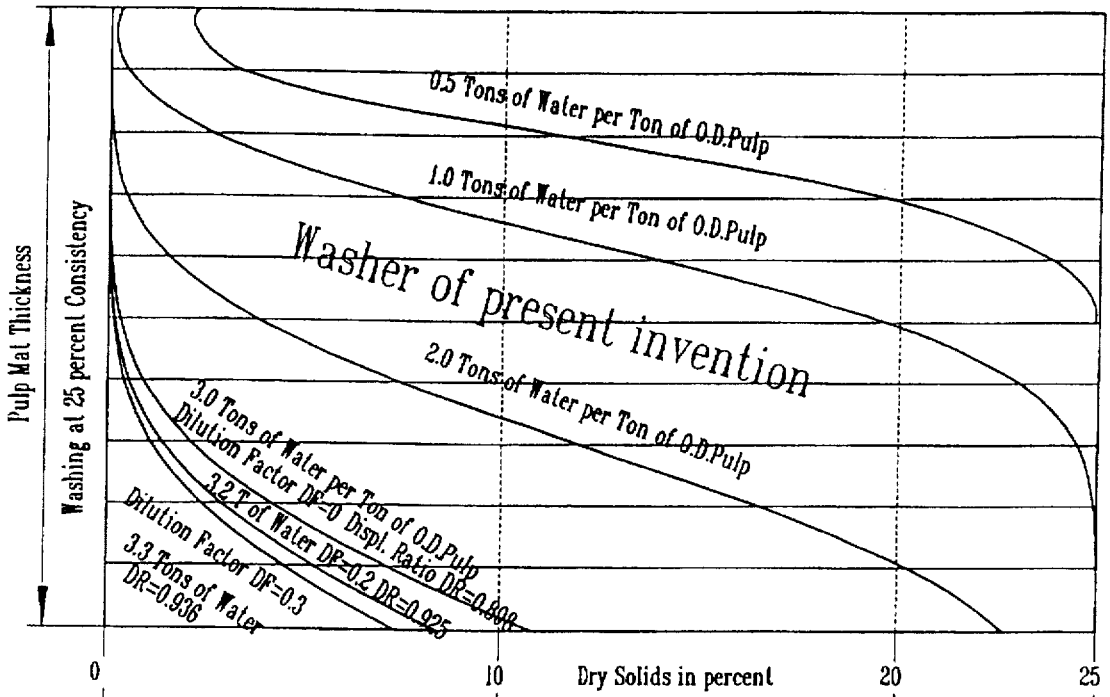
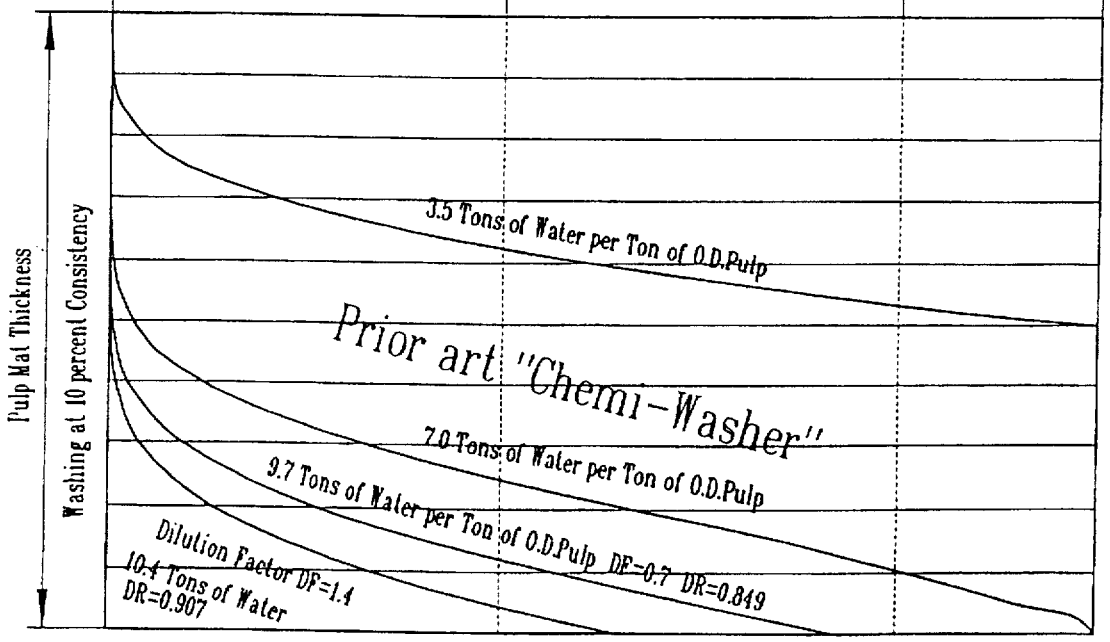
Fig 29 B

Fig 38

| Per O.D.T \ STAGE | BROWN STOCK | OXYGEN | FIRST OZONE | FIRST H202 | SECOND H202 | SECOND OZ. | THIRD H202 |
|---|---|---|---|---|---|---|---|
| Organic | | 15 kg | 10 kg | 5 kg | 4 kg | 3 kg | 3 kg |
| NaOH | | 15 kg | | 10 kg | 4 kg | | 4 kg |
| 02/03 | | 20 kg | 8 kg | | | 4 kg | |
| H202 | | | | 10 kg | 5 kg | | 3 kg |
| H2SO4 | | | 5 kg | | | 4 kg | |
| DTPA | | | 2 kg | | | 1 kg | |
| Carry over | | 6 kg | 1.7 kg | 1.3 kg | 0.8 kg | 0.7 kg | 0.6 kg |
| Total Dry Solids * | 625 kg | 56 kg | 26.7 kg | 26.3 kg | 13.8 kg | 12.7 kg | 10.6 kg |
| Black Liquor ** | 4.5 T at 25 % D.S. | | | | | | |
| Fresh Water | 1.5 Tons | 2.5 Tons | 2.5 Tons | 2.5 Tons | 2.5 Tons | 2.5 Tons | 2.5 Tons |
| Filtrate A and H | ← | 2.5 T at 1.92 % D.S. | ← | | | 2.5 T at 0.48 % D.S. | |
| Filtrate B | ← | | | 2.5 T at 0.94 % D.S. | | | |
| Filtrate C and J | ← | 2.5 T at 0.79 % D.S. | | ← | | | 2.5 T at 0.41 % D.S. |
| Filtrate D | ← | | | 2.5 T at 0.50 % D.S. | | | |
| Filtrate F | | ← | | | 2.5 T at 0.52 % D.S. | | |
| Filtrate E | 4.0 T at 0.70 % D.S. | | → | | | | |
| Weak Black Liquor | 2.5 T at 1.43 % D.S. | | | | | | |
| To Evaporator | 9.5 T at 18.78 % D.S. | | 9.0 T at 0.73 % D.S. | | | | |
| Total Dry Solids | 25 % | 2.25 % | 1.07% | 1.05 % | 0.55 % | 0.51 % | 0.42 % |
| Carry over to next | 0.25 % | 0.06 % | 0.05 % | 0.03 % | 0.03 % | 0.025 % | 0.02 % |
| DISPLACEMENT RATIO DR | 0.99 | 0.97 | 0.95 | 0.97 | 0.95 | 0.95 | 0.95 |
| Washing Stages In Each Washer | Six | Four | Five | Four | Five | Five | Five |

* Calculated at 28.57 % Washing Consistency

** Calculated at 12.5 % Brown Stock Consistency in the Digester

WOOD PULP PROCESSING APPARATUS AND METHOD

CROSS REFERENCE TO A RELATED PATENT APPLICATION

This is a continuation-in-part U.S. patent application Ser. No. 08/020,324, filed Feb. 19, 1993, now abandoned which is a continuation-in-part of U.S. patent application Ser. No. 07/898,944, filed Jun. 11, 1992, entitled "LIQUID REMOVAL APPARATUS AND METHOD FOR WOOD PULP", now U.S. Pat. No. 5,482,594 which in turn is a C-I-P of U.S. patent application Ser. No. 07/748,271, filed Aug. 24, 1991, entitled "LIQUID REMOVAL APPARATUS AND METHOD FOR WOOD PULP OR THE LIKE", now abandoned. This application is also a C-I-P of U.S. patent application Ser. No. 08/020,194, filed Feb. 19, 1993, now abandoned, which is a C-I-P of U.S. patent application Ser. No. 07/898,944, filed Jun. 11, 1992 now U.S. Pat. No. 5,482,594, and Ser. No. 07/748,271, filed Aug. 24, 1991, now abandoned, mentioned above, the subject matter of all of these applications hereby being incorporated herein by reference.

BACKGROUND OF THE INVENTION a. Field of the Invention

The present invention relates to an apparatus and method for processing wood pulp, and more particularly to such an apparatus and method which is particularly adapted for use in a system incorporating bleaching, and dewatering and/or washing material such as wood pulp or the like.

b. Background Art

In the pulp and paper industry, it is common to take the wood pulp from the digester and then dewater and wash the wood pulp through several cycles. Then the wood pulp is directed through a number of bleaching stages, and between each bleaching stage there is a dewatering process and also washing to remove the residue resulting from that particular bleaching step.

With regard to dewatering and washing, there are in general three common methods of accomplishing a dewatering and/or washing operation. One method is to employ a rotating drum which has a perforate cylindrical sidewall, where the cylindrical sidewall on one side travels downwardly into a bath of a pulp slurry and then travels upwardly to a location above the pulp slurry bath. A suction is applied within the drum, so that a portion of the pulp slurry adheres to the surface of the drum. As the layer of wood pulp on the drum is carried upwardly above the pulp slurry bath, in a first path of travel a dewatering operation is accomplished where the liquid from the pulp slurry is drawn into the interior of the drum. Then in a second part of the travel of the pulp on the drum, a wash water is deposited on the dewatered pulp mat to cause displacement washing. Before the layer of pulp material that has been dewatered and washed travels back into the pulp bath, this layer is removed from the drum by a doctor blade or the like. The drum is sometimes enclosed in a pressure chamber, and for practical reasons, the pressure differential used in the drum-type dewatering/washing operation is in the range of about four to ten pounds per square inch.

A second method is to use a continuously moving foraminous conveyor belt onto which a wood pulp slurry is deposited. The conveyor belt carries the wood pulp slurry sequentially over a series of suction boxes which create a lower than atmospheric pressure below the belt to apply a differential pressure across the moving conveying belt to perform first a dewatering operation, and then a washing operation where wash water is deposited on the layer of wood pulp. In this type of operation, the pressure differential that can be applied across the pulp layer is limited because of the frictional force created between the moving belt and its underlying support structure, and the pressure differential limitations in such devices are generally in the range of about two to three pounds per square inch.

A third type of dewatering/washing operation is to move the pulp between upper and lower foraminous belts which are pushed toward one another to squeeze the water from the pulp. Then the pulp is mixed with a cleaning liquid, and the liquid removal operation is again repeated by again squeezing the pulp. This series of steps is continued until the desired dewatering and washing is accomplished.

To the best knowledge of the applicant, all of the dewatering/washing systems that have actually been used commercially operate with pressure differentials in the range of two to ten pounds per square inch, but no higher.

With regard to prior art bleaching wood pulp, for many years, chlorine and chlorine dioxide have commonly been used as bleaching agents. However, in recent years, for environmental reasons, there has been greater effort to move toward the use of other bleaching agents, such as oxygen ($O_2$), ozone ($O_3$), hydrogen peroxide ($H_2O_2$), and possibly others. Quite commonly, the bleaching agent is introduced into a pulp slurry, which is then fed into a processing tower where the pulp slurry moves slowly upwardly or downwardly through the tower. As the pulp moves, the bleaching agent reacts with the wood pulp. The height of the tower and the rate of movement of the wood pulp is controlled so that the bleaching agent works on the wood pulp for a predetermined period of time (e.g. one half hour to several hours, depending upon the type of bleaching agent and other factors).

After the wood pulp slurry is removed from the tower, more liquid is added to the wood pulp to form it into a slurry of low consistency (possibly one percent). It is then subjected to a dewatering and a washing process to remove the residue resulting from the immediately prior bleaching step. The thickened slurry with the next bleaching agent mixed with it is then directed to another bleaching tower, where another bleaching operation is accomplished possibly with a different (or sometimes the same) bleaching agent. This process is repeated until the bleaching is completed.

SUMMARY OF THE INVENTION

The method of the present invention is arranged to combine effective dewatering and washing of the pulp with the bleaching stages in a manner to give a high degree of efficiency and effective bleaching, with relatively little or no net effluent leaving the system.

The method comprises dewatering and washing a batch of pulp at a plurality of wash locations, with the washing being accomplished by moving successive quantities of wash liquid into and through the batch of pulp while applying a sufficient pressure differential across the pulp to maintain the pulp at a consistency of at least about one part by weight of cellulose fiber to four parts by weight of liquid.

After the dewatering and washing of the pulp at each of the wash stations, the pulp is delivered to a related one of a plurality of bleaching locations where the pulp is treated with a bleaching agent. The method is characterized in that after the pulp is treated with the bleaching agent at each of the bleaching locations, the pulp is delivered to a subsequent washing location where the pulp is dewatered and washed.

In the preferred form, the pulp is dewatered and washed by delivering the pulp as a slurry into a pressure chamber in a pressure vessel so as positioned as a pulp layer over a pressure differential table means, and the pressure differential is applied through said pressure differential table means. The preferred form is that successive batches of pulp are delivered into the pressure vessel at each washing location and are removed from the pressure vessel while maintaining above atmospheric pressure in the pressure chamber.

The preferred form of discharging the pulp from the pressure vessel is accomplished by positioning the pulp at a discharge location in the vessel while the pulp is subjected to above atmospheric pressure in the vessel. A discharge passageway is provided and opened to the discharge location at a pressure below pressure in the vessel to create a pressure differential to move the pulp through the discharge passageway. The discharge passageway leads to the subsequent bleach location, and the pulp is delivered from the passageway to a treatment containing means at the subsequent bleach location.

In at least one discharge passageway, a bleaching agent is delivered into the passageway and to pulp passing through that passageway. Preferably, the pulp is moved through a venturi in the passageway, and the bleaching agent is delivered into the passageway at a location adjacent to the venturi. Desirably, this bleaching agent is a gaseous bleaching agent and in one embodiment the bleaching agent is ozone. The pulp is delivered through a plurality of venturis in the passageway, and the passageway is of sufficient volume and length whereby substantial bleaching of the pulp by the ozone can be accomplished in the passageway.

Also, at least one venturi is desireably positioned in each passageway to accelerate the pulp and cause shredding of the pulp into smaller particles.

In the latter part of a washing cycle of at least one of said wash locations a pulp treating agent is entrained in a portion of wash liquid which is moved into the pulp and remains in the pulp after the pulp is delivered to a subsequent bleaching location.

In a preferred form, the consistency of the pulp during washing is maintained at a value at least as great as about one part cellulose fiber by weight to three parts liquid. More desireably, the consistency is maintained at least as great as about one part cellulose fiber to two and a half parts liquid.

Fresh water is used as a portion of the wash liquid at a latter portion of washing cycle of at least some of said wash locations. Desireably, portions of wash water effluent from the pulp are recycled in the washing locations, and a portion of the effluent is delivered to an evaporating recycling mean to remove dissolved solids from the effluent to yield fresh water. This fresh water is utilized as wash liquid in subsequent washing cycles. Desirably, the pressure in each vessel is maintained at least as high as about one bar above atmospheric pressure, and the temperature in the pulp vessel is maintained at least as high as about 50 degrees C.

The pulp bleaching system of the present invention comprises a plurality of pulp washers arranged to dewater and move successive quantities of wash liquid into and through a batch of pulp while applying a sufficient pressure differential across the pulp to maintain the pulp at a consistency of at least about one part by weight of cellulose fiber to four parts by weight of liquid.

The system also comprises a plurality of bleaching means each arranged to receive the pulp from a related one of the pulp washers and to treat said pulp with a bleaching agent.

The system is characterized in that after the pulp is treated with the bleaching agent at each of the bleaching systems, the pulp is delivered to a subsequent pulp washer where the pulp is dewatered and washed In the preferred form, each pulp washer comprises a pressure vessel having a pressure chamber, a pressure differential table means positioned in the chamber to receive a layer of pulp slurry thereon, and arranged to create a pressure differential at the pressure differential table means to effect dewatering and washing of the pulp.

Other features of the present invention will become apparent from the following detailed description.

BRIEF DESCRIPTION OF THE DRAWINGS

FIG. 29*a* is a graph showing curves representing washing through a pulp layer in an idealized situation, utilizing teachings of the present invention;

FIG. 29*b* is a graph similar to FIG. 29*a*, but showing operation of a prior art Chemi-Washer;

FIG. 38 is a table illustrating performance of the system illustrated in FIGS. 31 thru 37;

DESCRIPTION OF THE PREFERRED EMBODIMENT

It is believed that a better understanding of the function and advantages of the system of the present invention will be obtained by first discussing generally one of the commonly used prior art bleaching systems used in the wood pulp industry, after which the system of the present invention will be described.

A. A Typical Prior Art Washing and Bleaching System

Figure 1:
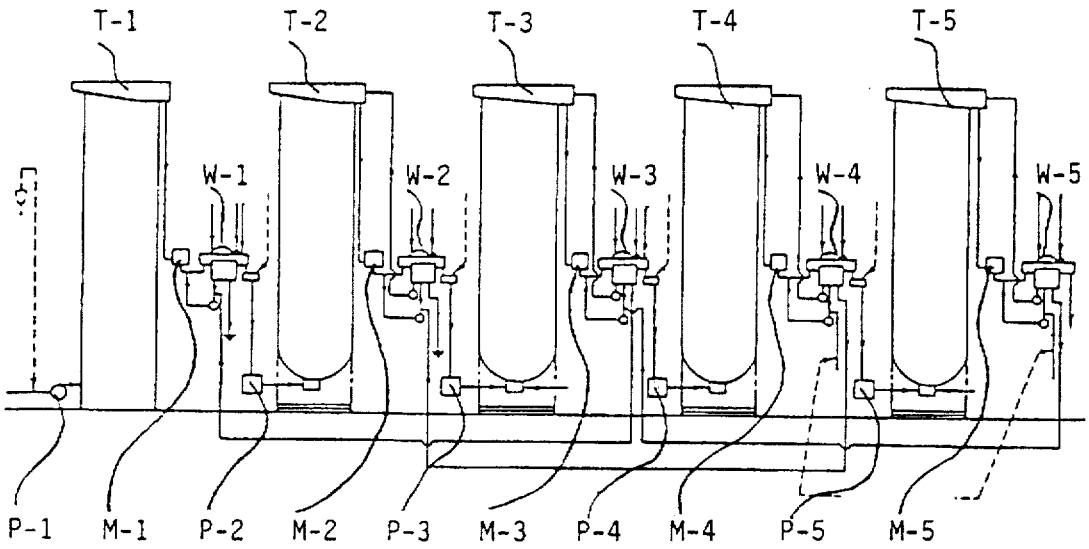
FIG. 1 is a schematic drawing of a commonly used prior art bleaching system.

This prior art bleaching system is illustrated somewhat schematically in FIG. 1. Initially, before any bleaching is accomplished, the wood pulp that has initially been processed in a digester is then dewatered and washed in a brown stock washing apparatus. The slurry discharged from this washer typically has a consistency of, for example, 10—13%. This pulp slurry is then diluted to a consistency of, for example, four percent and chlorine gas is introduced into this slurry. The slurry is then directed by a pump P-1 in the lower end of a chlorination tower T-1 where it slowly moves upwardly to the top of the tower. The travel time upwardly through the tower in a typical system could be between about one half hour to an hour. The slurry leaving the top of the chlorination tower T-1 then goes to a mixer M-1 where liquid recirculated from a washer W-1 is mixed with the slurry in the mixer M-1 to bring the consistency of the slurry down to about one percent. This one percent slurry is then directed into the washer W-1.

Typically, this washer W-1 is a drum washer as previously described herein in the section on background art, and sometimes more than one drum washer is used to wash the pulp further. The pulp from the washer W-1 can have steam added thereto (primarily to raise the temperature of the pulp to the desired level), and then this is directed by a pump P-2 into the lower end of a second tower T-2 which is an alkali extraction tower. The retention time in this tower T-2 is typically between one to two hours. The pulp leaving the top of the alkali extraction tower T-2 is then directed into a second washer W-2, and substantially the same operation is accomplished as described with regard to the washer W-1. More specifically, the slurry is diluted by the mixer M-2 and directed to the washer W-2 where it is dewatered and washed. Then steam is added and the slurry is then directed by a pump P-3 into the bottom of a third tower T-3, which in this instance is a chlorine dioxide tower. Chlorine dioxide is mixed to the pulp at the bottom of the tower.

After the bleaching step in the chlorine dioxide tower T-3 is completed, typically in about three to four hours, the pulp moves through a third washer W-3 to the fourth tower T-4 (an alkali extraction tower), then through the washer W-4 to the fifth tower T-5 (which is another chlorine dioxide tower). From the tower T-5, the pulp is directed to the final washing stage at W-5.

In this prior art bleaching operation, as shown in FIG. 1, fresh water is added at certain locations, and also liquid from some of the washing stages is recirculated back through the "upstream" portions of the system. For example, in the prior art system shown in FIG. 1, fresh water would be added into the last two stages of the washing system (W-4 and W-5). Further, in a typical operation, a certain portion of the fluid that is extracted from the washer W-5 would be directed back to the washer W-3; also, a portion of the liquid from the washer W-4 would be directed back to the washer W-2; and further a portion of the liquid from the washer W-3 would be directed back to the washer W-1.

With the consistencies of the stock from the washing stages generally being between ten to fourteen percent, for each unit of pulp material that is processed, there would possibly be approximately twenty five or more units of liquid that would be directed to a sewer as waste (this varying, of course, depending upon the actual consistency of the pulp entering and leaving the various washers and washer efficiency.)

B. The Dewatering/Washing Apparatus of the System of the Present Invention

In the preferred form of the present invention, there is utilized a dewatering and washing apparatus and method as described generally in U.S. patent application Ser. Nos. 07/758,271 and 07/898,944. Also, the apparatus described in the U.S. patent application Ser. No. 08/020,194 could be used. Other embodiments described in the two aforementioned earlier filed applications will not be described, with the understanding that, of course, such other embodiments or modifications thereof could be used in the system of the present invention. Then there will be a description of the overall system of the present invention.

As will become apparent from the following detailed description, this dewatering and washing apparatus has significant advantages when used in the system of the present invention, and this will be discussed later in this text.

There will now be a description of the dewatering and washing apparatus 10 used in the present invention, and then a description of how this apparatus 10 is used in the various stages of the bleaching of the wood pulp in the system of the present invention.

With reference to FIGS. 2 through 18, the dewatering and washing apparatus 10 utilized in the system of the present invention comprises a main pressure vessel 12 with front and rear ends 14 and 16. There is a single processing area 18 which is both a dewatering and washing processing area, and which occupies a substantial portion of the pressure vessel 12.

There is a head box 20 to contain the pulp slurry to be processed, a pressure inlet 21, and also a manifold system 22. Positioned within the pressure vessel 12 is a conveying and pressure differential table unit 24. As will be disclosed more fully later herein, this table unit 24, in conjunction with other components, accomplishes both dewatering and washing operations sequentially.

Also positioned within the pressure vessel 12 is an enclosure frame 26, which contains the pulp slurry and wash water in a manner that there is a sealed area to accomplish the dewatering and washing. In terms of function, the table unit 24 and the enclosure frame 26 can be considered to function as a table assembly 27 that contains the pulp slurry and accomplishes certain processing functions.

There is a dewatering/washing plate assembly 28 which, during the latter part of the dewatering operation and during the washing sequence, is pressed against the top surface of the pulp slurry being processed. Just above the plate assembly 28 is positioned a wash water dispensing assembly 30 which comprises a plurality of dispensing troughs 32. This trough assembly 30 provides a convenient means for dispensing the wash water sequentially onto the plate assembly 28 during the wash cycles.

The table unit 24 comprises a conveyor belt 34 which engages front and rear rolls 36 and 38. The upper run of this conveyor belt 34 extends along the top portion of the table unit 24.

At the rear end of the conveying belt 34 there is a pulp discharge assembly 40 which receives the processed pulp mat directly from the conveying belt 34 and moves the pulp mat through a discharge passageway at which the pulp mat forms a substantial seal. Then as the pulp mat is moved into a discharge area, pressurized gas (e.g. air or steam) from inside the vessel 12 moves the processed pulp material through a valve to a subsequent processing location outside the pressure vessel 12. This will be described in more detail later herein.

Figure 6:
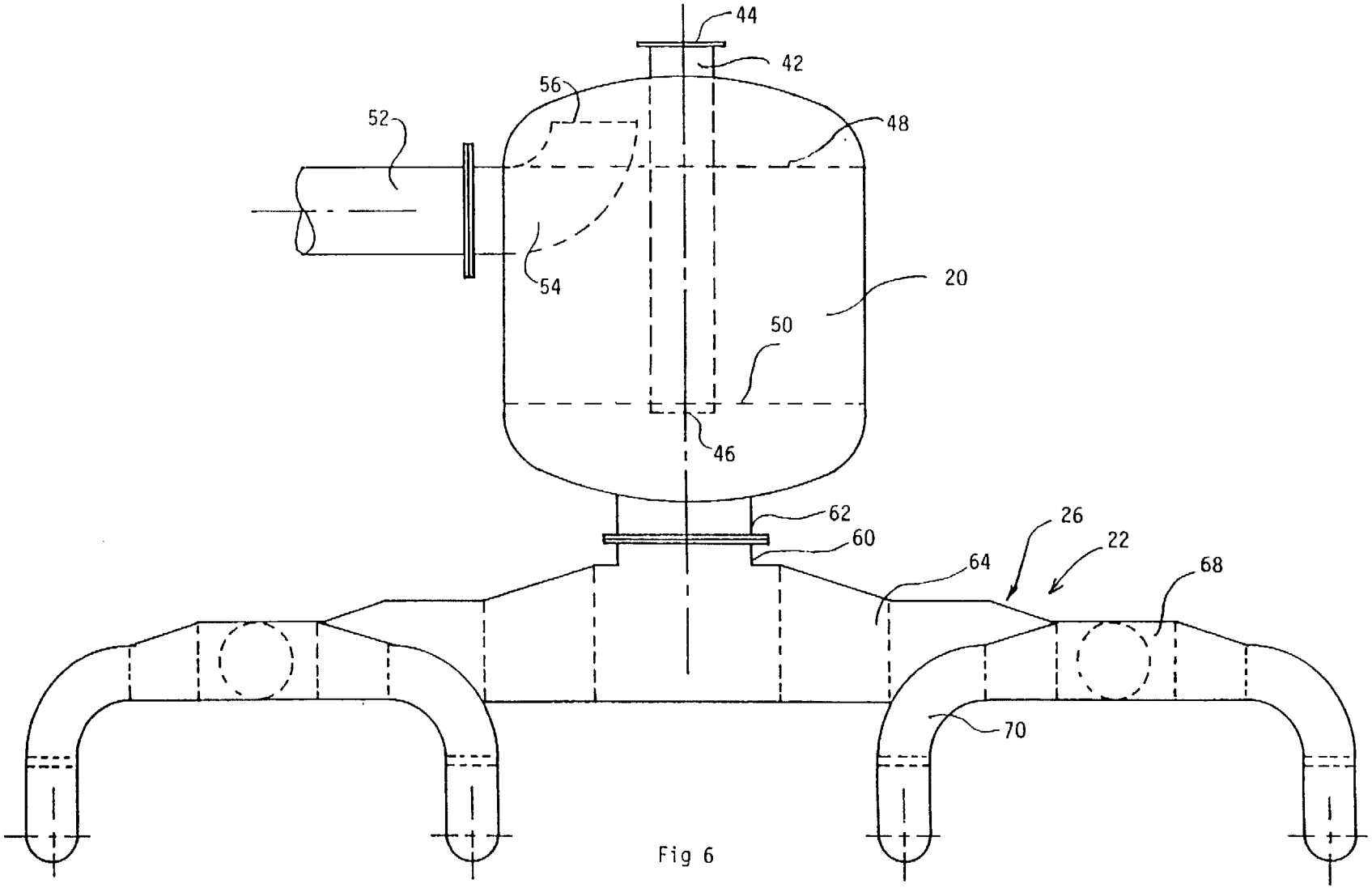
FIG. 6 is a side elevational view showing only the headbox and manifold assembly which provides the pulp for processing in the apparatus of FIG. 2.
Figure 7:
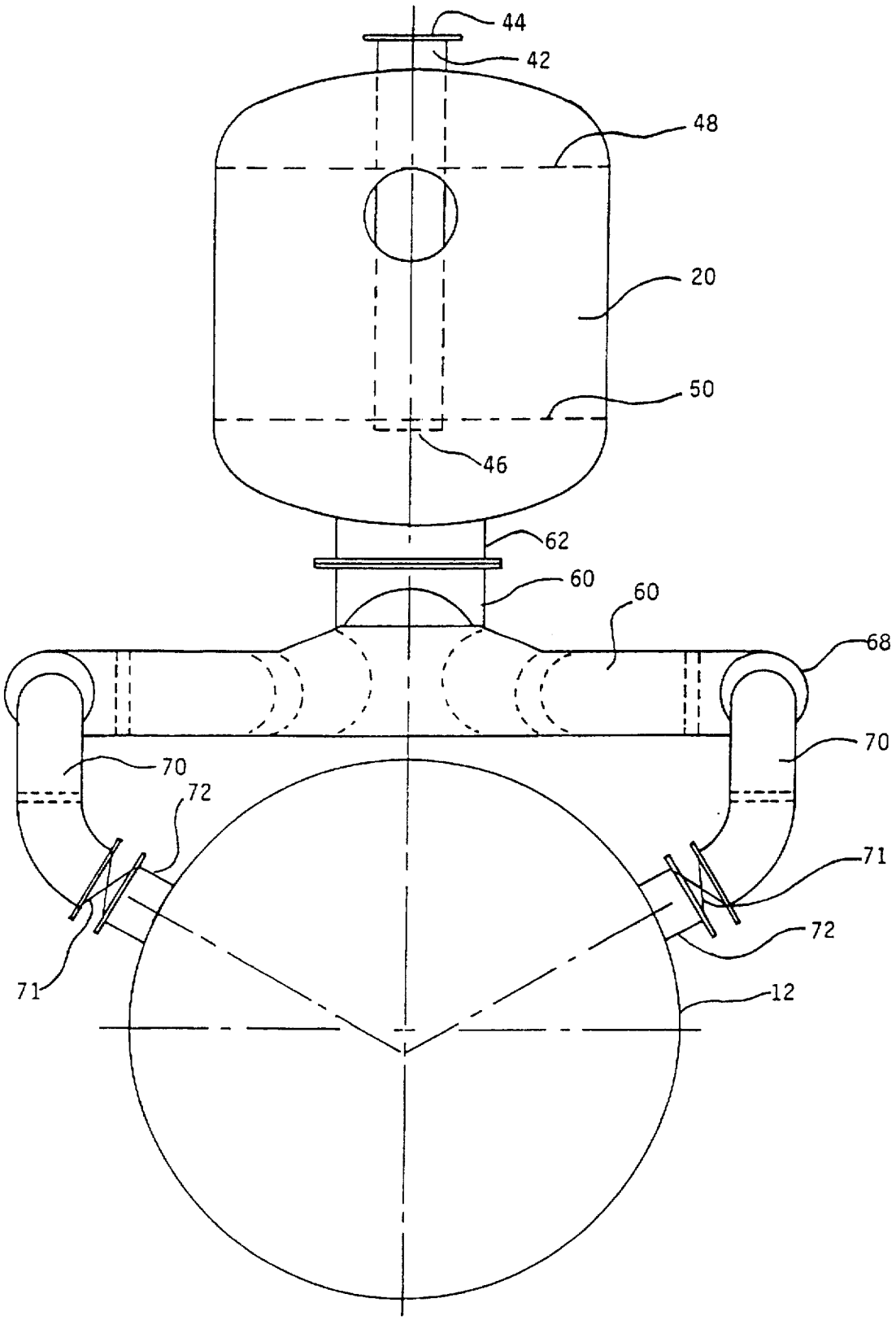
FIG. 7 is front elevational view of the headbox and manifold assembly of FIG. 6.
Figure 8:
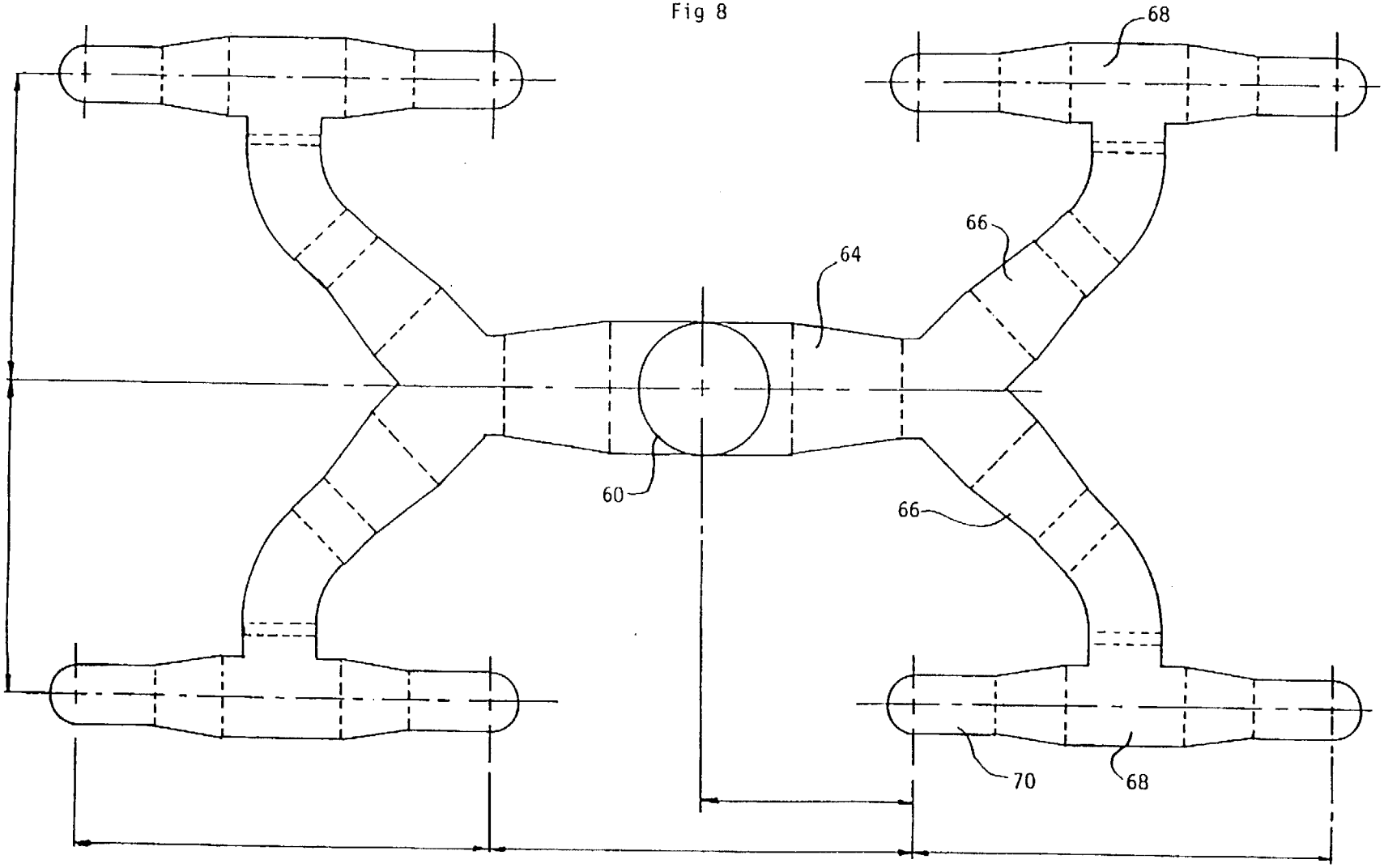
FIG. 8 is a top elevational view thereof.

With reference to FIGS. 6 through 8, the headbox 20 is made in the form of a tank to contain pulp at a relatively high pressure which is moderately greater than the pressure within the main pressure vessel 12 due to it's hydrostatic head only. There is a pulp inlet pipe 42 having an upper inlet end 44 and a lower outlet end 46 located within, and at the lower part of, the headbox 20.

As will be described hereinafter, the pulp in the headbox 20 is discharged rather quickly in a batch into the processing area 18. During the operation of the apparatus 10, wood pulp is directed substantially continuously into the headbox 20 and reaches an upper level 48, and drops to a lower level 50 immediately after a batch discharge of the pulp. The lower end 46 of the pipe 42 is positioned moderately below the lower level 50 so that splashing of the incoming pulp slurry and a mixing with air is minimized.

There is a pressure equalizing conduit 52 which has an end elbow 54 that extends into the headbox 20 and has an end opening 56 that is located above the upper pulp level 48. This equalizing tube 52 connects to a fitting 58 that leads into the interior of the main pressure vessel 12. Thus, as the liquid level of the pulp slurry in the headbox 20 changes, gas is permitted to flow between the headbox 20 and the interior of the main pressure vessel 12 to equalize the pressure in the headbox 20 and the interior of the vessel 12.

The manifold system 22 has a central inlet 60 that connects to a lower outlet valve 62 of the headbox 20. This inlet 60 leads into a main trunk section 64 that extends forwardly and rearwardly from the inlet 60, with the forward and rear ends of the trunk section 64 leading into two branch lines 66, with each branch line 66 leading into a respective sub-branch 68. The sub-branches 68 each comprise lines 70 that are in turn connected through respective valves 71 to outlet members 72, each of which is positioned at the side of the pressure vessel 12 a little above the top of the enclosure frame 26.

Figure 2:
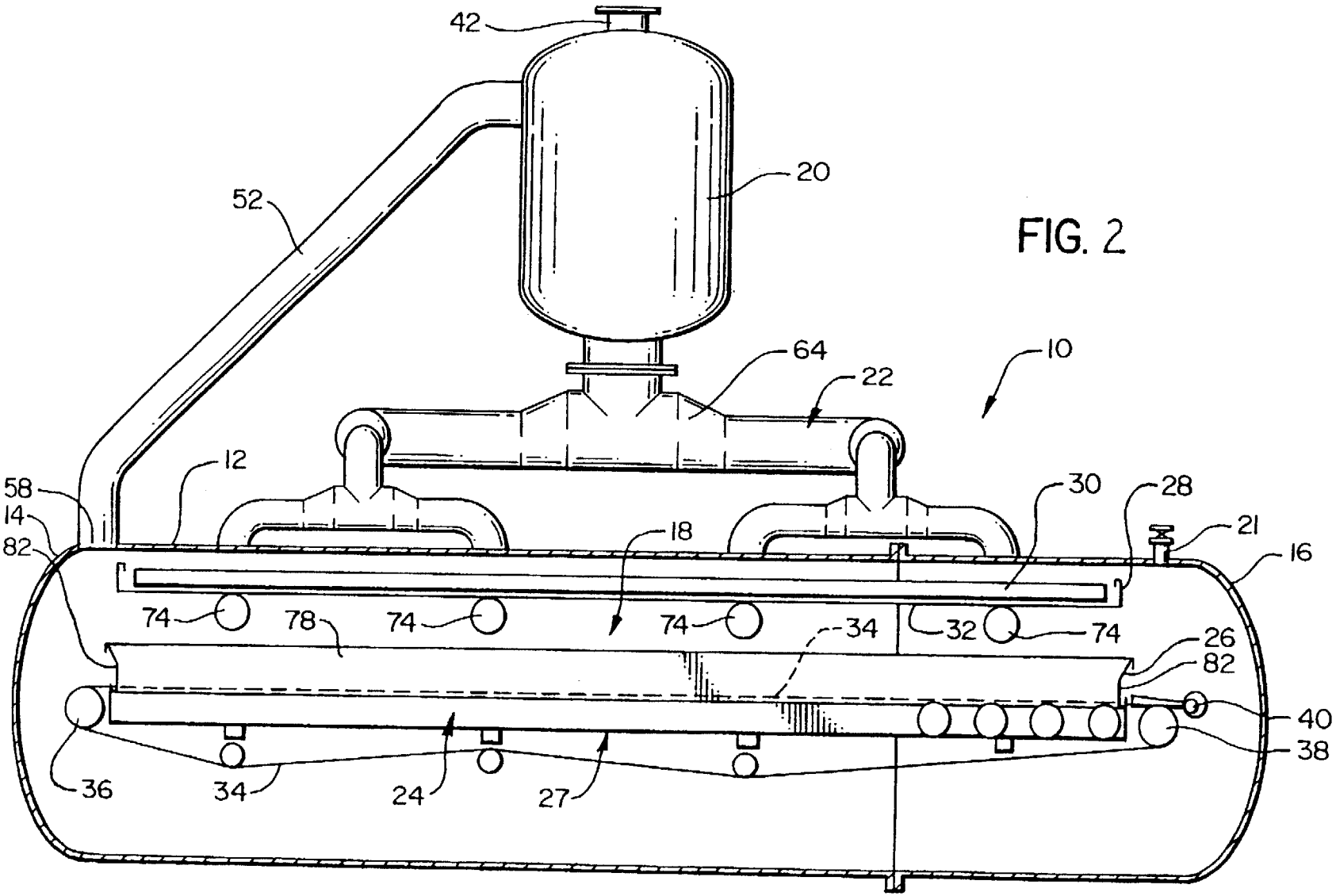
FIG. 2 is a side elevational view, taken partly in section, showing a dewatering/washing apparatus used in the system of the present invention.
Figure 3:
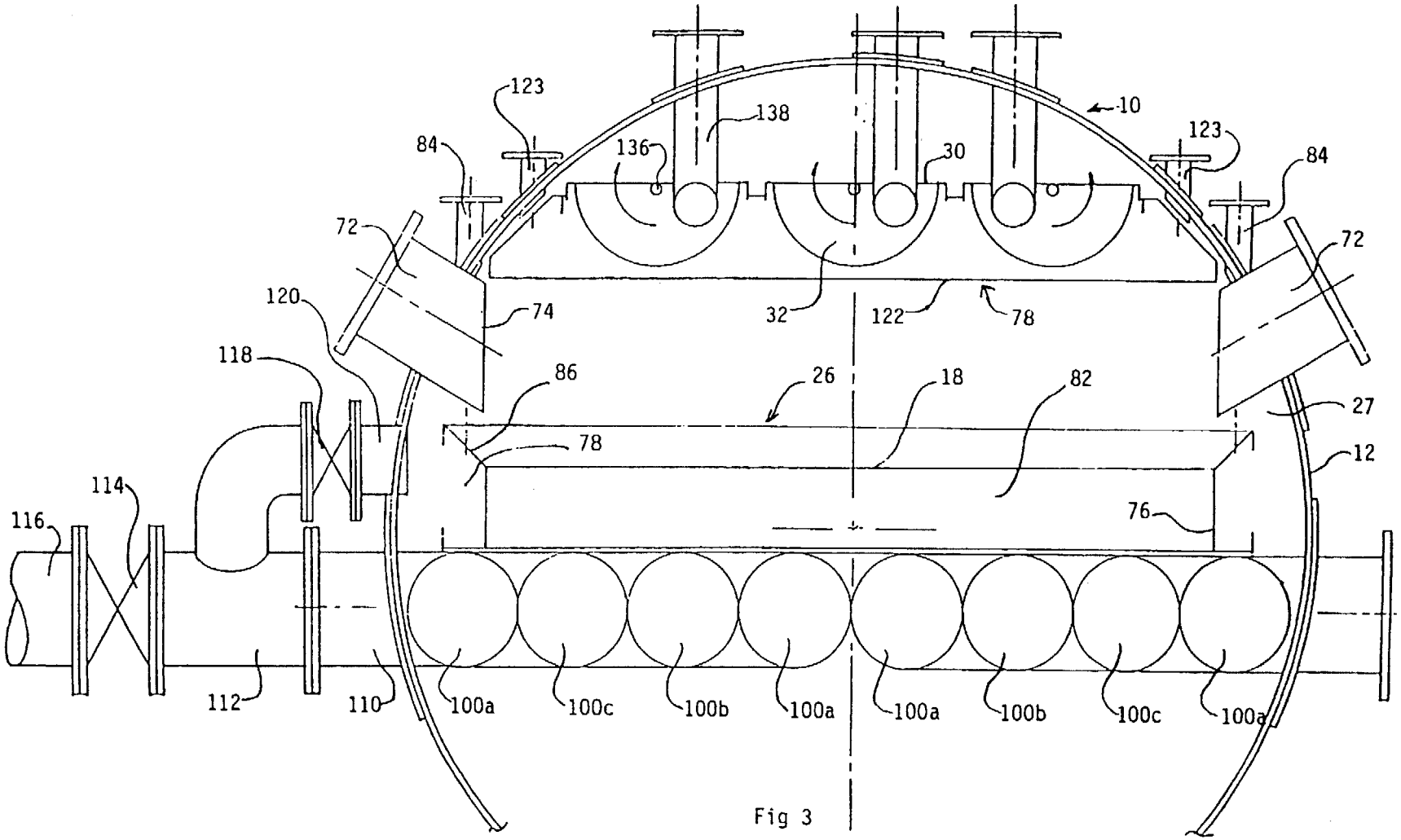
FIG. 3 is a sectional view taken along line 3—3 of FIG. 2.
Figure 4:
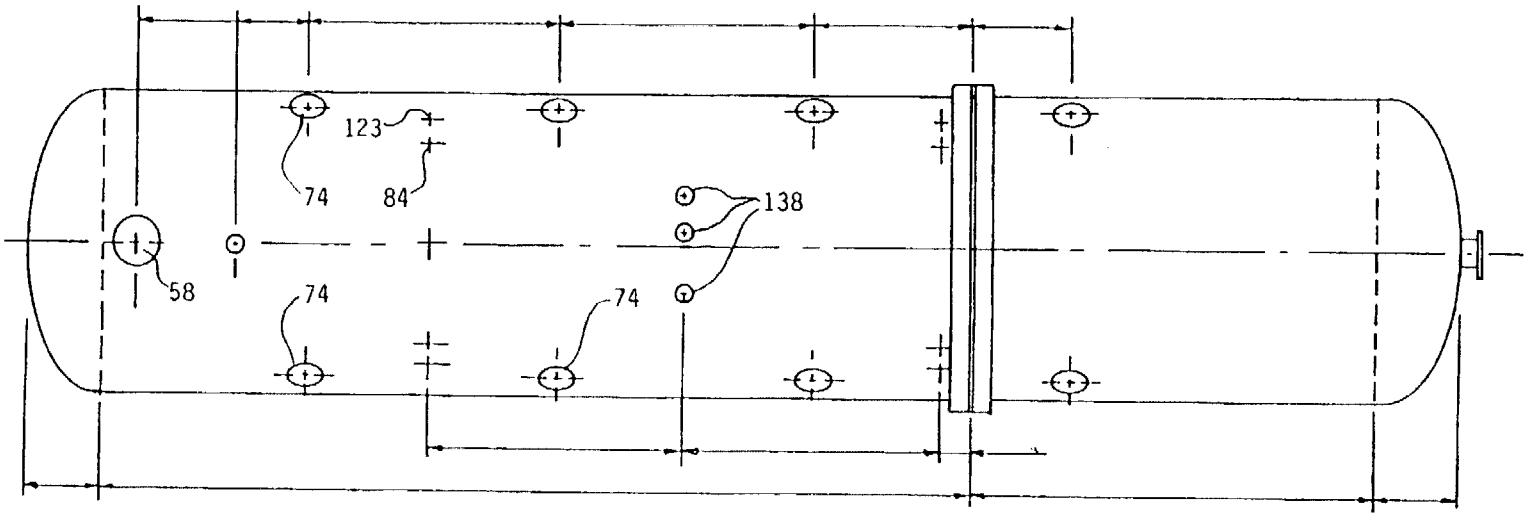
FIG. 4 is a top elevational view of only the pressure vessel of the apparatus of FIG. 2, showing various locations of the openings therein.
Figure 5:
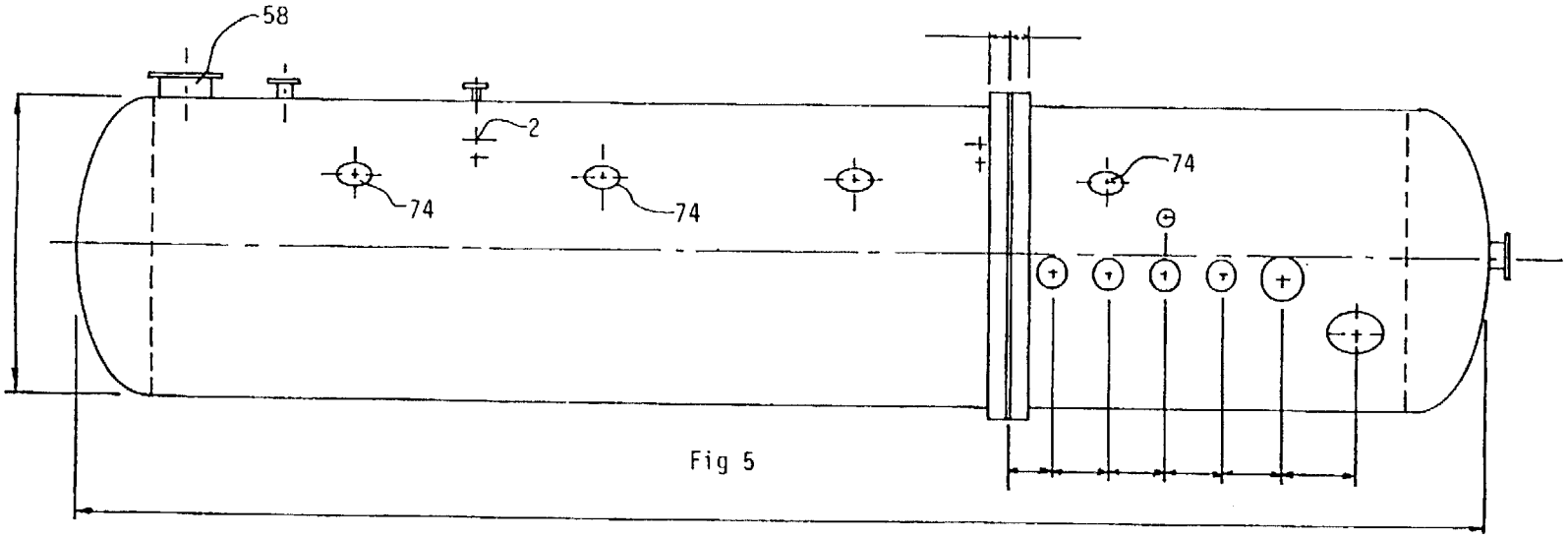
FIG. 5 is a side elevational view of the pressure vessel of FIG. 4, showing in addition certain fittings.

More particularly, as can be seen in FIG. 3, the outlet end 74 of each of the members 72 is positioned moderately above the edge of the frame 26 so as to be slightly outward of the vertical inside surface 76 of the enclosure frame 26. Also, this outlet 74 is positioned laterally just a short distance outside of the lateral edges of the dewatering/washing plate assembly 28. Thus, the pulp slurry is able to be discharged from the outlets 74 onto the table unit 24 within the area of the enclosure frame 26. The positioning of the outlet 74 permits the plate assembly 28 to be lowered downwardly to fit within the enclosure frame 26 and press against the pulp on top of the table unit 24. As can be seen in FIGS. 2, 4, and 5, the pulp outlets 74 are positioned in pairs on opposite sides of the pressure vessel 12 and spaced longitudinally at even intervals for proper distribution of the wood pulp onto the table unit 24.

The enclosure frame 26 comprises two longitudinally aligned side members 78 that extend along the lateral edge portions 80 of the belt 34, and two transverse members 82 that join the front and rear ends of the side members 78. These members 78 and 82 form a rectangular enclosure frame that defines the processing area 18.

This enclosure frame 26 can be raised or lowered, and to accomplish this, there is provided a set of four hydraulic jacks 84. The upper surfaces 86 of the side and end members 78 and 82 are slanted downwardly and inwardly toward the processing area 18 so that if any of the wood pulp happens to splash onto the surface 86, it will tend to flow into the enclosed processing area 18.

Figure 9:
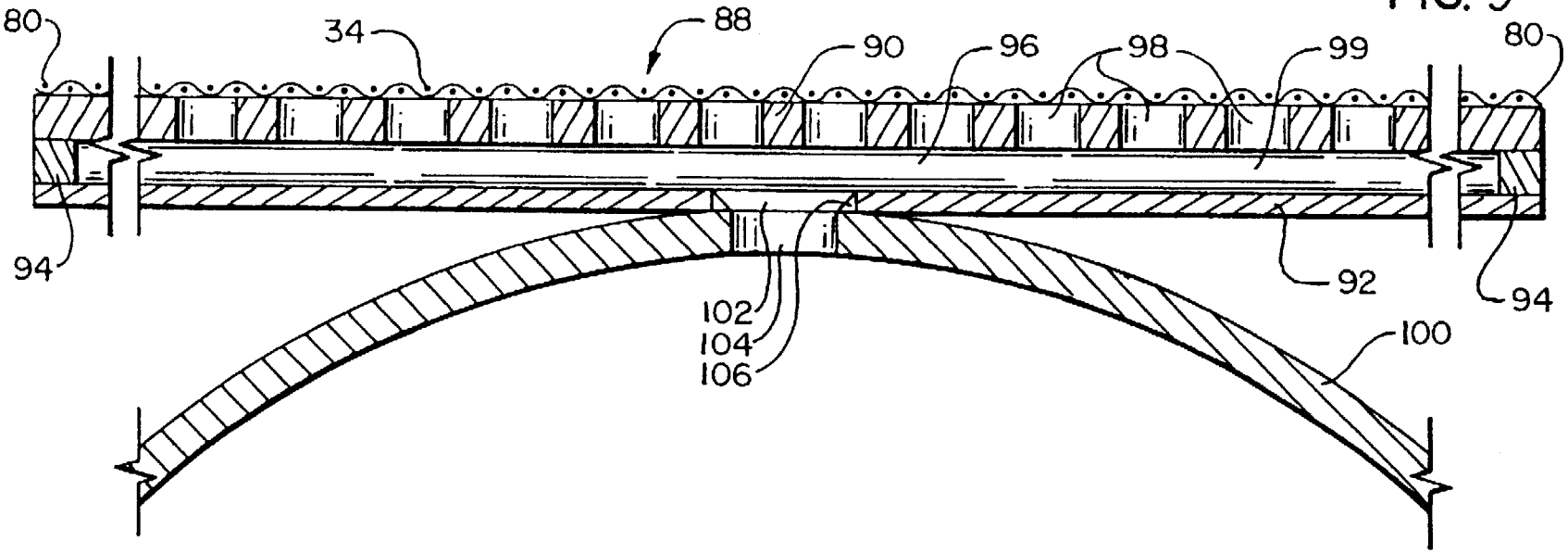
FIG. 9 is a transverse sectional view showing a portion of the table unit and a top portion of one of the conduits to which it is attached.
Figure 10:
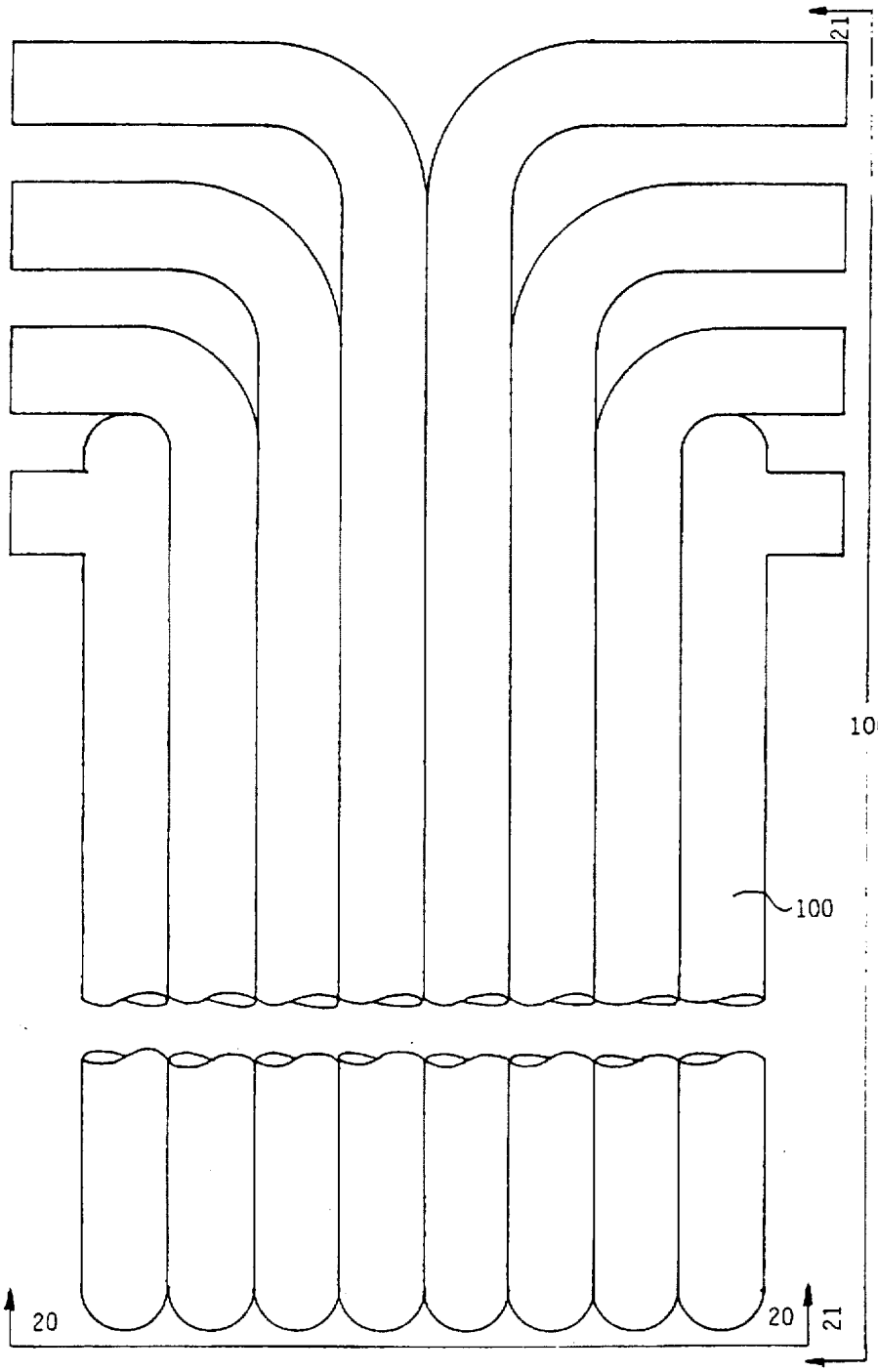
FIG. 10 is a top plan view showing only the recirculating tubes used in the apparatus of FIG. 2.
Figure 12:
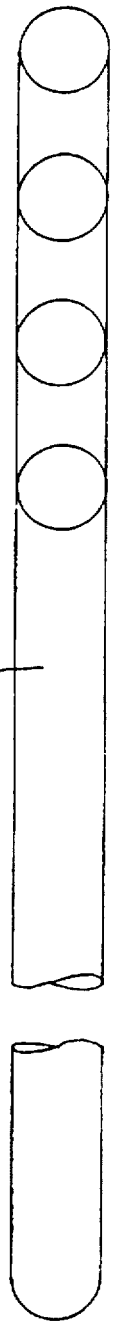
FIG. 12 is a side elevational view of the tubes of FIG. 10, taken at the location of line 12—12.
Figure 11:
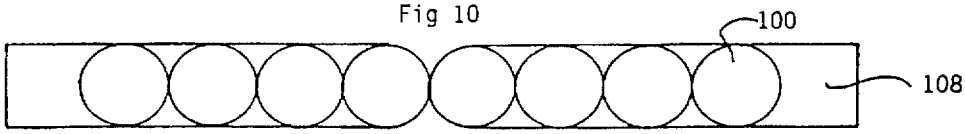
FIG. 11 is an end view of the tubes of FIG. 10, taken at line 11—11 of FIG. 10.

The aforementioned table unit 24, as can be seen in FIG. 9, in addition to comprising the conveyor belt 34 further comprises a pressure differential plate assembly 88 comprising an upper plate 90 and a lower plate 92 which are joined and sealed at their edges by a perimeter strip 94. The upper and lower plates 90 and 92 each have a planar, rectangular configuration, and are spaced a short distance vertically from one another to provide an enclosed chamber 96 that extends through substantially the entire area of the plate assembly 88. These plates 90 and 92 extend beneath the entire processing area 18, and the side and end edges of these plates 90 and 92 are positioned just below the perimeter frame members 78 and 82.

The upper plate 90 is formed with a plurality of vertical through openings 98 positioned at equally spaced intervals over substantially the entire surface of the upper plate 90. The upper run of the conveying belt 34 rests on top of the plate 90 and the liquid from the pulp mat on the belt 34 flows through the openings 98 and into the chamber 96 between the plates 90 and 92. The spacers between the upper and lower plates 90 and 92 are conveniently provided in the form of round wires 99 that extend transversely (e.g. about ¼ inch in diameter) across the entire width of the table unit 24, with these wires 99 being spot welded in place at longitudinally spaced intervals along the entire length of the plate assembly 88. The wires 99 divide the chamber 96 into a plurality of transversely extending subchambers into which the openings 98 lead.

To provide the pressure differential in the table unit chamber 96 and also to remove the liquid collected in this chamber 96, there is provided a plurality of longitudinally extending tubes 100 that are positioned immediately below the lower plate 92 of the table unit 24. The lower plate 92 rests directly on the tubes 100 and each tube 100 is provided with a plurality of spaced through openings 104 that are aligned with and directly adjacent to corresponding openings 102 in the lower plate 92. The plate and tube perimeter edge portions around these openings 102 and 104 are joined by a circumferential weld 106 that forms a fluid tight and gas tight seal around each pair of aligned openings 102 and 104. These tubes 100 are spaced laterally across the processing area so that these openings 102 and 104 provide adequate flow paths throughout the entire area of the chamber 96.

The rear ends of the tubes 100 are (see FIG. 11) formed with right angle sections 108, each of which extends laterally and connects with a related outlet fitting 110 (see FIG. 3) mounted in the wall of the vessel 12. As shown in FIG. 3, each fitting 110 is connected through a line 112 to a related outlet valve 114 which leads through a line 116 to a selected one of several tanks (to be described hereinafter). Also, one line 112 that is connected to the tube 100 nearest the centerline of the main pressure vessel 12 is connected to an equalizing valve 118 which leads back into the interior of the vessel 12 through a line 120.

Each of the valves 114 and the valve 118 is operated in a manner to either create a pressure differential between the plate unit chamber 96 and the interior of the vessel 12, or to equalize the pressure in the chamber 96 and inside the vessel 12.

It is to be understood that the aligned openings 102 and 104 are positioned not only along the longitudinally aligned sections of the tubes 100, but also in the curved and right angle sections 108 so that these openings pairs 102–104 are positioned throughout substantially the entire surface of the table unit 26.

To describe in more detail the dewatering/washing plate assembly 28, this assembly comprises a main horizontal rectangular contact plate 122 having a peripheral side wall 124 extending entirely around the side edges of the plate 122. This plate 122 is lowered and raised by a set of four pistons 123, two of which are shown somewhat schematically in FIG. 3.

Figure 13:
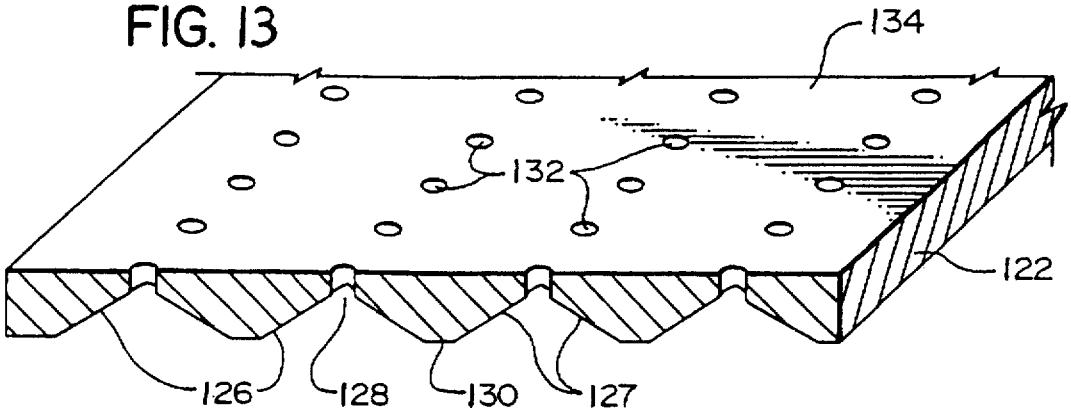
FIG. 13 is a perspective view of a portion of the contact plate of the apparatus of FIG. 2.

As can be seen in FIG. 13, the contact plate 122 is formed on its lower side with a plurality of longitudinally extending inverted "V" shaped grooves 126, each groove 126 being formed by slanting surfaces 127 that lead to an upper apex line or strip 128, and each pair of adjacent grooves forming a lower ridge line or strip 130 where the adjacent sides of adjacent grooves meet one another. The contact plate 122 is formed with a plurality of evenly spaced vertical through openings 132 extending along the length of each apex strip 128. Thus, when wash liquid is placed on the top surface 134 of the contact plate 122, the liquid flows through the openings 132 and into the grooves 126 at the location of the apex strips 128.

At this point the function of the dewatering/washing plate assembly will be described briefly, but there will be a more detailed description of its operation later herein. After the pulp slurry is initially discharged from the headbox 20 and manifold system 22 into the processing area 18 inside the enclosure frame 26 (which is in its lower position), the plate assembly 28 is lowered so that the contact plate 122 comes into contact with the upper surface of the pulp slurry. At the same time, there is a pressure differential between the interior of the vessel 12 and the pressure differential chamber 96 so that the pressure applied to the top of the contact plate 122 acts to push the plate 122 downwardly.

The pressure inside the vessel 12, in addition to pushing on the upper surface 134 of the plate 122, also exerts pressure through the openings 132 to bear directly against the pulp located at the opening 132. The pressure on top of the contact plate 122 causes the liquid in the pulp slurry to flow downwardly through the conveyor belt 34, through the plate openings 102–104 and into the pressure differential chamber 96 which is at this time at a low pressure level.

As the dewatering operation is just being completed, the wash cycles begin. A first layer of wash liquid is deposited on top of the contact plate 122, and this wash liquid flows through the openings 132 downwardly through the pulp mat to cause a liquid displacement washing operation. At the completion of the washing cycles the valves 114 and 118 are operated to equalize the pressure in the pressure differential chamber 96 with the pressure in the vessel 12, the dewatering/washing plate unit 28 is raised, and the enclosure frame 26 is also raised. Then the conveying belt 34 is moved to move the processed pulp mat through the discharge assembly 40 to a location outside of the pressure vessel 12.

Figure 18:
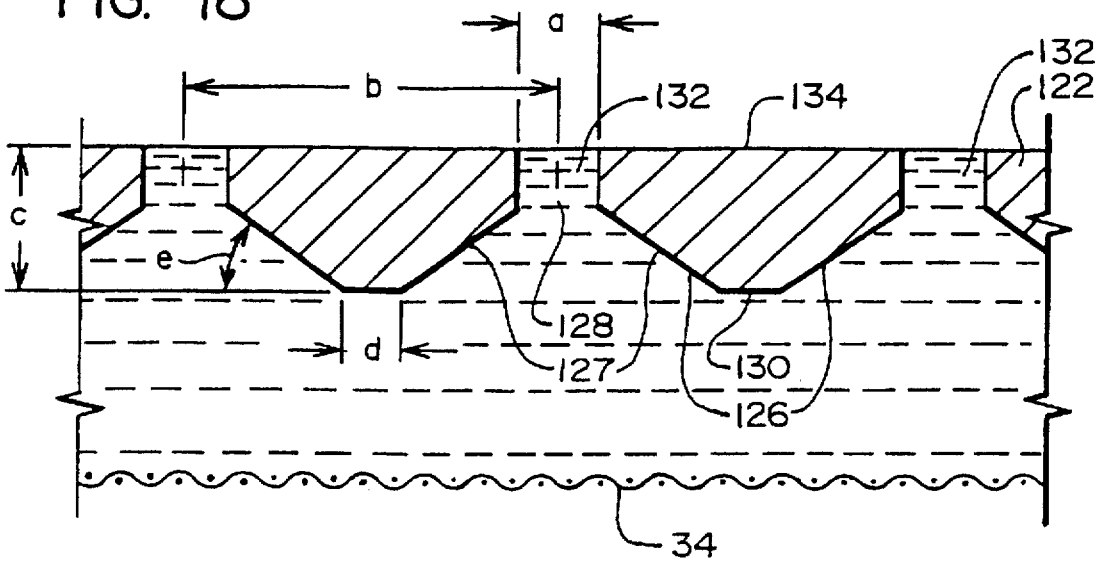
FIG. 18 is a transverse cross-sectional view of the contact plate.

To describe further the configuration and operation of the contact plate 122, reference is now made to FIG. 18. First, with regard to the dimension and configuration of the contact plate 122, in one embodiment which has been found to operate effectively, the diameter of the openings 132 (indicated at "a") were made as 3/32 inch. The lateral spacing of these openings 132 from one apex line 128 to another is ½ inch (indicated at "b" in FIG. 19) and the longitudinal spacing along each apex line 128 is ½ inch. The total depth dimension of the plate 122 (indicated at "c") is ¼ inch. The width of the apex line 130 (indicated at "d" in FIG. 19) is 1/16 inch. The angle of slant of the surfaces 127 relative to the horizontal was about 30° (indicated at "e" in FIG. 18).

It is to be understood, of course, that the dimensions and angles presented above are given simply by way of example of a contact plate 122 that has been found to work effectively, and these could be varied. With regard to the spacing and the diameter of the openings 132, the total cross-sectional area of these openings 132 should be great enough to permit an adequate rate of flow of the wash liquid through the openings 132 and into the pulp mat. Yet present analysis indicates that the size of the opening 132 should be sufficiently small and the spacing of the openings sufficiently great so that the contact plate 122 had adequate area to maintain its capability to enhance the dewatering operation.

It has been found that the use of this contact plate 122 in the present invention enhances both the dewatering and the washing operation. It was found experimentally that when the pulp slurry was dewatered to a certain consistency (in the order of about 20 to 25 percent) without use of the contact plate 122, further dewatering was not accomplished, because as the pressure differential continued to be applied, small air passageways (or steam passageways, if steam is present in the vessel 12) would form through the pulp mat, causing a "fingering", a blow-by condition.

On the other hand when the pressure plate 122 was used in the manner indicated above, it was found that the dewatering process could be continued until (for the same type of pulp slurry) the consistency of the pulp slurry was raised to as high as 25 to 35 percent before further effective dewatering could not be accomplished.

Also, as indicated above, the use of the contact plate 122 enhances the wash operation. There is what is called a "dilution factor" where during each washing operation a certain portion of the black liquor that is removed from the pulp mat is diluted by fresh wash water in the system. If a higher percentage of the black liquor is removed during the dewatering process, then there is less black liquor that needs to be removed during the washing process. Thus, for the same dilution factor (which in the preferred embodiment of the present invention is one or less), there is less black liquor to be removed during the washing cycle and hence less wash water is needed for each cycle of displacement washing cycle.

Attention will now be directed toward the countercurrent liquid recirculating system of the present invention. In the following description, a three stage wash cycle is described. Further analysis has indicated that this could advantageously be a five stage wash cycle or possibly more than five wash cycles. However, for ease of explanation, only three wash cycles are described.

As indicated previously, there are three wash water discharge troughs 32 which are utilized to accomplish (in the present embodiment) three wash cycles. Each trough 32 has the configuration of half of a cylindrical shell, where the cylinder has been divided along a plane coinciding with the center axis of the cylinder. Each trough 32 is rotatably mounted about its center axis of curvature 136 in a manner that by rotating the trough 32 ninety degrees, the liquid in the trough can be discharged by gravity flow onto the contact plate 122. Each trough 132 is fed by a respective inlet pipe 138. Each pipe 138 extends through the pressure vessel and is connected to a respective feed tube 140.

In the liquid flow system described more fully in U.S. patent application Ser. No. 07/898,944, there are three liquid receiving tanks. These are operatively connected to the tubes 100 in a manner that the liquid in the system is recirculated in a counterflow pattern as described in U.S. patent application Ser. No. 07/898,944. Since this precise pattern of recirculation is not necessary for a proper understanding of the system of the present invention, it will not be described in detail herein.

The process of the initial dewatering and washing accomplished by the apparatus 10 is started by initially depositing a charge of wood pulp, having a consistency of, for example, one and one half to two and one half percent onto the conveying belt 34 at the table unit 24, where it immediately begins to flow laterally to form a layer. As soon as about one quarter to one half of the charge of the wood pulp is deposited on the table unit 24, the valves 114 connected to some of the collecting tubes 100 are opened (with the equalizing valve 118 being closed at this time) to connect these tubes 100 to a low pressure area, which for dewatering could be the pressure at a black liquor collection tank. This causes the pressure in the table unit chamber 96 to drop to create the pressure differential between the interior of the vessel 12 and the lower pressure in the table unit chamber 96, which in turn causes liquid to flow from the pulp slurry into the chamber 96, and thence into the collecting tubes 100.

As indicated previously, as soon as the full charge of pulp has been deposited on the table unit 24, the dewatering/washing plate assembly 28 is immediately lowered so that the contact plate 122 comes into engagement with the upper surface of the pulp slurry. As described previously, the pressure differential between the interior vessel pressure above the plate and the lower pressure below causes the plate 122 to press down on the pulp slurry, and also gaseous pressure is exerted through the openings 132. This enhances the movement of the black liquor that is in the pulp slurry out of the pulp, into the chamber 96 and thence into the tubes 100.

When this initial dewatering step is just being completed one of the troughs is rotated ninety degrees to deposit the wash liquid in that trough 32 onto the top of the contact plate 122. Since the pressure differential between the interior of the vessel 12 and the chamber 96 remains, the wash liquid indicated at 164 is caused to move into the pulp mat and begin a displacement washing cycle.

When the batch of washing liquid has moved into the mat, then the open valves 114 leading from the related tubes 100 are closed, and the other two valves 114 which connect to other tubes 100 are opened. At this second point the trough 32 is rotated ninety degrees and the next batch of wash liquid is deposited on the contact plate 22. The liquid that is now being removed from the wood pulp is directed to a collection tank. This process can be repeated to accomplish as many wash cycles as desired.

It should be pointed out that as a final step, the liquid that is finally moved into the pulp mat, so as to remain in the pulp mat when the pulp mat is moved from the apparatus 10, normally has dissolved or suspended therein a chemical compound or substance (e.g. a bleaching agent or a chemical compound to change the pH or have some other effect) to be used in a subsequent operation.

The next step is to remove the processed pulp mat 158 from the processing area 18 and also to a location outside of the main pressure vessel 12. To accomplish this, first the enclosure frame 26 and the dewatering/washing plate assembly 28 are both raised, and the belt 34 is moved in a forward direction to carry the processed pulp mat 58 to the discharge assembly 40.

Figure 14:
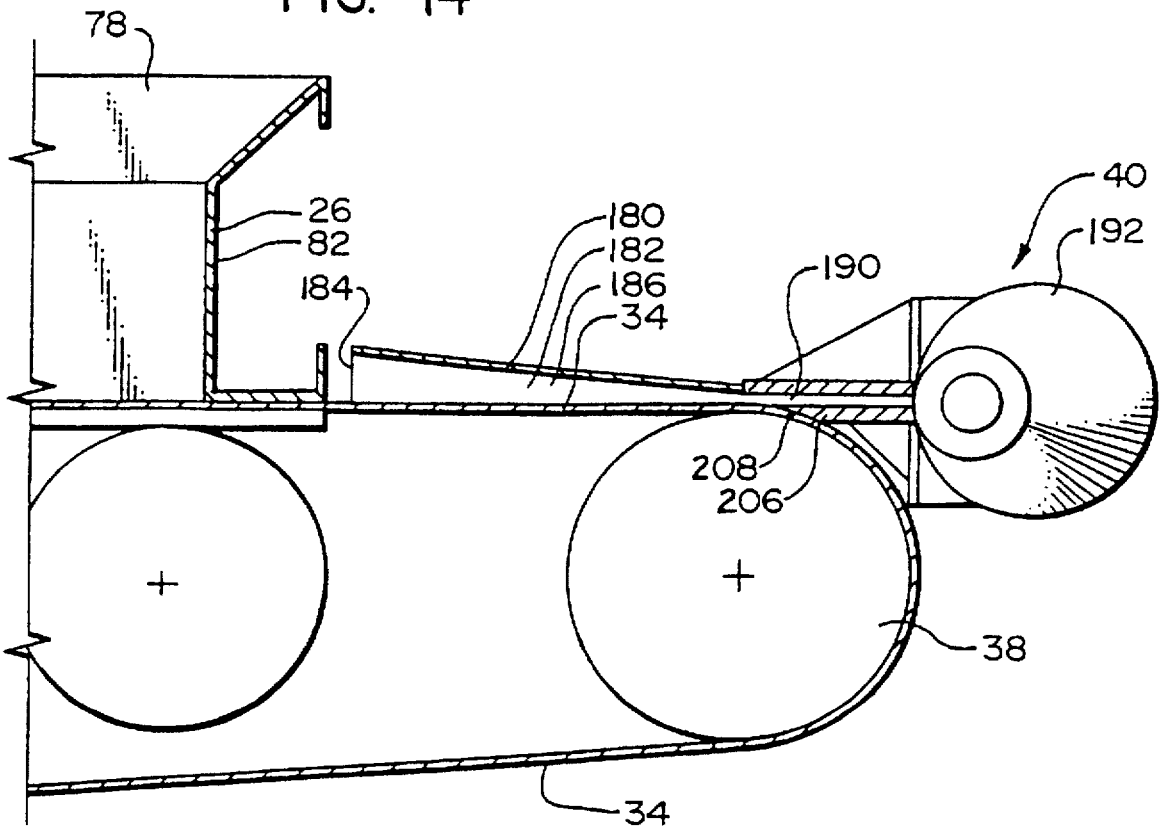
FIG. 14 is a side elevational view of the pulp discharge assembly of the apparatus of FIG. 2.
Figure 15:
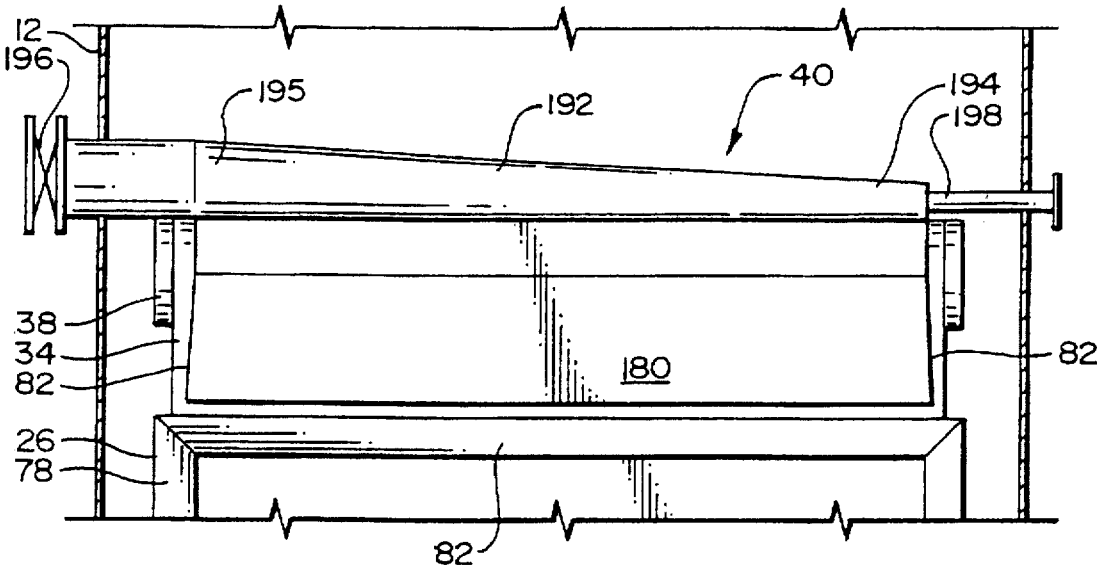
FIG. 15 is a top elevational view of the discharge assembly of FIG. 14.
Figure 16:
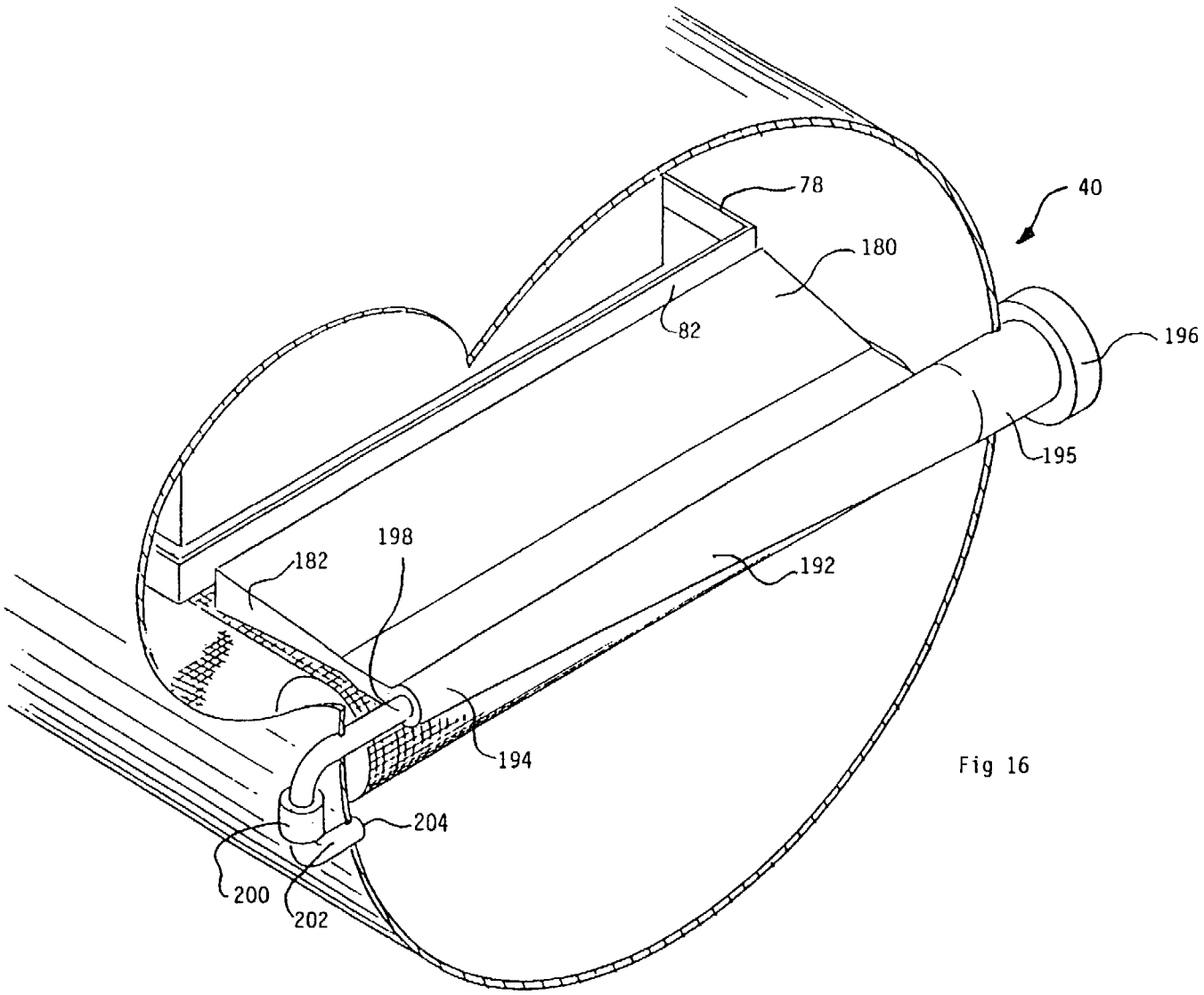
FIG. 16 is an isometric view of the discharge assembly as shown in FIGS. 14 through 15.

As can be seen in FIGS. 14, 15 and 16 the discharge assembly 40 comprises a guide plate 180 that has two side plates 182 that defines with the underlying belt 34 an inlet 184 which has a height dimension moderately greater than the thickness dimension of the processed pulp 158. The plate 180 slopes very moderately downwardly in a forward direction so that the passageway 186 leading from the inlet 184 and defined by the plates 180 and 182 and the upper run of the belt 34 tapers in thickness in a forward direction. The effect of this is that the pulp layer becomes squeezed to a moderate extent in the passageway 186 as it progresses forwardly.

The effect of so moving the pulp into the passageway 186 is to substantially close the rear end of the passageway 186 so that very little of the gas (e.g. air or steam) within the vessel 12 passes through the passageway 186. The passageway 186 at its rear end terminates in a discharge passageway portion 190 having a substantially constant cross-sectional area. This forward passageway section 190 leads into a discharge chamber defined by a discharge housing 192. This discharge housing 192 has a generally frusto-conical configuration, having at its side a right side 194 a smaller cross-sectional area and extending laterally through the opposite side of the vessel 12 where it has a more expanded area 195. At the outlet end, there is an outlet valve 196 that connects to a tube or other member that leads to the next processing station. There is a gas pressure line 198 leading into the right end 194, and this line 198 connects through a valve 200 to an elbow 202 that leads into the interior of the pressure vessel 12 at 204.

There is a doctor blade 206 having a forward edge 208 that removes the pulp mat from the belt 34. This doctor blade 206 defines the lower portion of the aforementioned passageway 190.

In operation, when the dewatering and washing cycle has been completed, the belt 34 is moved to in turn move the forward edge of the pulp mat through the entryway 184 and into the passageway 186. When the pulp mat has moved forward to the extent that it substantially encloses the passageway 186, then the valve 196 is opened, thus reducing the pressure in the discharge housing 192 to a lower level. This enhances the movement of the pulp mat toward the discharge housing 192. As the pulp mat begins to be discharged from the forward passageway portion 190 into the housing 192, then the valve 200 can be selectively opened to cause the high pressure gas in the vessel 12 to pass into the inlet 204, through the valve 200 and into the housing 192 to assist in blowing the pulp material outwardly from the housing 192 and through the valve 196. When the pulp mat has been discharged, then these valves 200 and 196 are closed.

Figure 17:
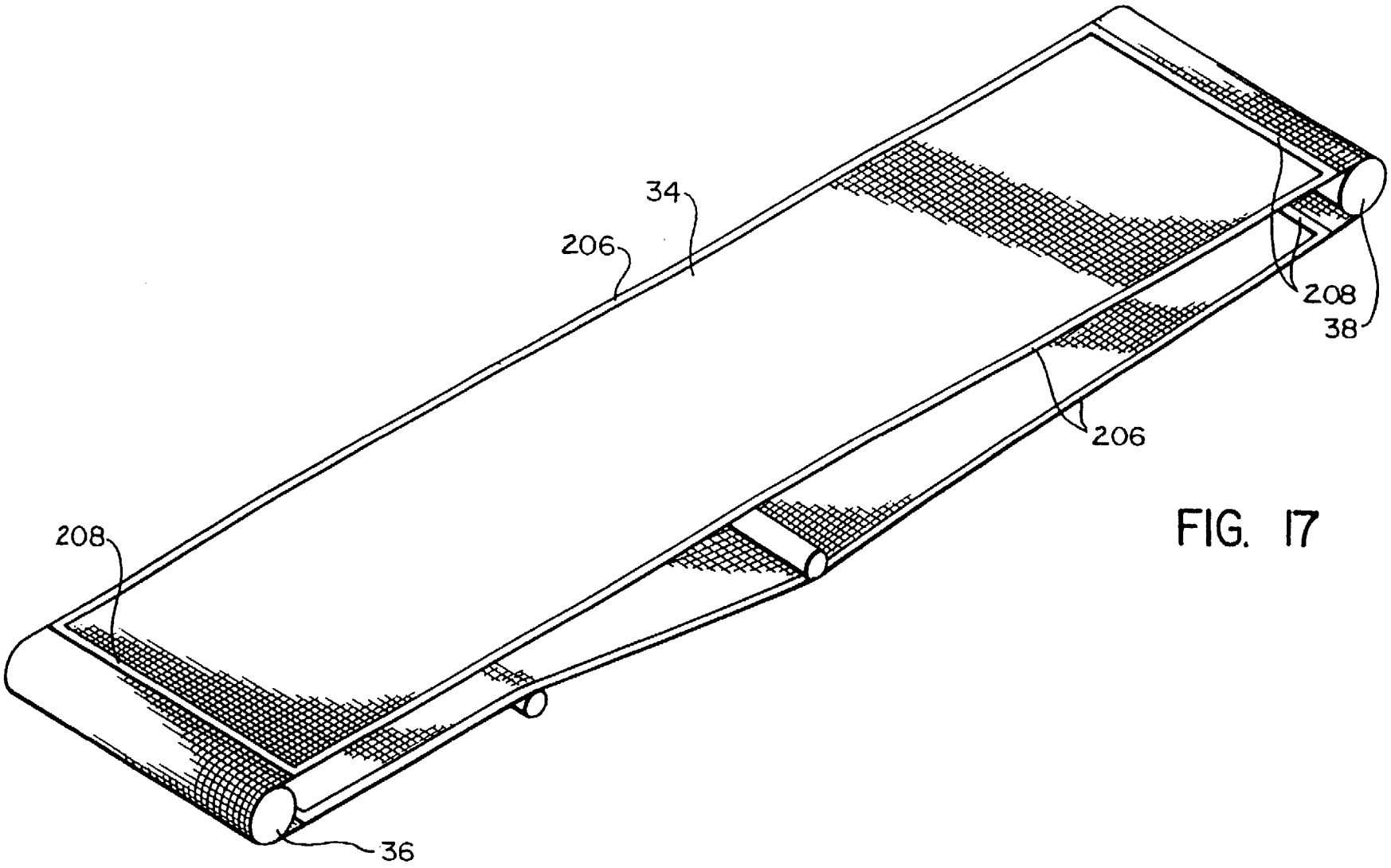
FIG. 17 is an isometric view of the conveying belt of the apparatus, and showing also the rollers associated therewith.

To further describe the conveying belt 34, reference is made to FIG. 17. It can be seen that the belt 34 has two edge strip portions 206 and four transverse strip portions 208 that are made imperforate. These strips 206 and 208 engage the lower edge portions of the enclosure frame 226 to make a seal. After the dewatered and washed pulp mat is discharged from the upper run of the belt 34, the lower run moves to become the upper run of the belt for a second dewatering and washing operation.

As indicated previously, one of the desirable features of the apparatus 10 is that with the entire process being performed within the pressurized vessel 12, it becomes more practical to operate with much higher pressure differential across the pulp mat, and also to operate at higher temperatures, if desired. This leads to a number of advantages in the system of the present invention.

With the foregoing detailed description of the apparatus having been completed, the overall operations of this apparatus 10 will now be summarized. Initially, the vessel 12 is pressurized to an above atmospheric operating pressure. Generally, the pressurized gaseous medium within the vessel 12 is air, steam, or a combination of air and steam. Also, desirably the temperature within the vessel 12 is maintained at a level above ambient temperature, this depending on operating pressures and other factors.

A pulp slurry is directed through the pipe inlet 44 to flow into the headbox 20, until the headbox 20 is filled to an adequate level (i.e. to the level 48 as shown herein). Also the enclosure frame 26 is lowered onto the table unit 24 and the plate assembly 28 remains in its raised position. Then the valves 71 in the manifold outlet members 72 are opened to cause the pulp slurry in the headbox 20 to flow through the manifold 22 and through the outlets 74 onto the portion of the upper run of the conveyor belt 34 that is within the enclosure frame 26. The pulp slurry typically would have a consistency of one and one half to two and one half percent, and at that consistency it would readily flow across the table unit to form a substantially uniform layer within the enclosure frame 26.

While the pulp slurry is flowing onto the table unit 24, as soon as this pulp slurry has reached a sufficient depth so that the dewatering process can begin (typically in the order of 3 to 4 inch), the valve 114 that leads from one set of the conduits 100 is opened to lower the pressure in the variable pressure chamber 96 in the plate assembly 88. At the same time, the equalizing valve 118 is closed (or remains closed). This pressure differential causes the liquid in the pulp slurry to begin flowing through the foraminous conveying belt 34 and through the openings 98 in the plate 90, thence into the chamber 96, from which the liquid flows through the openings 104 that lead into the conduits 100. These conduits 100 in turn direct the liquid into the tank.

As soon as the first batch of pulp slurry has been completely discharged through the openings 74 into the processing area 18, then the contact plate 122 is promptly lowered onto the upper surface of the pulp slurry. As described in more detail previously herein, the gaseous pressure above the plate 122 pushes downwardly on the plate 122 to cause it to press against the pulp slurry and assist in the dewatering operation. At the same time, gaseous pressure acts through the openings 132 directly against the pulp slurry. This pressure differential is maintained until the desired amount of liquid has been removed from the pulp slurry to form the pulp mat.

As soon as the dewatering step is completed, then the troughs 32 are tipped sequentially to deposit the wash liquid onto the pulp mat. The wash cycles are accomplished as described above.

When the final wash cycle is completed, then both the enclosure frame 26 and the contact plate 122 are raised, the valves 114 that are open are then closed and the equalizing valve 118 is opened to raise the pressure in the table unit chamber 96 to the level in the vessel 12. With the pressure being so equalized, the only force bearing on the upper surface of the conveyor belt 34 is the weight of the pulp mat. Then the conveyor belt 34 is moved to cause the pulp mat to move into the discharge assembly 40. Then the discharge assembly is operated as described previously herein to move the pulp mat out of the pressure chamber of the vessel 12.

Figure 19:
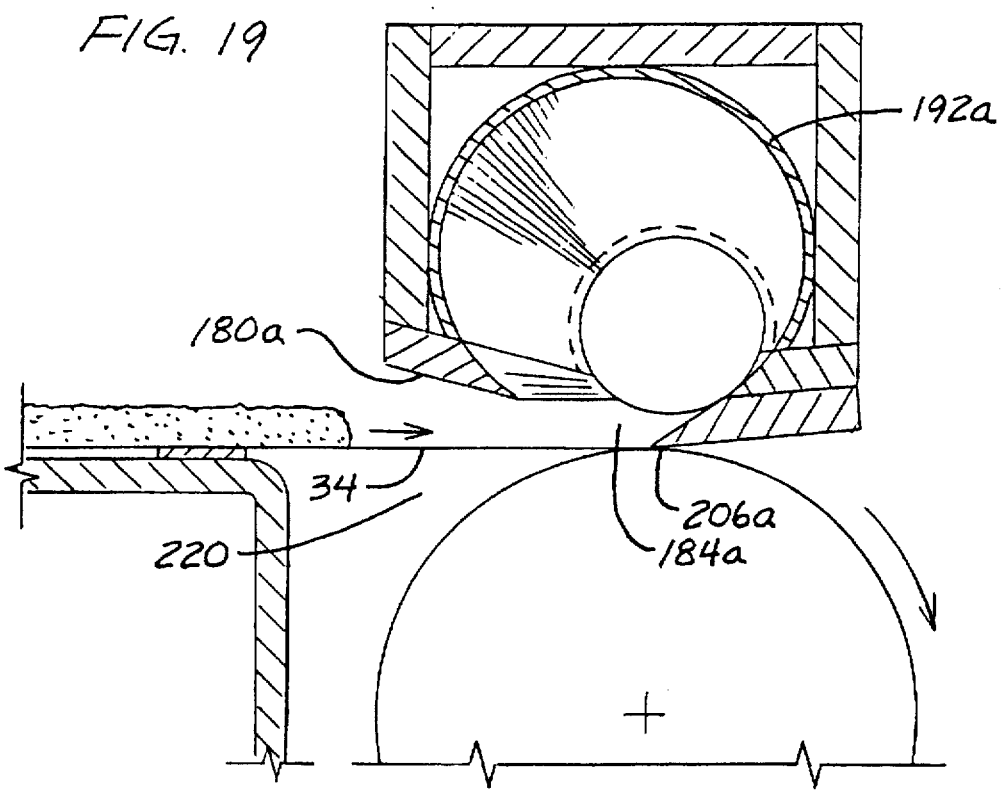
FIG. 19 is a sectional view similar to FIG. 14 showing a modified version of the pulp discharge assembly of the apparatus.
Figure 20:
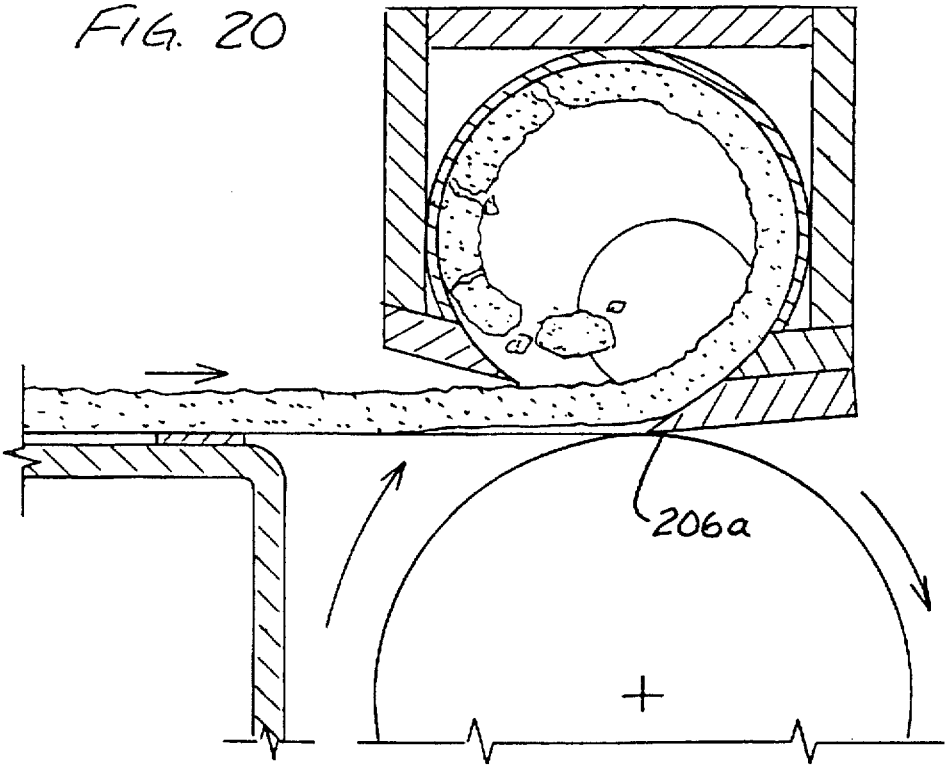
FIG. 20 is a view similar to FIG. 19 showing the pulp having entered the housing of the discharge assembly.
Figure 21:
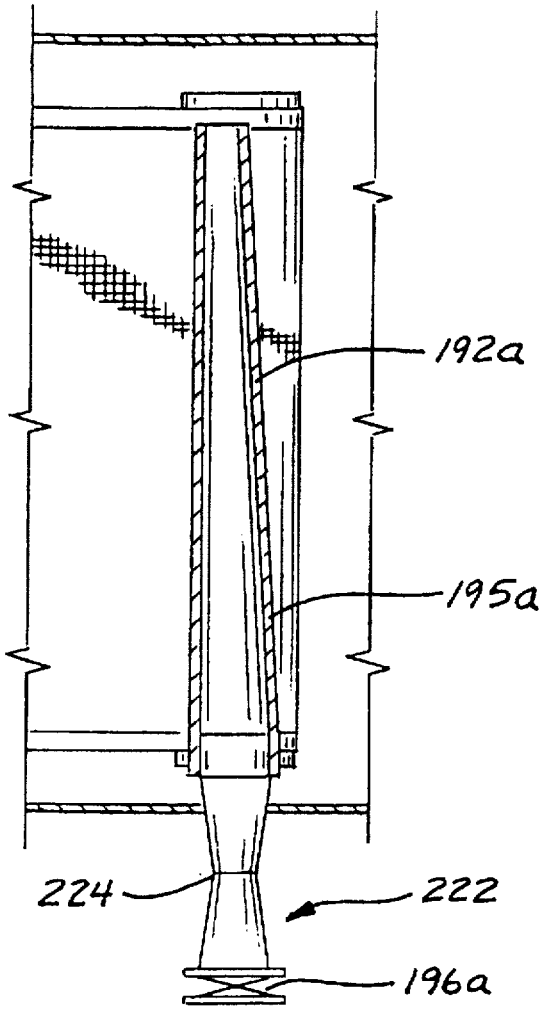
FIG. 21 is a top plan view, partly in section, of the modified version of FIGS. 19 and 20.

A modified form of the discharge assembly 40 is illustrated in FIGS. 19 through 21. To distinguish this modified form and the components thereof, like numerical designations will be used for components similar to the discharge assembly 40, with an "a" suffix distinguishing those of the modified form.

As in the original version of the discharge assembly 40, the present assembly **40*a* has a guideplate 180*a* positioned above the belt 34. This plate 180*a* with the belt 34 defines an inlet 184*a*, and has a downward and forward slope. The longer inlet passageway 186 as shown in the first version described previously herein is substantially eliminated, and the inlet 184*a* actually is sufficiently short so that it does not have a clearly defined inlet and outlet. It will be noted that this inlet 184*a* leads substantially directly into the chamber defined by the housing 192*a*. Further, the area 220 immediately below the belt 34 immediately adjacent to the inlet 184*a* is at the pressure level within the pressure vessel so that the gaseous medium below the belt acts to move the pulp from the belt 34 directly into the interior of the housing 192*a* (this being illustrated in FIG. 20.) The doctor blade 206*a* is positioned at a further forward location so that the pulp mat is actually lifted off the more forward part of the belt 34 when the pressure differential is applied before it reaches the doctor blade 206*a***.

With reference to FIG. 21, it can be seen that at the expanded portion 195 of the housing **192*a*, there is a venturi section 222 that leads from the housing 192*a* and to the valve 196*a*. As will be described later herein, this venturi section 222 accelerates the pulp which is being blown from the housing 192*a* through the throat portion 224 of the venturi, after which it recovers its static pressure. In the system of the present invention, when a gaseous medium, such as oxygen ($O_2$) or ozone ($O_3$) is used in subsequent bleaching, this can be introduced into the system at the location of the venturi 224** which enhances the mixing process and acts as a shredder for the discharged pulp.

It will be noted that the aforementioned valve 200 and pipe sections 198 and 202 of the first version of the discharge assembly 40, are eliminated in this modified version, since the gaseous medium from within the pressure vessel enters directly into the entry portion 184 to blow the pulp toward the exit end where the valve 196*a* is located.

Figure 23:
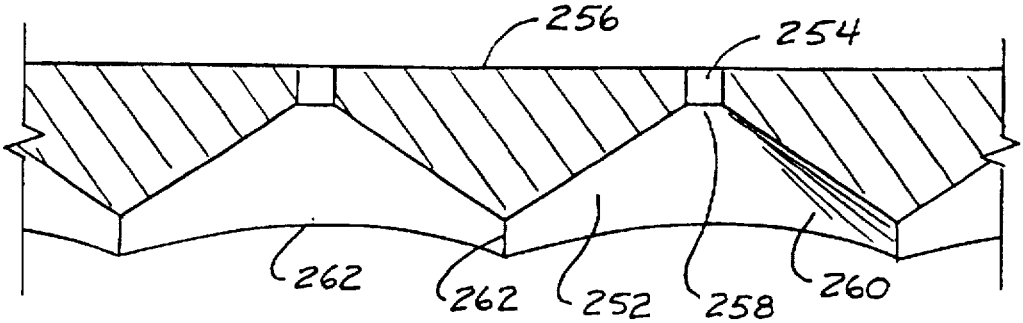
FIG. 23 is a sectional view taken along line 23—23 of FIG. 22.
Figure 24:
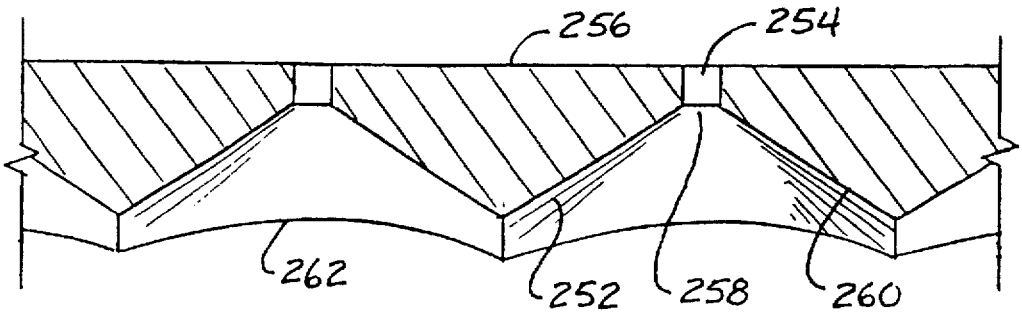
FIG. 24 is a sectional view taken along line 24–24 of FIG. 22.
Figure 22:
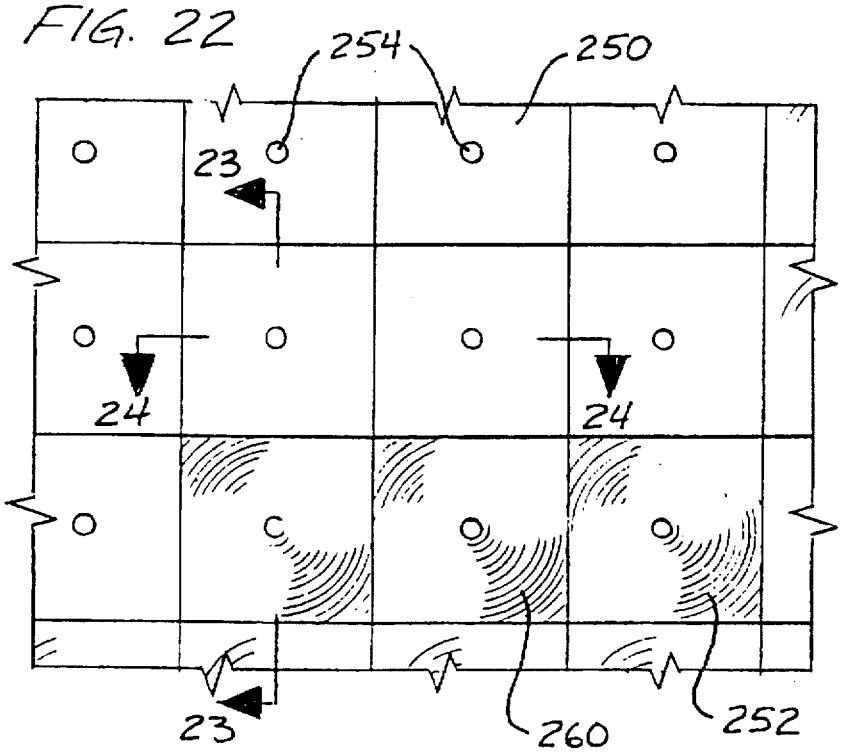
FIG. 22 is a bottom plan view of a modified form of the contact plate of the present invention.

A modified form of the contact plate 122 is illustrated in FIGS. 22 through 24. This modified plate 250 differs from the plate 122 in that instead of providing V shaped grooves 126, there is provided a plurality of conically shaped recesses 252 arranged in a square pattern. The plate 250 has a plurality of through openings 254 arranged in a regularly spaced square pattern, extending from the upper plate surface 256, each to an upper apex location 258 of a related recess 252. It can be seen that each recess 252 is defined by a surface 260 having the configuration of a truncated cone, with the lower edges of each fusto-conical surface 260 overlapping with one another, so that the juncture line to adjacent surfaces 260 each define a crescent shaped lower edge 262. Thus, it can be seen that liquid flowing through the opening 254 is able to flow down along each frusto-conical surface 260 in an expanding downward pattern.

C. The First Embodiment of the System of the Present Invention

This first embodiment of the system of the present invention is described in the earlier U.S. patent application, Ser. No. 08/020,324 (of which this present application is a continuation-in-part), and is thus an earlier design. Since that design was originated there have been further modification and improvements, and these are incorporated in the second embodiment which is described in Section E of this text. While the first embodiment described in this section is believed to be a significant advance over the prior art, the later embodiment described in Section E is presently believed to be the preferred embodiment of the present invention.

Figure 25:
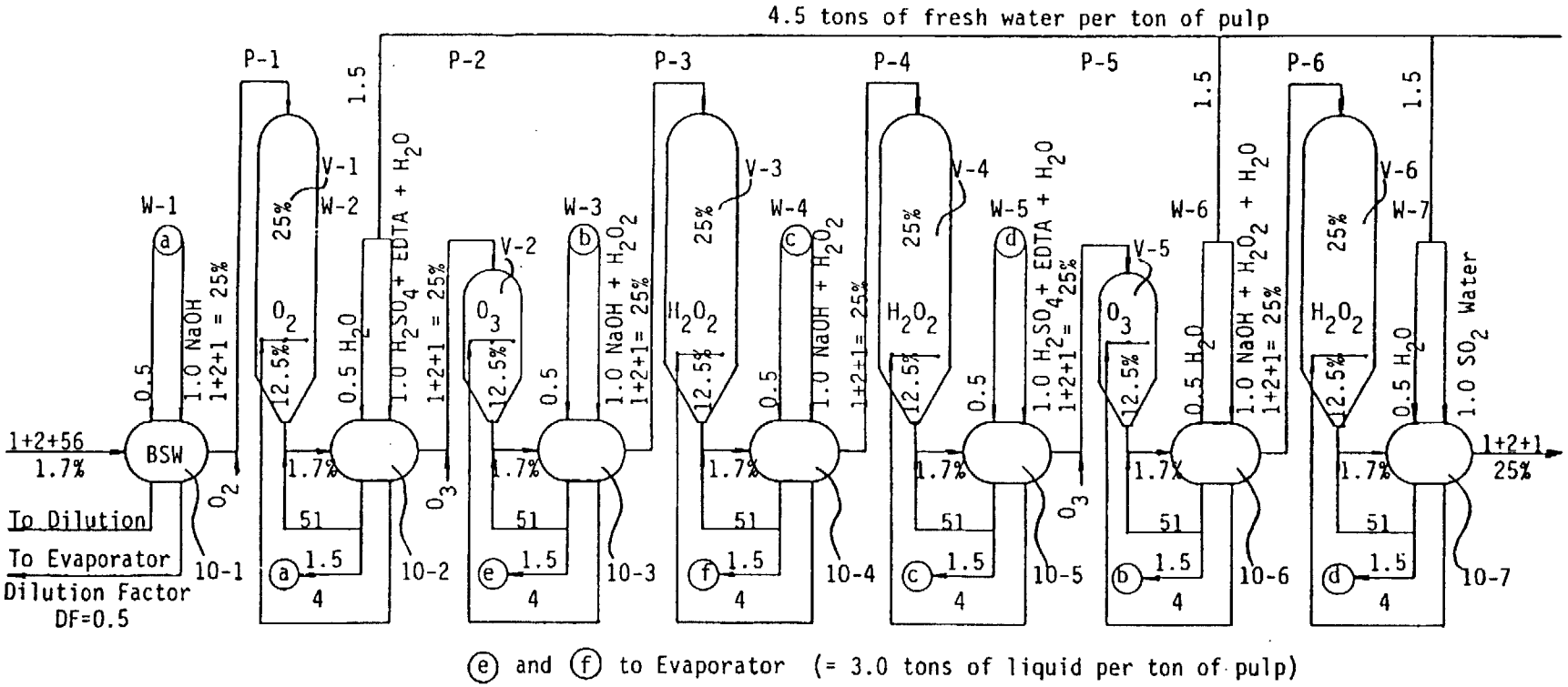
FIG. 25 is a schematic drawing of the system of the present invention, utilizing the dewatering/washing apparatus shown in FIGS. 2–21.

The system of the present invention is illustrated somewhat schematically in FIG. 25. In the particular embodiment of the system shown herein, there are seven washing stations, (each of which has a dewatering/washing apparatus 10 as described above) and six processing stations interspersed with the washing stations. In the particular arrangement shown herein, in the first processing station, the pulp is treated with oxygen ($O_2$); in the second and fifth processing station the pulp is treated with ozone ($O_3$); and in the third, fourth and sixth processing station, the pulp is treated with hydrogen peroxide ($H_2$ $O_2$). However, it is to be understood, of course, that the number of washing stations and processing stations, and also the particular treatment given the pulp at any particular processing station could be varied, depending upon the type of pulp being processed, the end pulp product desired, and other factors. Thus, the processing compounds specified, the specific values specified and the steps presented in this description of the system of FIG. 25 are intended to relate to one preferred embodiment, and obviously modifications could be made.

Also, in describing the system of FIG. 25, there will be given specific numerical values as to the consistency of the pulp at various stages, relative units of different portions of the liquid and the pulp, certain pressure levels and temperatures, and other detailed processing information. This is done to present what is presently believed to be a preferred embodiment that is generally representative of the type of system that would be contemplated for commercial use, and is not intended to be limiting. Further, these values are given so that a clearer understanding of the operating advantages of the system of the present invention over the prior art can be obtained. However, further analysis and development may indicate other numerical ranges or values may be preferred.

To describe now the system of the present invention as shown in FIG. 25, the seven dewatering and washing stations are designated W-1 through W-7, and the six processing stations are designated P-1 through P-6. For convenience, the dewatering and washing stations will simply be referred to each as a "washing station", since the major portion of the equipment (i.e. the apparatus 10) at each of these stations W-1 through W-7 is normally referred to as "a washer". As will become apparent, however, from the following detailed description, at each washing station there is accomplished a dewatering, and also the introduction of the processing chemicals or compounds and/or bleaching agents into the wood pulp for treatment of the pulp during the retention period at the processing station.

The pulp from a digester (not shown in FIG. 25) is introduced into the initial washer 10-1, a preferred embodiment of which is disclosed above as the apparatus 10 and shown in FIGS. 2 through 24. In this particular embodiment, the consistency of the pulp slurry being directed to the washer 10-1 is specified as 1.7% (but this could be varied). At such consistency, for every one part of pulp fiber, there would be two parts of liquid within the fibers themselves, and fifty six parts liquid between and around the fibers. This slurry is first dewatered and then subjected through a number of wash cycles in the washer 10-1, as described previously herein in the more detailed description of the apparatus 10.

During the last wash cycle, the liquid that is deposited on the pulp mat contains sodium hydroxide. This liquid with sodium hydroxide remains in the pulp mat, which is then discharged from the washing apparatus 10-1 to be directed toward the top of a first pressurized processing vessel V-1. The sodium hydroxide raises the pH level of the pulp mat (e.g. to a pH of 9–11) so that the oxygen to be introduced reacts in the desired manner with the pulp.

The pulp being discharged from the washer 10-1 then has the oxygen ($O_2$) introduced therein (desirably in the form of liquid oxygen which vaporizes and permeates throughout the discharged pulp). This is desirably accomplished by placing in the discharge conduit leading from the discharge valve 196 of the discharge housing 192 a tube having a venturi section which enhances the mixing with the oxygen, and the oxygen is introduced at the location of the venturi. This pulp, containing the sodium hydroxide, and also having the oxygen introduced therein is then directed into the top of the pressure vessel V-1.

The pressure in the vessel V-1 is maintained at a level moderately below that in the chamber of the washer 10-1. For example, with the pressure in the chamber of the washer 10-1 being nine bars (i.e. nine times atmospheric pressure), the pressure in the vessel V-1 could be about six bars. Thus there would be a three atmosphere pressure drop so as to drive the pulp from the washer 10-1 to the vessel V-1. The temperature maintained in the vessel V-1 is desirably at a relatively high temperature (e.g. 115° C.), this being made possible by the relatively high pressure maintained in the vessel V-1.

The pulp in the vessel V-1 is extracted on a continuous basis from the lower part of the vessel V-1, so that the pulp deposited in the top part of the vessel V-1 gradually descends toward the bottom. The timing is such that the total retention time in the vessel V-1 for any one portion of pulp would be, for example, forty minutes. Liquid from the washer 10-2 is introduced into the lower part of the vessel V-1 to decrease the consistency of the pulp to, for example, twelve and one half percent in the lower part. Thus, for approximately the last ten minutes of this forty minute retention period, at twelve and one half percent consistency there is one part pulp fiber, two parts liquid within the fibers themselves, and five parts liquid surrounding and between the fibers.

One of the main reasons for introducing this liquid into the pulp in the lower part of the vessel V-1 is that this will cause a dilution of the liquid in the pulp fibers that carry the oxidized residue therein. During the retention period in the upper part of the vessel V-1, the oxygen is reacting with the material in the fibers, and since the consistency of the pulp is very high in the upper portion of the vessel V-1, for example twenty five percent, there is little, if any, liquid surrounding the fibers to cause the oxidized residue within the fibers to move out from he fibers. However, when the liquid is added in the lower part of the vessel V-1 to lower the consistency, the liquid within the fibers, having a high concentration of the oxidized residue, has the contained residue diffused outwardly through the fibers into the surrounding liquid.

The pulp which is discharged from the lower part of the vessel V-1 is then mixed with liquid circulated from the second washing apparatus 10-2 so that the consistency of the pulp drops to a 1.7% level. This pulp in turn is introduced into the headbox 20 of the second stage washing apparatus 10-2.

It should be noted that a small amount of liquid is being added to the washer 10-1 at the location indicated at "a". This portion of liquid is taken from the liquid outflow from the second washer 10-2 and recycled in an "upstream" direction (i.e. to the washer 10-1). The liquid from the second stage washer 10-2 is cleaner than the liquid being recirculated in the first stage washer 10-1, and this flow from the second stage washer 10-2 works to replenish the washed liquid in the first stage washer 10-1, so as to keep the impurities at a sufficiently low level. Also, part of this portion of liquid being recirculated at "a" in the washer 10-1 is liquid that is mixed with the sodium hydroxide which is introduced into the pulp in the very final washing stage. This is accomplished so that if, for example, 1.5 units of the liquid is recirculated from washer 10-2 to the washer 10-1 for each unit of pulp, 0.5 units of this liquid is introduced into the wash water, and the remaining 1.0 units of this liquid is separately mixed with the sodium hydroxide so that it moves into the mat at the very end of the dewatering/washing process to be retained, in the pulp mat, after which the pulp mat is moved from the washer 10-1 to be mixed with the oxygen and then moved into the first stage vessel V-1.

The consistency of the pulp which is discharged from the first washer 10-1 is at about twenty five percent, this being one part pulp fiber, two parts liquid retained within the pulp fibers, and one part of the liquid having the sodium hydroxide outside and between the pulp fibers.

As mentioned above, the pulp slurry discharged from the vessel V-1 is mixed with liquid from the washer 10-2 so as to be at about a 1.7% consistency, and is introduced into the second washer 10-2. The dewatering is accomplished in the washer 10-2 as described above, and at the end of the dewatering, a small amount of fresh wash water is introduced into the pulp mat. A second wash liquid containing fresh water and sulfuric acid ($H_2SO_4$) and "EDTA" (an abbreviation for ethylene diamine tetra acidic acid) is then added. In this specific embodiment, it is indicated that 1.5 units of fresh water are added, with 0.5 of these units being introduced at the very end of the dewatering cycle so as to be introduced along with some of the displaced liquid from the pulp into the first washer 10-1 at location "a". The one part of this fresh water (having the sulfuric acid and the EDTA) remains in the pulp and is conveyed into the next processing station P-2.

The sulfuric acid serves to adjust the pH of the pulp to be compatible with the subsequent ozone bleaching step. The "EDTA" is added to stop the metal ions present from reacting with the ozone. The pulp discharged from the second washer 10-2 has a consistency of about twenty five percent (one part pulp fiber, two parts liquid contained in the pulp fiber, and one part liquid containing the sulfuric acid and the "EDTA" outside and between the fibers). This is mixed with ozone ($O_3$) as the pulp is being discharged from the discharge assembly 40 of the washer 10-2, and this is in turn directed into the second pressure vessel V-2. As the pulp in the vessel V-2 descends gradually downwardly, the ozone reacts with the pulp fibers.

The total dwell time in this second vessel V-2 is about ten minutes. The pressure is at about six bar and the temperature at 70° C. In the first two minutes, the pulp is at twenty five percent consistency, and in the next eight minutes fluid from the third washer 10-3 is directed into the lower part of the vessel V-2 to lower the consistency to twelve and one half percent. As indicated above, with reference to the first vessel V-1, this is done so that the oxidized residue in the pulp fibers can diffuse outwardly into the liquid surrounding the pulp fibers. The pulp discharged from the second vessel V-2 is treated in substantially the same manner as that discharged from the first vessel V-1. One difference is, however, that the additional liquid introduced at the location "b" into the washer 10-3 is from a corresponding location "b" which is the discharge from the sixth washer 10-6. It should be noted that this liquid is derived from the washer 10-6 as displaced liquid from the pulp that has just been treated in the second ozone processing vessel V-5.

The pulp from the second vessel V-2 is diluted with liquid from the third washer and directed into the third washer 10-3. The pulp in the third washer 10-3 has sodium hydroxide and hydrogen peroxide added thereto, and is then directed into the top of the third vessel V-3. The total dwell time in this third vessel is approximately three hours and ten minutes; the pressure six bar and the temperature 90° C. For the first three hours, the pulp remains at a twenty five percent consistency, and for the last ten minutes liquid is introduced from the fourth washer 10-4 to lower the consistency to twelve and one half percent.

Essentially the same process as described before is repeated with respect to the fourth, fifth and sixth washing station (W-4 through W-6). In the fourth washer 10-4, sodium hydroxide and hydrogen peroxide are again added into the final processing as in the washing station W-3, and the liquid that carries these compounds along with supplying some replenishing liquid (as indicated above approximately 1.5 units of such liquid) is derived from location "c" which is the discharge from the fifth washer 10-5. The fourth vessel V-4 thus also is a peroxide bleaching vessel and has the same processing conditions as the vessel V-3.

In the fifth washer 10-5, liquid is indicated as being added at "d", and this is from the location "d" leading from the seventh washer 10-7. Added to a portion of this water introduced at "d" into the fifth washer 10-5 is sulfuric acid and EDTA. The pulp from the fifth washer 10-5 is directed into the fifth processing vessel V-5, which is an ozone bleaching vessel, and is processed as in the second vessel V-2. Accordingly, ozone is introduced into the pulp that is being discharged from the fifth washer 10-5 and is going in to the fifth vessel V-5.

In the sixth washer 10-6, fresh water is added, with one part of this fresh water having sodium hydroxide and peroxide added thereto. The pulp is then directed into the sixth pressure vessel V-6. The processing conditions in this vessel V-6 are substantially the same as in the other two peroxide bleaching vessels V-3 and V-4.

The pulp from the sixth vessel V-6 is then delivered to the final washer 10-7 of the washing station W-7, where in the final stage, fresh water is added, with SO2 water being added in the final wash cycle. A portion of the liquid from the washer 10-7 is directed (as indicated at "d") into the washer 10-5. The fully bleached pulp taken from the final washer 10-7 is then directed to a location for further processing.

Figure 26:
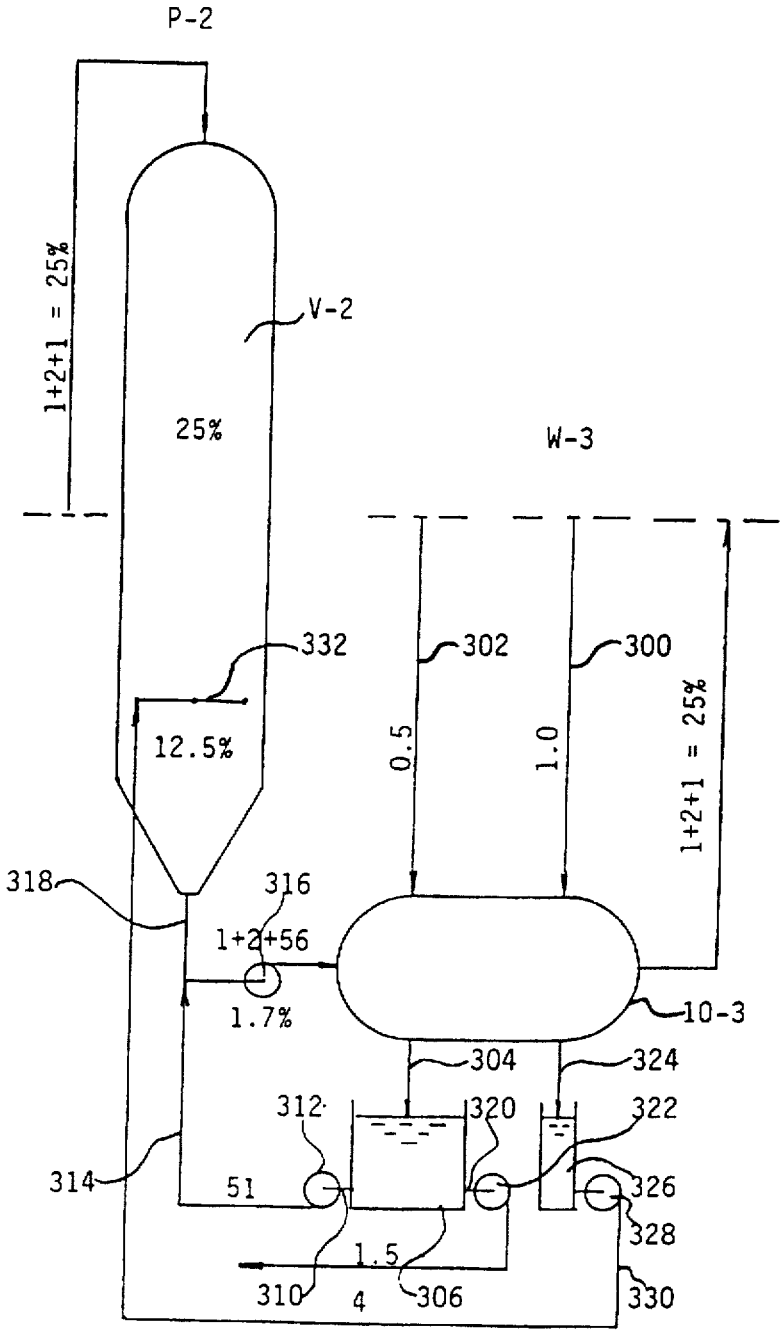
FIG. 26 is a schematic view similar to FIG. 22, but showing only a single processing station and a washing station, including more of the details thereof.

To further illustrate certain aspects of the present invention, reference is made to FIG. 26 which shows only a single washing station and a single processing station. For convenience, the washing station W-3 and processing station P-2 have been selected. Thus, there is shown the washing unit 10-3 and the pressure vessel V-2. There is a first input line 300 which delivers one unit of fresh water liquid having the sodium hydroxide and hydrogen peroxide contained therein. There is a second input line 302 through which the 0.5 units of fresh water is added. As described above, the 0.5 units of fresh water is introduced into the pulp at the very end of the dewatering process. Immediately thereafter, the one unit of fresh water with the sodium hydroxide and hydrogen peroxide is introduced in the pulp, and is retained therein for delivery into the third 0processing station P-3. For the other washers 10-2 and 10-4 to 10-7, the liquid and treating chemicals and/or compounds introduced will be those designated in FIG. 25.

There is a first discharge line 304 which leads from the washer 10-3 and directs liquid from the washer 10-3 into a holding tank 306. A line 310 leads from the holding tank 306 to a pump 312, and a line 314 leads from the pump 312 to a pump 316 that directs liquid into the washer 10-3. Another line 318 directs the pulp from the lower end of the pressure vessel V-2 to join with the liquid in the line 314 to be mixed therewith and be directed to the pump 316 for introduction into the washer 10-3.

The flow through the line 304 into the holding tank 306 is intermittent, in accordance with the operation of the washer 10 as described previously herein. On the other hand, the operation of the pump 312 and the pump is substantially continuous so that there is a substantially constant flow of the pulp slurry at about 1.7 percent consistency into the headbox of the washer 10-3.

Also, another line 320 leads from the holding tank 306 to a pump 322, and this directs a smaller portion of the liquid (i.e. one and one half units of liquid for each unit of pulp) from the tank 306 to be discharged to the evaporator. For the other washers 10-2 and 10-4 to 10-7 this 1.5 unit of liquid would either be recirculated or discharged for evaporation as indicated in FIG. 25.

Another line 324 leads from the washer 10-3, and this is directed into a second holding tank 326. The liquid that is directed into this line 324 is the liquid which is 3.5 units of liquid that flows through the pulp during the very last portion of the dewatering of the pulp, along with the 0.5 units of fresh water introduced through the line 302. Thus, there is relatively clean liquid in this holding tank 326, and this liquid is drawn from the tank 326 by a pump 328 and thence through a line 330 into the diffusion zone 332 of the pressure vessel V-2.

It can be seen with reference to FIG. 25 that the only effluent which is discharged from the system shown in FIG. 22 is that which is discharged at washing stations W-3 and W-4, indicated at "e" and "f". Further, it can be seen that the amount of this effluent from each of the washing stations W-3 and W-4 is 1.5 tons for each ton of pulp, making a total of 3.0 tons of discharged effluent for each ton of pulp that is processed. This is a sufficiently small quantity of effluent so that it can economically be directed to an evaporator. Accordingly, there is no net discharge of liquid effluent from the system into a sewer line.

In contrast to this, as discussed earlier herein, in the prior art system shown in FIG. 1, the amount of discharged effluent is in the order of twenty five or even as high as seventy five tons, depending on how many bleaching stages there are and the end brightness desired. In that prior art system, it is not economically feasible to evaporate the effluent. First, the amount of effluent is sufficiently high so that the evaporation cannot be done economically. Further, since the bleaching agents in the prior art system of FIG. 1 are chlorine and chlorine dioxide, it would be necessary to contain these in vessels or conduits made of titanium. On the other hand, in the present invention, the evaporation could take place in stainless steel containers.

Also, with reference to FIG. 25, it can be seen that for each ton of pulp that is processed, four and one half tons of fresh water are used. Three tons of this fresh water are in the effluent which goes to the evaporator. One ton of this fresh water remains in the pulp that is discharged from the final washer 10-7. Only one half ton of this fresh water goes as recirculated liquid to the brown stock washer 10-1 and is then discharged with the black liquor to the evaporator. Thus, there is from the first stage brown stock washer 10-1 only a dilution factor of 0.5.

D. Further Discussion of the Overall Dewatering/Washing/Bleaching Operation and Particularly the Washing Operation Subsequent to the design of the first embodiment of the system of the present invention described in Section C of this text, further analysis was conducted relative to the system of the present invention. This led to the design of the second presently preferred embodiment of the system of the present invention which will be discussed later in Section E. It is believed that a better appreciation of some of the significant features of the present overall invention will be obtained by analyzing at this time in more detail the dewatering/washing/bleaching operation and in particular the washing operation accomplished by the washing apparatus which was described in Section B of this text. After that, the overall system of the second embodiment will be described in Section E, and also benefits derived from that system.

In a pulp processing operation, the digester pulp in the digester is treated with various chemicals to break down various organic material, and the resulting effluent from the digester is a mixture of the black liquor and pulp. Typically, the consistency in the digester would be about twelve and one half percent, which means that there is one part cellulose fiber by weight and seven parts black liquor. The black liquor that leaves the digester is a solution containing about twenty five percent dissolved solids, with about half of these solids being organic compounds and the other half various chemicals used in the digesting process. The organic compounds include partially fragmented lignin, cellulose and hemicellulose degradation products and their solubilized derivatives, and other reaction by-products such as sodium soaps. The inorganic material in the black liquor is primarily cooking chemicals in ionic form.

After the black liquor is separated from the pulp, it is usually designated as a "weak black liquor". This contains about fifteen percent dissolved solids. Normally, the weak black liquor goes to a recovery operation (i.e. an evaporator recovery boiler, etc.) for reclamation of chemicals and reformation into cooking liquor. The organic material that is dissolved in the black liquor is burned at the mill in a recovery boiler to recover the energy contained therein and the noncombustible portion is sent to chemical recovery.

The pulp with the black liquor from the digester is initially directed to the brown stock washer which first "dewaters" the pulp to remove a large percentage of the black liquor, and then subjects the pulp to several washing steps to separate a high percentage of the remaining dissolved organic and inorganic chemicals from the pulp fibers. The organic material that remains in the pulp after dewatering and thus travels through subsequent processing steps are sources of biological oxygen demands, chemical oxygen demand, and color in pulp mill effluent streams. In addition, poorly washed pulp is a source of precursors for dioxins and chlorinated furans during the bleaching operation.

Since the organic material in the black liquor is a source of energy and much of the inorganic material in the black liquor is a source of digesting chemicals, improving washing efficiency improves energy and chemical recovery. Also, organics that remain with the pulp require increased amounts of chemicals to accomplish the bleaching.

The pulp material itself is made up of cellulose fiber which is a heterogeneous mass of several layers of cellulose molecules (lamellae) in a large central cavity (lumen). Cellulose fibers also bond to each other, creating a network of fibers and cavities. When suspended in water, the fiber network swells, and movement of liquid from one cavity to another is relatively easy.

The communication among the lumen cavity, the liquor between the lamellae, and the liquor surrounding the cellulose fiber is limited to what can pass through the pores of the fiber wall. Liquor outside the fiber can be displaced or mixed with cleaner liquor by breaking up the fiber network. However, the liquor inside the fiber can only be affected by diffusion through the pores of the fiber wall.

Diffusion occurs whenever there is a difference in liquor concentration between the inside and the outside of the fiber. Thus, when a cleaner liquid is passed through the pulp, and the liquor inside the pulp has a higher concentration of solids, there is a diffusion to cause the liquid in the fibers and surrounding the fibers to move out (with the liquid outside the fibers moving into the fibers) toward an equilibrium where the liquid inside and outside the fibers has the same solids concentration.

The speed at which diffusion takes place is dependent on a number of factors, namely:

(i). The difference in concentration of solids between the inside and outside of the fiber, (ii). temperature, (iii). turbulence in the liquor surrounding the fiber, and (iv). the size of the molecules that are subject to diffusion.

The rate of diffusion is highest when the difference in concentration is large, the temperature is high, the turbulence is intense, and the molecule undergoing diffusion is small. The washing of the pulp fibers occurs by a combination of displacement washing (moving a cleaner liquid through the pulp mat to displace the liquor that is outside of the fibers), and diffusion processes (i.e. the migration of the more concentrated liquor inside the fibers to a location outside of the fibers.

An ideal displacement washing would have a plug of wash liquid moved through the stationary pulp pad, completely replacing the previous solution. However, real washing processes exhibit several departures from this ideal condition. For example, there can be viscous fingering and axial diffusion or back-mixing. Some of the solute will be contained in stagnant areas between fibers, in the fiber lumen, and within the fiber walls. This material must diffuse out of the stagnant areas before it can become available for displacement. Viscous fingering, axial diffusion and even diffusion from stagnant areas between the fibers all occur on a relatively short time scale.

There are typically two parameters that are used to determine the performance of washing systems. One is the dilution factor (DF), and the other is the displacement ratio (DR). The dilution factor is the amount of water over that is required for total displacement. The equation for the dilution factor is as follows:

$$DF=(W_s-W_m)/W_p$$

where $W_s$=mass of shower liquor $W_m$=mass of liquor in mat leaving washer $W_p$=mass of dry pulp.

The displacement ratio is the ratio of the actual solids reduction in a single stage to the maximum possible reduction in that stage. The equation for the dilution factor is as follows:

$$DR=(C_e-C_m)/(C_e-C_s)$$

where $C_e$=liquor solids concentration entering washer $C_s$=shower liquor solids concentration $C_m$=solids concentration in mat liquor leaving washer It was indicated earlier in this text that the pulp fibres that are in the digester and are then processed in the dewatering/washing apparatus contain within the fibers two parts liquid by weight for one part cellulose fibre. Thus, for one ton of cellulose fibre (this being the fibre that would remain after it has been thoroughly washed and oven dried), there are two tons of liquid within the pulp fibres.

Figure 27A:
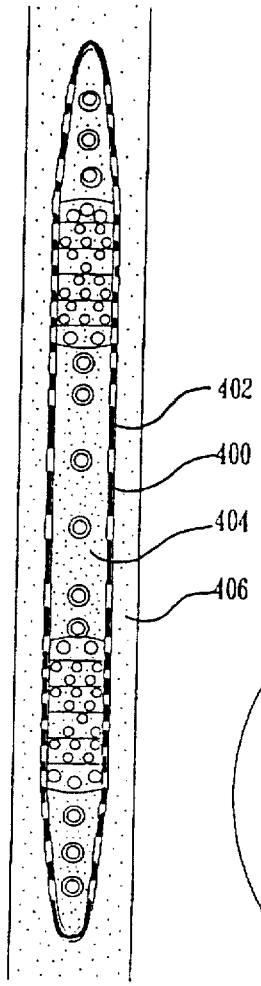
FIG. 27*a* is a longitudinal sectional view through a cellulose fiber, showing its surrounded in liquid at 10% consistency.
Figure 27B:
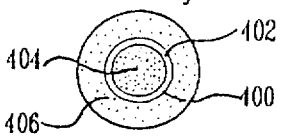
FIG. 27*b* is a sectional view transversely to the cellulose fiber of FIG. 27*a;*
Figure 28C:
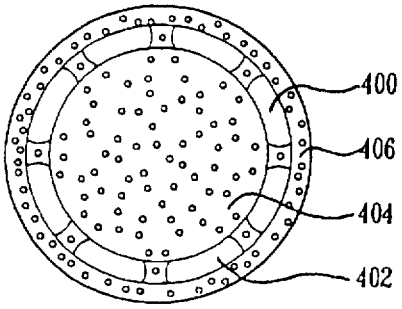
FIG. 28*c* is a view similar to FIG. 28*b*, but drawn to an enlarged scale.
Figure 27C:
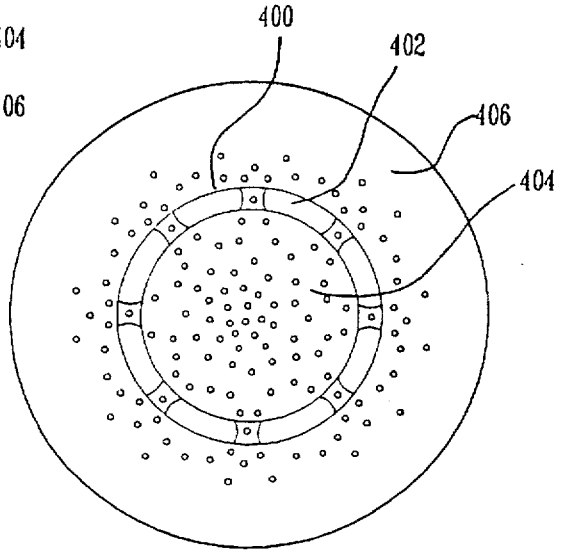
FIG. 27*c* is a sectional view the same as FIG. 27*b*, except showing the cellulose fiber to a larger scale.

To illustrate this, reference is made first to FIGS. 27A, 27B and 27C which illustrates a single wood fibre 400 where the total batch of pulp is at a ten percent consistency. This means that for one part of fibre material, there are nine parts liquid (including the material dissolved in the liquid). Since each fibre 400 has within its outer shell 402 two parts liquid 404 for each part of fibre by weight, at ten per cent consistency there are seven parts liquid (indicated at 406) outside the fibre. The currently commercially used types of dewatering and washing apparatus are such that, the consistency of the wood pulp after it is dewatered is commonly between ten and thirteen percent, so FIGS. 27A, B and C are reasonably representative of the pulp after dewatering in accordance with the prior art.

Now let us examine what occurs during a single washing step. As the wash liquid moves into the layer of dewatered fibre, it displaces that portion of liquid 406 that is outside of the fibres. Let us assume in this instance that the wash liquid is pure water with no dissolved solids therein, and the liquid 404 and 406 inside and outside the fiber 400 is black liquor have 25% dissolved solids therein. As soon as the first wood fibers 400 at the top of the dewatered pulp are surrounded by the fresh water, the liquid 404 (with the dissolved solids) within the fibre 400 starts to diffuse outwardly into the surrounding fresh water 406, to come nearer to equilibrium (relative to the percentage of the dissolved material) with the liquid 406 surrounding the fibre.

In this instance, if (as assumed) the liquid within the fibre and initially surrounding the fibre is black liquor at 25% dissolved solids content (i.e. three parts liquid and one part dissolved solids), and assuming that the liquid surrounding the fibre is totally displaced with fresh water (not having any dissolved liquids), and if diffusion of the liquid within the cellulose fibre 400 with the surrounding wash water would be such so that complete equilibrium is reached, then the liquid within each fibre 400 and outside the fibre 400 would have 5.5% dissolved solids, and the liquid, surrounding the fibers would have that same concentration of solids.

Thus, since the dewatering/washing apparatus that is commonly used in the prior art dewaters the pulp material to approximately a ten percent to a thirteen percent consistency (as indicated above), the situation shown in FIGS. 27A, B and C is typical of what would occur during the initial washing step at the topmost portion of the pulp material if diffusion were complete and complete equilibrium would occur.

Figure 28A:
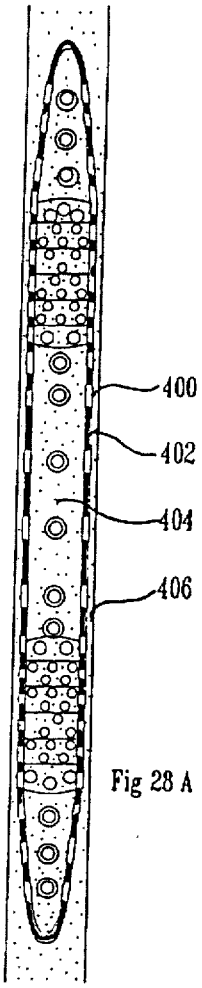
FIG. 28*a* is a view similar to FIG. 27*a*, but showing the cellulose fiber in liquid at 25% consistency.
Figure 28B:
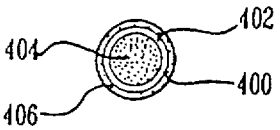
FIG. 28*b* is a sectional view taken transversely across the fiber of FIG. 28*a;*

Now let us turn out attention to FIGS. 28A, B and C which represent what would occur in an ideal situation during the washing of pulp fibres where pulp after dewatering is at twenty five percent consistency (three parts total liquid, including dissolved solids, to one part cellulose fibre). Let us also assume that the liquid within the fibre and that surrounding the fibre is black liquor having three parts liquid to one part dissolved solids (i.e. 25% dry solids content).

Since (as discussed above) the liquid within the fibre 400 is twice the weight of the cellulose fibre itself, there is one part by weight cellulose fibre, two parts by weight liquid 404 (including dissolved solids) inside the fibre 400, and one part liquid at 406 surrounding the wood fibre.

Let us now assume that during an initial step in the washing process, the liquid 406 surrounding the fibre 400 is totally displaced with fresh water (with no solids dissolved therein), this occurring when the first portion of fresh wash water encounters the uppermost fibres 400 in the pulp mat. With the pulp being at twenty five percent consistency there will be for each fibre 400 only one part of fresh water surrounding the individual fibre. When two parts of the liquid within the fibre 400 diffuses outwardly, and the one part of the liquid outside the fibre diffuses inwardly into the fibre 400, if complete equilibrium is reached, there will be 16⅔% dissolved solids throughout the liquid ((2×0.25)/3=16 ⅔).

To further pursue this analysis, reference is now made to FIG. 29A where there is shown schematically a layer of pulp 408 which has been dewatered in a brown stock washer of the present invention to a twenty five percent consistency (i.e. three parts liquid for every one part fiber), and that each unit of liquid (i.e. black liquor) comprises twenty five percent dissolved solids. Let us create a hypothetical situation and assume that a quantity of pure wash water (without any dissolved liquids) is placed on top of the pulp mat 408, and for purposes of analysis, let us divide the pulp mat 408 into ten layers numbered one through ten.

Let us further assume that the pulp layer comprises one ton of dry cellulose fiber and that one ton of wash liquid is placed on top of the pulp, after which the pressure differential is applied to move the wash water into the pulp and to displace the liquid that surrounds the pulp fibers. Since the pulp is at twenty five percent consistency, there is two tons of liquid inside the pulp fibers and one ton of liquid outside of the pulp fibers. Let us also assume that the first one tenth of the wash water moves into the top one tenth of the pulp mat.

For purposes of analysis, let's first assume a further idealized situation where as soon as that one tenth of that wash water enters the top tenth of the pulp mat, there is complete diffusion so that the liquid inside the pulp fibers has the same percentage of dissolved solids as the liquid outside of the pulp fibers. As indicated in the prior analysis, this would mean that the liquid inside and outside the pulp fibers would have sixteen and two-thirds percent dry solids dissolved in the liquids.

Now let us assume this same first one tenth of this wash liquid now at 16⅔% dry solids content moves downwardly into the second one tenth thick layer of pulp. Again, the liquid inside the pulp fibers has twenty five percent dry solids content. Let us assume again that there is immediately complete diffusion so that there is complete equilibrium between the liquid inside the fibers and outside the fibers. Analysis indicates that the liquid and the percent of dissolved solids in the liquid would be 22.2 percent [(2×25)+(1×16 ⅔)]/3. When this same first one tenth of the wash water moves into the third layer and assuming complete equilibrium is achieved with the liquid inside the fibers in that third layer, the percentage of dissolved solids in the wash water would further increase.

$$[(2\times25)+(1\times22.2)]/3=24.1$$

It can readily be seen from the above analysis that the first one tenth increment of the wash water obtains a higher and higher percentage of dissolved solids as it proceeds downwardly through the layer of pulp fiber.

It is also apparent that when the second one tenth increment of wash water moves into the top one-tenth layer of pulp, that second increment of wash water (without any dissolved solids therein) is encountering the first layer of pulp which has only 16 ⅔% dissolved solids content. As this second increment of wash water proceeds downwardly through the pulp mat, its percentage of dissolved solids increases, but not as rapidly as the first one-tenth increment of wash water.

These percentage changes have been calculated and are presented on the graph of 29A. It can be seen that on the vertical axis, there is plotted the pulp mat thickness in one-tenth increments. On the horizontal axis, the percentage of dry solids present in the liquid is given. It can be seen that if only one half of a ton of wash water is used per one ton of pulp, a fair percentage of the dry solids have been removed from only the top half of the pulp mat, but the wash water has only progressed half way into the mat. When a full one ton of wash water is used, then the second curve indicates that removal of dry solids is substantial in the top half of the mat, but diminishes to almost zero when the wash water reaches approximately the ninth increment of one-tenth layers of pulp. However, when three tons of wash water is used, it can be seen that there has been a significant removal of the dry solids and there is a displacement ratio of 0.898. If 3.3 tons of wash water is used, the displacement ratio goes to 0.936. It is to be emphasized that this analysis was done for a hypothetical idealized situation.

In FIG. 29B, this same analysis was performed, but with the consistency of the pulp mat being ten percent, which would be typical of a prior art washer such as the Chemi-Washer. As will be recalled from the analysis given previously in this text, this would mean for every one ton of pulp fiber, there are two tons of liquid within the fibers, and seven tons in the mat outside of the fibers. It can be seen that when 9.7 tons of water is used, there is a displacement ratio of only 0.849. From the graph immediately above at 29A, it can be seen that with the use of only three tons of water, there is a displacement ratio of 0.898.

Figures 30A, 30B:
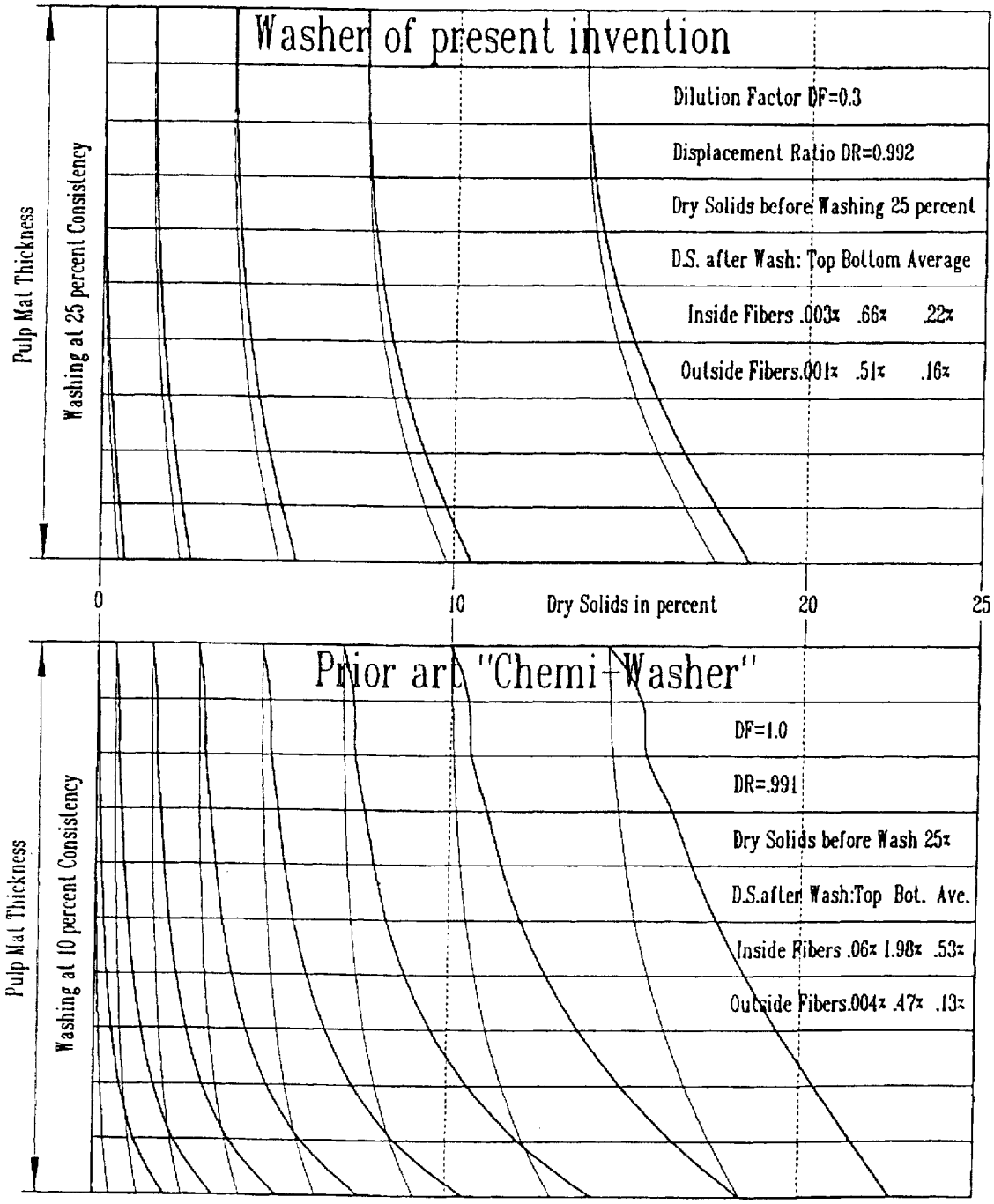
FIG. 30*a* is a graph illustrating the washing operation of the present invention in actual operation.
FIG. 30*b* is a graph similar to FIG. 30*a*, but showing the performance of a prior art Chemi-Washer.

It should be understood that FIGS. 29A and 29B were calculated where an ideal situation was assumed in which there is immediate and complete diffusion of dry solids from inside the pulp fibers to the surrounding filtrate, and pure wash water was used in the initial washing step and the wash water was assumed to ideally displace the liquid outside the fibres without any mixing with it. Further calculations were run to simulate what would happen under actual operating conditions. These are illustrated in FIGS. 30A and 30B. The thick lines which are shifted somewhat to the right in comparison with the thin lines represent the percentage of dry solids in the liquids inside the fibers, and the thin lines somewhat to the left of the thick lines represent the dry solids in the filtrate outside of the pulp fibers.

The values given in FIG. 30A represent what computer analysis indicates would occur during a complete washing using the washer described in the text of this present application with five countercurrent passes of the wash water through the pulp mat after the dewatering. It is assumed that 3.3 tons of wash water is used for each ton of pulp, and that the same wash liquid is recycled (countercurrently four times for subsequent washing cycles. To clarify the terminology in each washing cycle, there are five washing steps where 3.3 tons of wash water is passed through one ton of pulp five times. On a first washing cycle the totally clean water would be passed through the pulp mat on the very last (i.e. fifth) washing step. The prior four washing steps for that cycle would use dirtier wash water that was used in prior washing cycles. Then in the next cycle where the pulp mat is being washed, the recycled water from the fifth step in the previous cycle would now be used for the fourth washing step. In this manner, the wash water is recycled countercurrently through four washing cycles, and as that particular batch of wash water becomes its "dirtiest", it is used in the very first washing step on the fifth cycle.

FIG. 30B represents what a computer analysis indicates would be achieved in the washing operation using the prior art Chemi-Washer. It is assumed that ten tons of fresh wash water is used for one ton of pulp fiber. There are shown seven washing steps for each cycle. Also, in this instance, the fresh water is countercurrently recycled for use on subsequent cycles so that as the wash water has a higher percentage of solids, it is used for a yet earlier washing step in subsequent cycles.

The values showing the performance of the washer of the present invention and the prior art Chemi-Washer are printed on the graphs of FIGS. 30A and 30B. It can be seen that for the washer of the present invention, the dry solids content for the liquid inside the fibers is at the average of 0.22 percent at the completion of the cycle, while the dry solids content for the liquid outside the fibers is 0.16 percent. For the prior art Chemi-Washer, the dry solids content for the liquid inside the fibers is 0.53 percent, while the dry solids content for the liquid outside the fibers is 0.13 percent.

It is believed the significance of the above analysis will become more apparent from the following description of the second embodiment of the system of the present invention.

Section E. Second Embodiment of the System of the Present Invention (FIGS. 31–39)

This second embodiment is similar to the first embodiment in several respects. In this second embodiment there is an initial brown stock washer and six additional washers, each of which is utilized after a related one of six bleaching operations. There are six bleaching stations, and these six bleaching stations utilize at each station the same bleaching agents as in the first embodiment. (In this description the washer following each bleaching apparatus is simply considered to be part of that bleaching station.)

Figure 31:
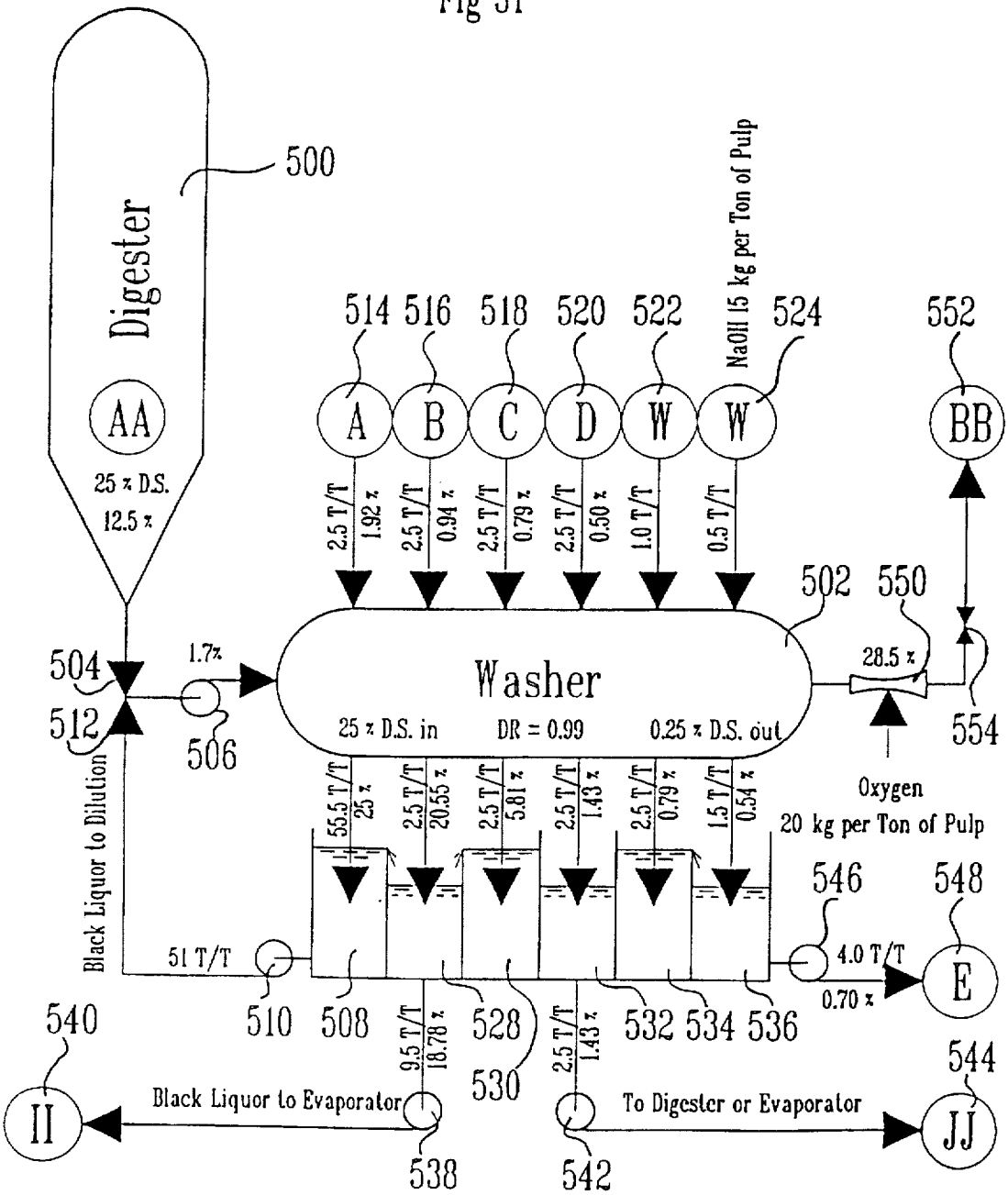
FIGS. 31 thru 37 are seven figures illustrating successive operating stations in a system of the second embodiment of the present invention.

To distinguish these components of the second embodiment components from those of the first embodiment, numerical designations will be used, and letters will be added to distinguish different locations in the system. The basic system in the second embodiment is disclosed in seven drawings, FIGS. 31–37. FIG. 31 discloses the initial brown stock washing station where there is a digester 500 and a brown stock washer 502. FIGS. 32–37 disclose in sequence the six bleaching stations, the components which appear on FIG. 32 will be given "a" designations; the components in FIG. 33 (the second bleaching station) will be given "b" designations, with the stations of FIGS. 34 through 37 being given designations "c", "d", "e", and "f".

Throughout this description of the second embodiment, various values of weight, percentages, consistency and other values will be printed directly on the drawings. It is believed that this will add clarity to the overall description. These values represent what current analysis by the inventor herein indicates would be within an optimized range in this embodiment. However, it is to be understood that these values could be modified depending on a number of factors. Further, if this system of the second embodiment is to be incorporated into an existing pulp bleaching system, using some of the components from that existing system and adding components of this second embodiment, then this might require further modifications. For example, in the following detailed description, it will be pointed out that certain effluent may be recirculated or possibly directed to the digester, instead of the evaporator, this depending to some extent on the capacity of the existing evaporator.

In this second embodiment, sufficient pressure is used in the washer 502 (e.g. 10 bar) to obtain a consistency of the dewatered pulp of 28.5%. This would mean that there is only one half ton of liquid around the pulp fibers for each ton of pulp fiber, with two tons of liquid remaining in the pulp fibers.

With reference to FIG. 31, it can be seen that the pulp in the digester 500 has a twelve and one half percent consistency and that it contains twenty five percent dry solids for each unit of liquid. The pulp passes from the digester 500 through 504 to a pump 506. At the same time, black liquor that has been removed from the washer 502 in the first dewatering step in the washer 502 and collected in a tank 508 is recirculated by means of a pump 510 through 512 to be combined with the pulp slurry from the digester 500 to flow to the pump 506 to be directed into the washer 502 in the manner described previously in Section B of this text.

In the particular embodiment disclosed herein, a sufficient amount of the black liquor (i.e. 51 tons of black liquor for each ton of pulp) is recirculated from the tank, 508 so that when this is added to the pulp slurry discharged from the digester 500, the pulp directed by the pump 506 into the washer 502 has the consistency of 1.7 percent. As soon as the batch of pulp slurry is deposited onto the processing screen in the washer 502 as described in Section B of this text and the dewatering is initiated, the black liquor flows into the tank 508. Then there is a sequence of six washing steps which follow one immediately after another, as described previously. these washing steps are designated as "A", "B", "C", "D", and "W" in FIG. 31, and the liquid for each of these washing operation flows from a different portion of a batch tank or from its related tank or container. As will be described further in this text, each portion of the wash liquid supplied to these tank portions "A", "B", "C", "D" is derived from the washers at different downstream locations in the system of the present invention. For example, the wash liquid B used in the second washing step in FIG. 31 is derived from the effluent removed from the pulp in the washer 502*c* (See FIG. 34) during the second washing step at the third bleaching station.

Then the final step of the washing (indicated at the two locations designated "W") employs fresh water. As shown herein, there is a first batch of fresh water which is equal to one ton of water for each ton of pulp, and then a second last portion of fresh water which is equal to 0.5 tons of water for each ton of pulp. The final 0.5 tons of wash water contains fifteen kilograms of sodium hydroxide (NaOH) per ton of pulp. This last 0.5 tons of fresh water moves into the pulp mat (dispensing the free liquid already in the pulp mat) and remains in the pulp mat when it leaves the washer 502 to go to the first bleaching station shown in FIG. 32.

The four initial portions of recycled liquid at A, B, C and D are designated 514, 516, 518 and 520, respectively, and the two clean water sources are indicated 522 and 524, respectively.

When the first 2.5 tons of liquid from source "A" 514 moves into the tank and moves into and through the pulp mat, the liquid that flows out of the pulp is collected in the tank 528. When the liquid 516 is moved into the washer 502 and moves through the pulp in its washing operation, the displaced liquid from the pulp resulting from this flows into the tank, 530. In like manner, the remaining three tanks designated 532, 534 and 536 receive the liquid outflow from the pulp that result from the liquid source C (518), D (520) and W (522 and 524), respectively, with the flow caused resulting from the two sources W (522 and 524) flowing into the tank 536.

It is to be understood that for most of the locations where flow is indicated, there will be a valve and/or a pump as needed to control the flow and/or provide the pumping action. However, since this is an obvious requirement and within the skill of the art to provide these, such valves and pumps are (for clarity of explanation) in large part not shown in system shown in FIGS. 31 through 37. It is to be understood that the presence of such valves and/or pumps are deemed to be indicated in the drawings and explanation by the indication in the drawings and/or in the text of such flow.

It will be noted that an overflow from the black liquor collecting tank 508 goes into the next tank 528 which receives the effluent from the first washing step. The effluent collected in the tank 528 is directed by a pump 538 to an evaporator 540 indicated at II in FIG. 31. Also, the overflow from the tank 530 flows into the tank 528 to mix with the liquid therein and thus is also directed to the evaporator 540.

The outflow from the tank 532 is moved by the pump 542 and is directed back to the digester or to the evaporator, and this outflow is indicated at JJ and at 544. The outflow from the final tank 536 is directed by a pump 546 to the source E (548). This outflow at E (548) is cycled back to the washer **502*b* (see FIG. 33) which is at the second bleaching station. This effluent is used for the liquid in the first washing step at the washer 502*b***.

Figure 32:
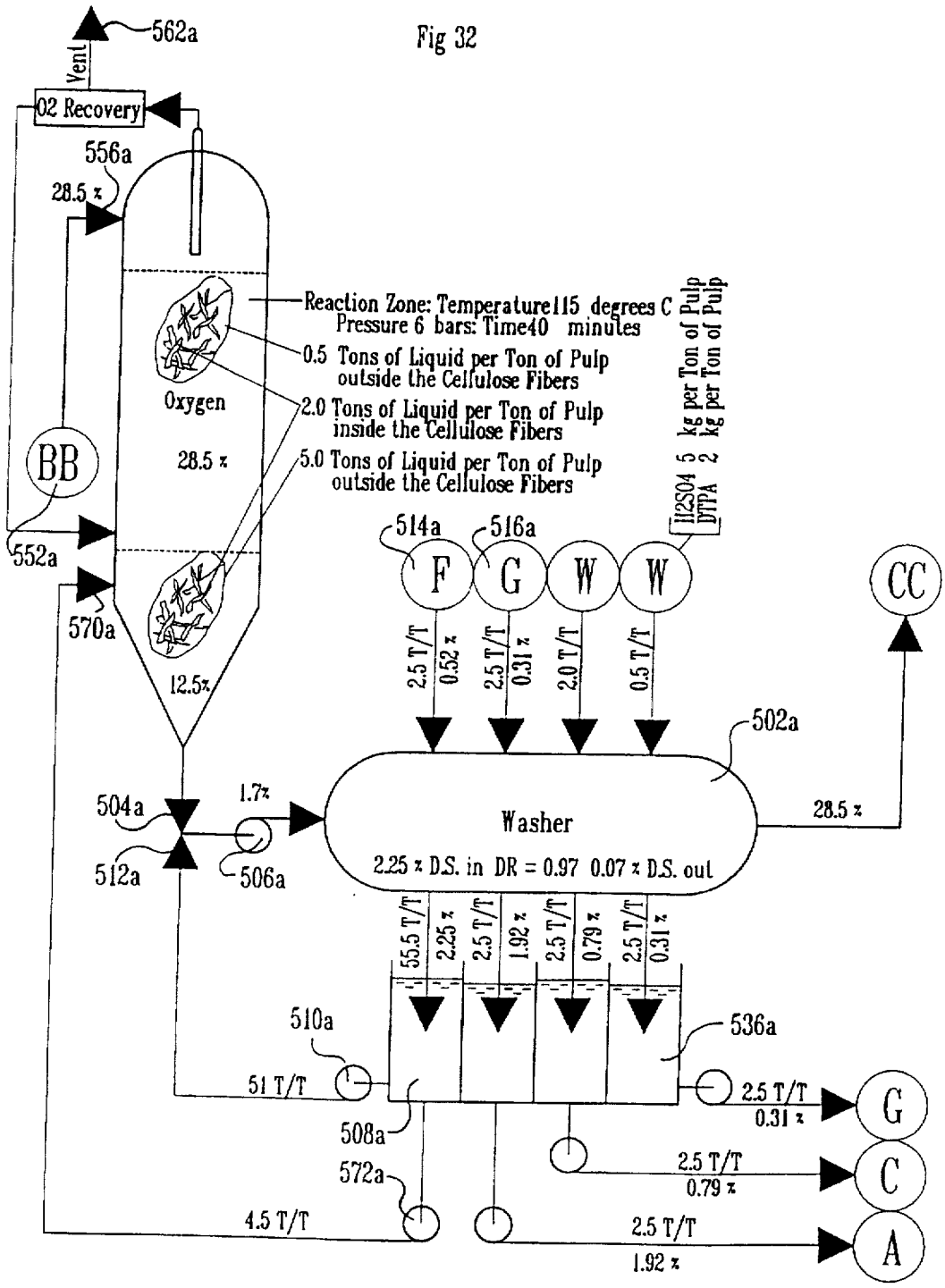

Finally, the dewatered and washed pulp mat from the brown stock washer 502 is directed into a venturi tube 550 where oxygen (02) is added to the pulp and directed to the inlet 552 of the first bleaching station (indicated at BB both in FIGS. 31 and 32).

As a further note of explanation, the numerical designations that have "T/T" thereafter indicate the tonnage of liquid flow for each ton of pulp fibre. The percentage designations immediately adjacent to that T/T designation indicate the percentage of dissolved solids in that liquid. Thus, in FIG. 31, it can be seen that the flow A (514) for that particular washing step uses 2.5 tons of liquid for each ton of pulp fiber, and that particular liquid has 1.92 percent dissolved solids content. Also it can be seen that in the first dewatering/washing process in the brown stock washer 502 in FIG. 31, the liquid in the pulp slurry entering the washer 502 has 25% dissolved solids therein, while the liquid contained in and surrounding the pulp mat that is finally discharged into the venturi 550 has 0.25% dissolved solids therein. Thus, (also as indicated in FIG. 31), the displacement ratio achieved by the first brown stock washer 502 is 0.99. These are values calculated by computer analysis, and it is presently believed that these are close to values which can reasonably be achieved.

In the following text, there will be discussion of each of the six bleaching stages with reference to FIGS. 32 thru 37. For clarity of presentation, the following description will be divided into six sections, one for each of the stages shown in FIGS. 32 thru 37.

a. First bleaching stage (oxygen stage—FIG. 32).

As indicated immediately above, the pulp discharged from the brown stock washer 502 is directed into a venturi 550. As it's name implies, this venturi 550 comprises a converging/diverging passageway through which the flow rapidly increases in velocity through the throat of the venturi and decreases as it flows out of the venturi. A valve 554 is provided downstream of the venturi 550 to control the flow through the venturi 550.

As indicated in FIG. 31, 20 kg of oxygen is added to the pulp at (or adjacent to) the location of the venturi 550. The flow of the pulp through the venturi 550 causes the pulp to be shredded into smaller particles to facilitate the mixture of the oxygen with the pulp particles, and also to facilitate the movement of the pulp into and at the next bleaching station.

As can be seen in FIG. 32, the pulp from the brown stock washer 502 that is passed through the venturi 550 (with the oxygen therein) is directed into an inlet **556*a* at the upper end of a bleaching tank 558*a*. This inlet 556*a* is arranged so as to discharge the pulp material into the upper end of the tank 558 in a swirling circular pattern so that the gaseous portion of the flow (steam and/or air along with a portion of the added oxygen) can be directed into the lower end of a centrally positioned tube 560*a*. Some of this flow is vented as at 562*a* (for example, the steam would be vented), and there is an oxygen recovery line 564*a* to recycle the oxygen back to a lower portion 566*a* of the tank 558*a*. This recycled oxygen is moved upwardly through the pulp contained in the tank 558*a*** to carry on the bleaching process.

The operating conditions are indicated on FIG. 32, and it shows the desired pulp temperature of 115C, the pressure at 6 bars and the processing time 40 minutes. It can also be seen that the pulp that as delivered to the bleaching tank **558*a*** has 0.5 tons of liquid per ton of pulp outside of the cellulose fibres, and two tons of liquid per ton of pulp inside the cellulose fibres.

As the pulp collects in the bottom part **568*a* of the tank 558*a*, liquid is introduced at 570*a* by means of a pump 572*a* drawing liquid from a first stage tank 508*a*. This is to add sufficient liquid to the pulp to bring it to a 12.5% consistency so that it can be moved out of the tank 558*a*. The tank 558*a* is sufficiently large so that as sequential batches of pulp are moved into the upper end of the tank 558*a*, the pulp gradually moves downwardly to the lower end of the tank, this being done at a sufficient rate so that there is a total dwell time of 40 minutes for each portion of pulp brought into the tank 558*a***.

The pulp at a 12 ½% consistency is moved from the tank **568*a* through 504*a* to a pump 506*a* into a washer 502*a*. Also, liquid derived from the tank 508*a* is moved by a pump 510*a* up to 512*a* to combine with the flow from the bleaching tank 558*a* to bring the pulp slurry moved by the pump 506*a* into the washer 502*a*** to a 1.7% consistency.

There is a first dewatering step, by which the pulp slurry is reduced from a 1.7% consistency to a 28.5% consistency. It will be noted that as indicated in the printing within the RKS Washer 502*a* that the dissolved solids in the liquid is at 2.25%, while (as indicated in FIG. 31), the dissolved solids in the liquid remaining with the pulp mat from the brown stock washer 502 is at 0.25% solids. This additional 2% dissolved solids is attributable to the bleaching chemicals and to the additional organic material which is broken down in the pulp fibre during the bleaching operation within the tank 558*a*.

Figure 35:
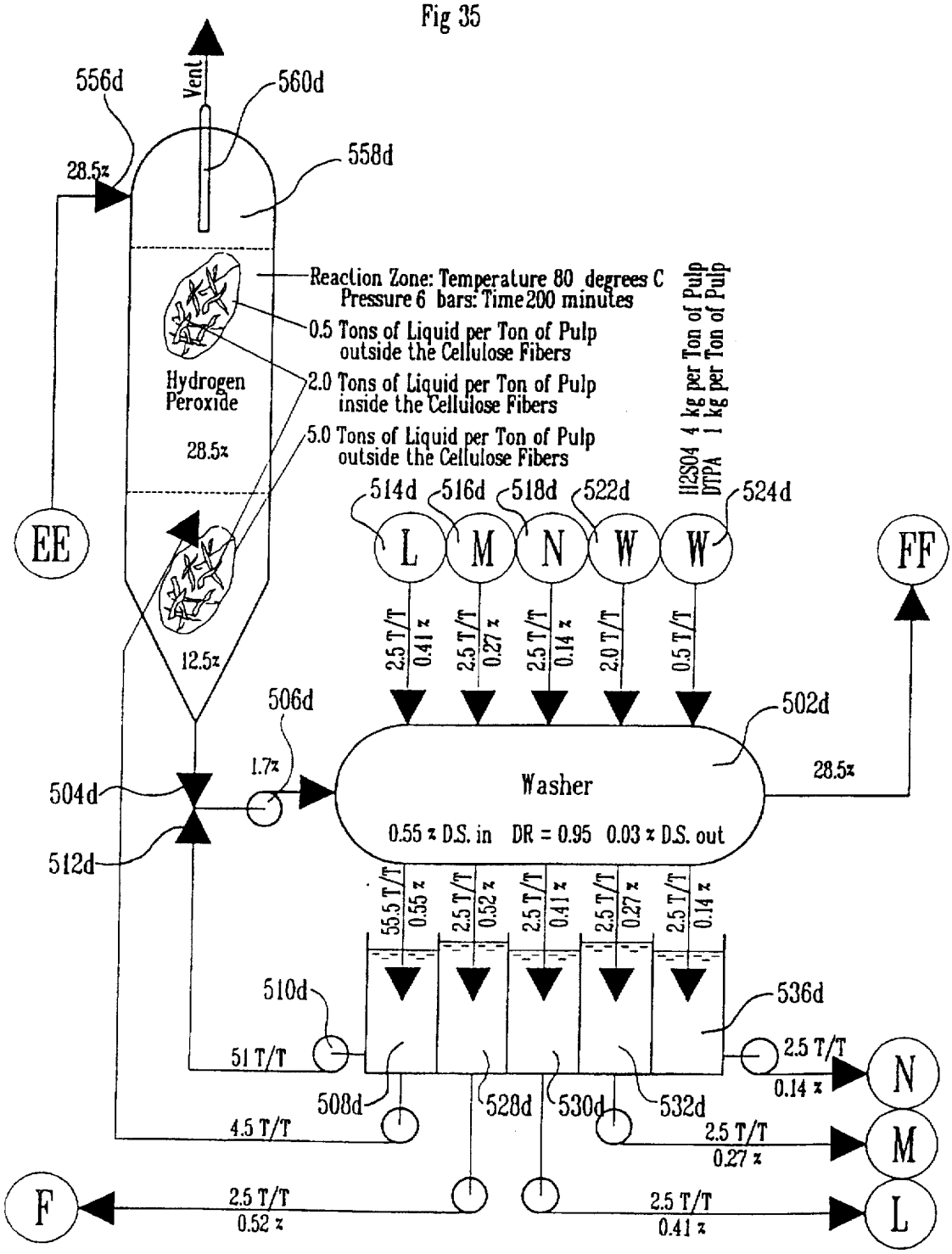
Figure 36:
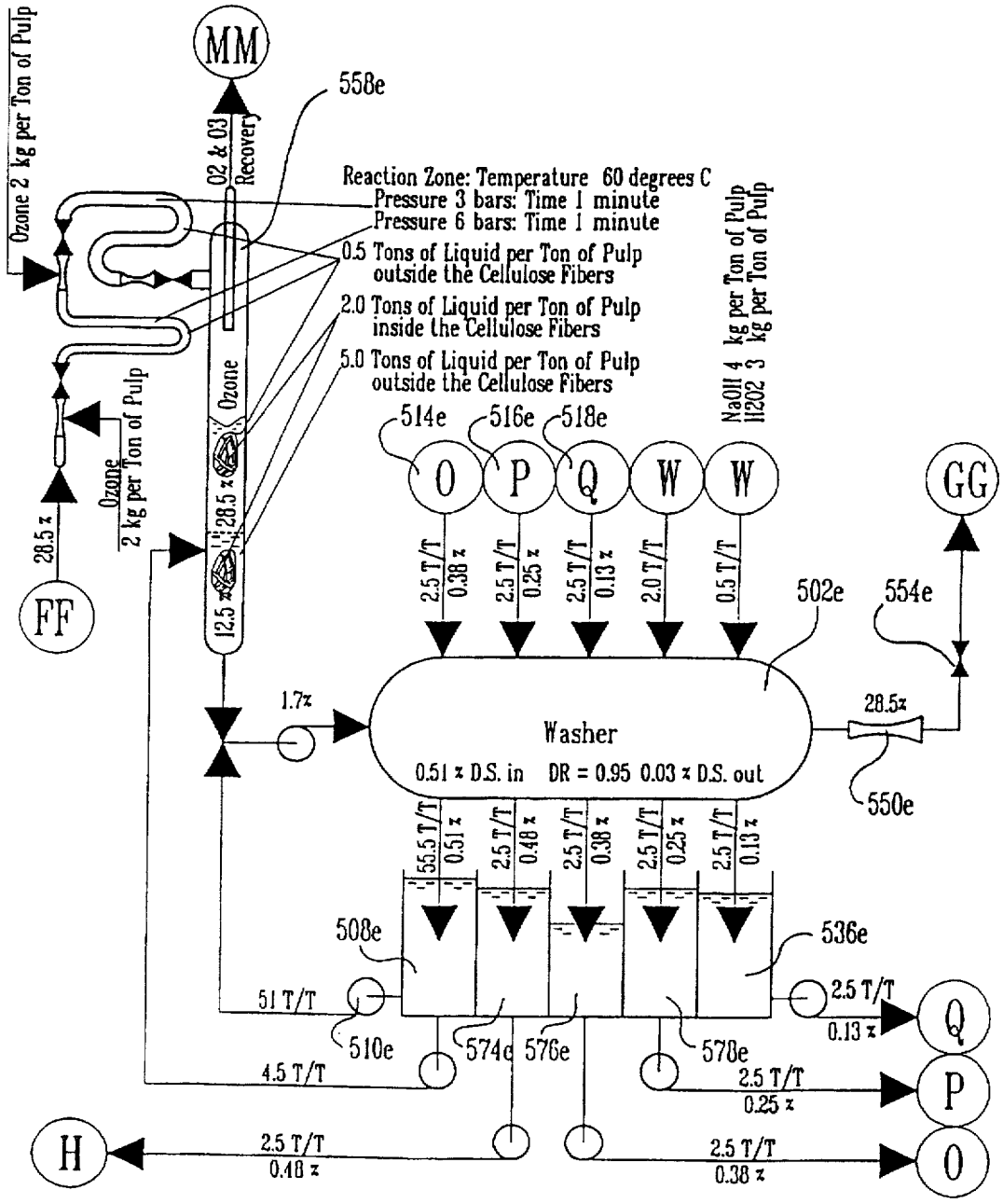

The first portion of washed liquid F514*a* is derived from a source indicated at the effluent outlet at F in the fourth bleaching station shown in FIG. 35. The second washwater source G 516*a* is derived from the effluent indicated at G in FIG. 32 from the tank 536*a* that receives the discharge resulting from the last washing step using fresh water as the source liquid. Also, it will be noted that the effluent indicated at "A" and "C" in FIG. 32 are both recycled to provide the liquid sources at A514 and B516 in the brown stock washer of FIG. 31.

The final inflow of fresh water into the washer 502*a* (0.5 tons of fresh water per ton of pulp) has added thereto 5 kg (kilograms) of sulpheric acid (H2SO4) and 2 kg of DPTA (i.e. diethylenetriaminepentaacetic acid) per ton of pulp.

It will be noted that the sulpheric acid and DPTA with the final 0.5 tons (per ton of pulp fibre) of wash liquid remain in the pulp mat when the pulp is discharged from the washer 502*a*. As indicated previously in the description of the first embodiment, this sulphuric acid serves to adjust the pH of the pulp to be compatable with the ozone bleaching step. The DPTA is added to stop the metal ions present from reacting with the ozone. Also, as previously described herein, the sodium hydroxide which is added in the final washing step of the brown stock washer (as shown in FIG. 31), is to adjust the pH in the pulp to be compatable with the oxygen bleaching step.

b. The Second Bleaching Station (Ozone Stage—FIG. 33).

The pulp that is discharged from the washer 502*a* is directed into a series of three venturis 550*b*, each of which is followed by a valve 554*b*. As in the prior bleaching station shown in FIG. 32, each venturi 550*b* accelerates the flow therethrough as it passes through the necked section of the venturi to shred the pulp. At the same time, ozone is introduced into the pulp at (and/or adjacent to) the location of the venturi 550*b*. Desireably, the concentration of the ozone is 4 kg of ozone per ton of pulp at each of the first two venturis to make a total of 8 kg per ton. There is a pressure drop after the first venturi 550*b* down to six bars. A second pressure drop after the second venturi 550*b* brings the pressure down to three bars, and the pressure drop after the third venturi 550*b* brings the pressure down to near atmospheric, at which time the pulp enters into the second stage tank 558*b*. As in the first stage, there is a gaseous discharge tube 560*b*, and the gaseous discharge of the remaining ozone in the oxygen is moved to a recovery location.

Between the three venturies, 550*b*, there are two sections of pipe 571*b* with enough length and volume to provide space for the amount of pulp blown in each cycle and to provide about one minute reaction time for the ozone bleaching to take place.

The recycling of liquid from the dewatering tank 508*b* is accomplished in substantially the same manner as described with reference to the first bleaching stage in FIG. 32 in that a portion of the liquid from the tank 508*b* is directed back to the lower part of the bleaching tower 558*b*, while most of the dewatering liquid is directed back through 512*b* to dilute the flow from the bleaching tower 558*b* to 1.7% consistency.

With regard to the liquid sources for the washing operation, the initial washing source E514*b* is derived from the effluent discharged from the tank 536 in FIG. 31. The second liquid source at H516*b* is derived from the effluent flowing out of the washer 502*e* in the first stage of washing at the fifth bleaching station shown in FIG. 36. This fifth bleaching station also uses ozone as the bleaching agent. The use of ozone as a bleaching agent produces toxic material which is desirably not directed to the main evaporator, but is treated separately. Accordingly, this filtrate flowing at H from the second ozone stage bleaching (FIG. 36) is directed back to the first ozone stage bleaching station in FIG. 33.

The effluent resulting from each of the three washing steps from the liquid sources E514*b*, and I518*b* are each directed to three tanks, 574*b*, 576*b*, 578*b*, respectively. The effluent in these three tanks 574*b*, 576*b* and 578*b* is collected in the middle tank 576*b* and directed by the pump 580*b* to a separate evaporator KK582*b* where this effluent is treated separately. The effluent resulting from the last washing steps 520*b* and 522*b* using fresh water is directed at I back as the third liquid source 518*b* in FIG. 33.

In the last part of the fresh water stage, the 0.5 tons of fresh water per ton of pulp that is last moved into the pulp mat contains 10 kg of sodium hydroxide per ton of pulp and 10 kg of hydrogen peroxide per ton of pulp. These two ingredients remain in the pulp as it is delivered to the third bleaching station in FIG. 34. The sodium hydroxide adjusts the pH level, and the hydrogen peroxide (H202) acts as a bleaching agent.

Figure 34:
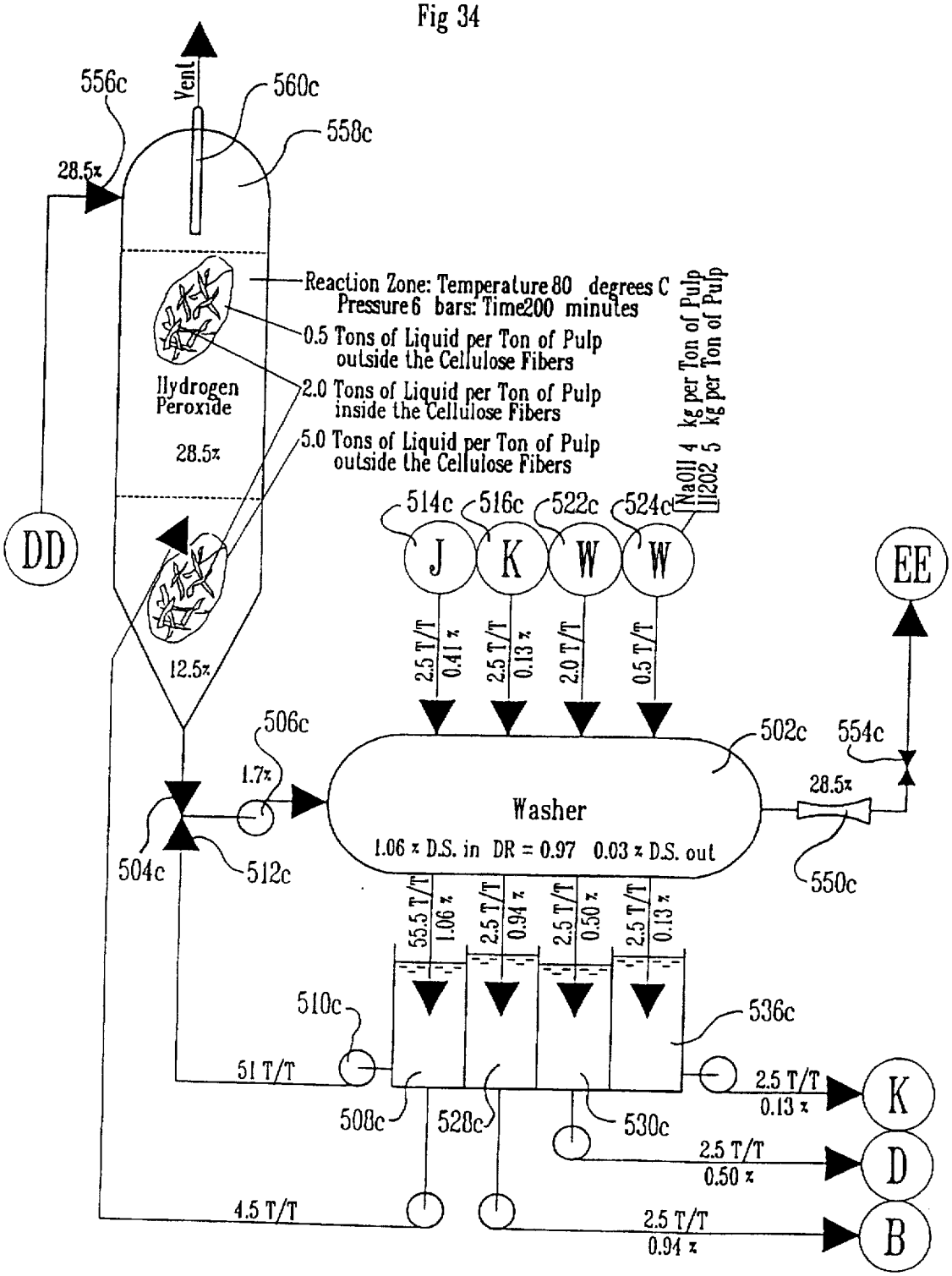

The pulp that is discharged from the washer 502*b* at the completion of the washing is directed through an outlet venturi 550*b* to pass through a valve 554*b* and thence to the third bleaching station shown in FIG. 34.

c. Third Bleaching Station (Hydrogen Peroxide Bleaching—FIG. 34)

The pulp with the hydrogen peroxide therein is directed into the bleaching tank 558*c* through an inlet 556*c* and there is a central vent tube 560*c*. It can be seen from the printed material appearing in FIG. 34 that the temperature in the reaction zone is 80 degrees C., the pressure six bars, and the total bleaching time 200 minutes. As each additional batch of pulp is delivered into the top of the bleaching tank 558*c* and moves downwardly, a relatively slow bleaching reaction takes place. It can be appreciated that because of the long retention time in the tank 558*c* that this tank 558*c* is made rather large.

The dilution of the pulp first in the bleaching tank 558*c* and subsequently by recycling the liquid from the dewatering tank 508*c*, the dewatering and washing of the pulp in the washer 508*c*, and the delivery of the pulp from the washer 502*c* through the venturi 550*c* is accomplished in substantially the same manner as described in connection with the oxygen stage bleaching (the first bleaching stage shown in FIG. 32). Accordingly, it is believed that a detailed description is not needed herein of this third stage bleaching of FIG. 34. It can be noted however that two portions of effluent indicated at B and D in FIG. 34 are directed back to the brown stock washer and provide the liquid sources at B516 and D520. The effluent at K from the final fresh water washing stage is recycled to provide the water source at K516*c* in the washer 502*c*.

The last portion of fresh water at 524*c* has added thereto 4 kg of sodium hydroxide per ton of pulp, and 5 kg of hydrogen peroxide per ton of pulp, and this remains in the pulp which is discharged through the venturi 550*c*.

d. Fourth Bleaching Station (Second Stage of Hydrogen Peroxide Bleaching—FIG. 35)

The fourth bleaching stage illustrated in FIG. 35 is substantially similar to the first hydrogen peroxide bleaching stage shown in FIG. 34, so it is believed that a detailed description of the fourth stage of FIG. 35 is not needed. It can be seen that the processing conditions in the bleaching tank 558*d* are substantially the same as that in 558*c*, and the recycling of the liquid from the dewatering tank 508*d* is substantially the same as accomplished in the third stage of FIG. 34.

The recycling of the effluent discharge from the washer 502*d* in FIG. 35 is different than shown in FIG. 34. In the present bleaching stage of FIG. 35, the last three portions of effluent indicated at N, M and L are recycled back to the washer 502*d* as the source liquids at L514*d*, M516*d*, and N518*d*. Then, the effluent at F from the second effluent tank 528*d* is recycled back to the first bleaching stage of FIG. 32 to be become the fluid source at F514*a* in FIG. 32 for the first bleaching stage which is an oxygen bleaching stage.

e. Fifth Bleaching Station (Second Ozone Stage—FIG. 36)

Figure 33:
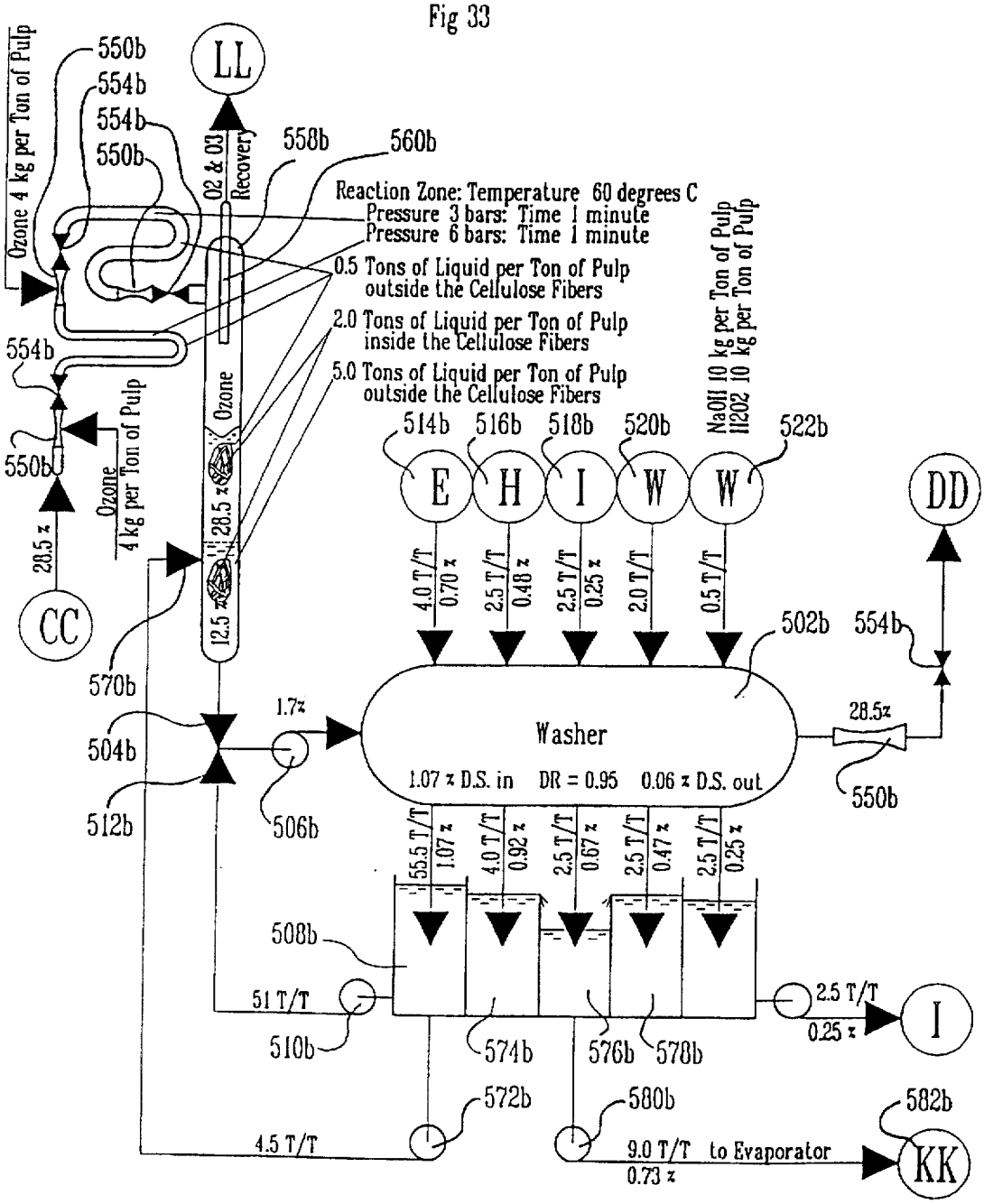

The operation at the fifth bleaching station (FIG. 36) is in large part similar to that shown in FIG. 33. Accordingly, it is believed that a detailed description is not needed for a proper understanding of the apparatus and operation of the second ozone stage.

Thus, there are the three venturis 550*e*, with the ozone being injected into the flow passages at the location of the first two venturis 550*e*. However, only two kg of ozone are injected into the pulp stream at each of the first two venturis 550*b*, which is half of the amount of ozone used in the first ozone stage of FIG. 33. Other than that, the bleaching conditions are substantially the same as shown in FIG. 33.

The initial recycling of the dewatering liquid from the tank 508*e* is substantially the same as in the second bleaching stage shown in FIG. 33.

However, the recirculating pattern of the effluent from the washer 502*e* is somewhat different than with the washer at 502*b* (FIG. 33). First, the effluent from the tank 574*e* is directed at H to the liquid source H516*b* in the first ozone stage of bleaching at FIG. 33. The next three effluent tanks 576*e*, 578*e* and 536*e* have their effluent directed to source locations which lead directly back to the washer 502*e*, these being indicated at 0514*e*, P516*e* and Q518*e*.

Figure 37:
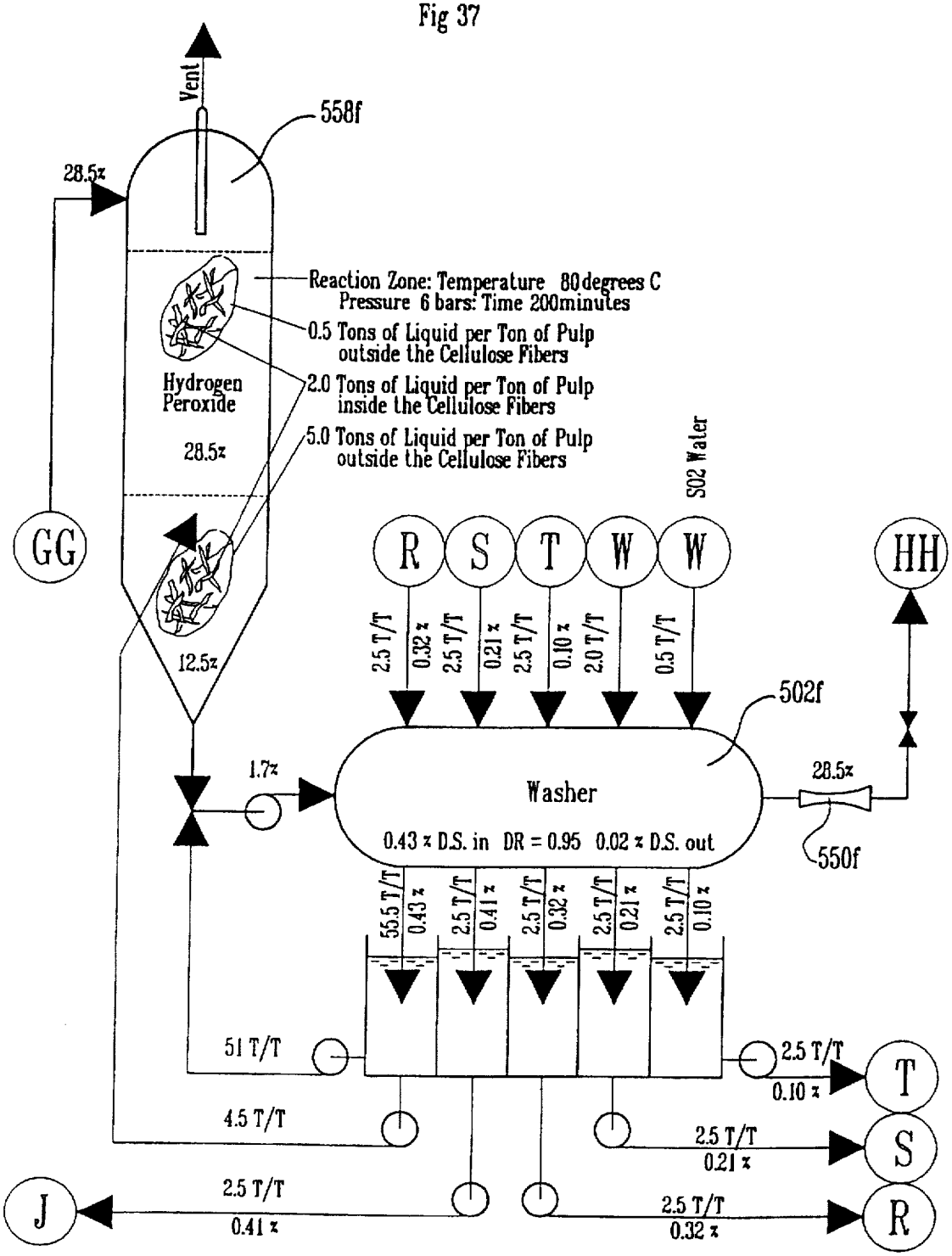

The last portion of wash liquid has dissolved therein 4 Kg of NaOH and 3 Kg hydrogen peroxide (H202) per ton of pulp, which remain in the pulp mat as it is discharged from the washer 502*e*, through the venturi 550*e* and a valve 554*e* to the final bleaching station shown in FIG. 37.

f. Sixth Bleaching Station (Third Hydrogen Peroxide Stage—FIG. 37)

This sixth and final bleaching station is substantially the same as (and functions substantially the same as) the second hydrogen peroxide bleaching station shown in FIG. 35. Accordingly, there will be no detailed description with regard to this final bleaching stage.

As in the fourth bleaching stage of FIG. 35, the final three tanks of effluent from the washer 502*f* (indicated at R, S and T) are recycled directly back to the same washer 502*f* at that station. The effluent from the second tank 528*f* is indicated at J and is recycled to become the first liquid source at J514*c* in the third bleaching stage of FIG. 34, which is also a hydrogen peroxide bleaching stage.

The final portion of wash liquid has SO2 (sulphur dioxide) dissolved therein, and this remains in the pulp mat that is discharged through the venturi 550*f*. The pulp from the venturi 550*f* is shown being discharged at HH, and this pulp is commonly dried and then bailed for future use, such as being shipped to a paper mill.

FIG. 38 presents a data summary of the second embodiment shown in FIGS. 31 thru 37. On the left hand column, there is first listed in the first six columns the six types of dissolved solids. The first organic solids is the organic material which in the bleaching stages is broken down into soluable organic material that dissolves in the liquid. Then the two bleaching agents are shown, namely the oxygen (O2 and ozone) and the hydrogen peroxide. Then the three treating agents are also shown (solidum hydroxide, sulpheric acid, and DTPA).

Next, in column 1 is the carryover which represents the weight of dissolved solids per ton of wood fiber that is carried over from each washer to the next bleaching stage, and the next space indicates the dry solids. Below is the fresh water, and this indicates the amount of fresh water added at each bleaching station. In the following six spaces in the first column, there is shown the filtrates and the movement from one washing station to the other as indicated by the arrows. In the next space down (first column), there is indicated the black liquor that goes to the evaporator. In the next two columns down in the first column, there is given the dry solids initially in the liquid and then in the liquid that is carried over to the next stage, these being given as percentage values. In the next row down, first column the displacement ratio at each wash station is indicated. Finally, in the last row, first column, there is indicated how many washing stages there is for each washing station.

Along the top row, there is indicated first the brown stock washing station, and then the subsequent six bleaching stations. The values given in column indicate those for bleaching station listed at the top of the column.

It will be noted that there is a total of only sixteen and one half tons of fresh water added for each ton of cellulose fiber. Because of the efficiency of the system of this invention, it now becomes feasible to recycle the effluent discharge from the system to recover fresh water, and to utilize this fresh water in the washing operation in accordance with the steps shown in FIGS. 31 thru 37.

Figure 39:
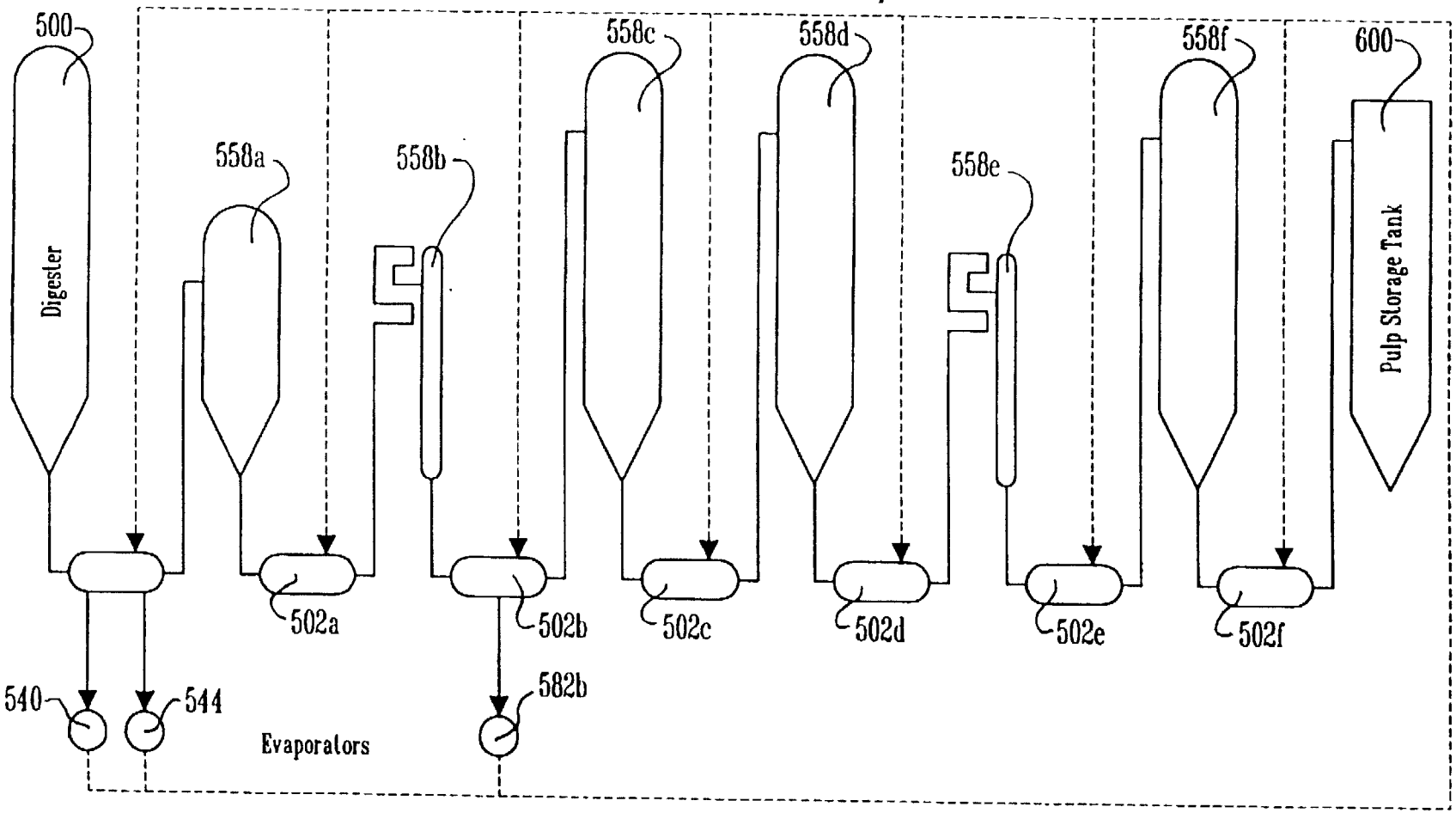
FIG. 39 is a schematic drawing of the system of the second embodiment, and showing the recycling of fresh water in the system.

This particular feature of the present invention is illustrated in FIG. 39, where th main components described with reference to FIGS. 31 thru 37 are shown somewhat schematically. It is indicated that fresh water condensed from each of the evaporators 540, 544 and 582*b* can be condensed and recycled back to the various washers 502 thru 502*f* to act as the source of fresh wash water. Accordingly, it would be possible to have a totally closed system where no net effluent of wash water is discharged.

Usually, a bleaching plant is located near a large body of water so that the substantial quantities of effluent from the washers can be discharged into (and thus become diluted in) the large body of water, such as a river or the ocean. However, with the growing environmental concerns, the system of the present invention can provide significant environmental benefits. This is not simply in avoiding the polluting of nearby water sources, but also in the initial conservation of water, since the present system could be substantially independent of a relatively large source of water that is usually required for bleaching plants. This could even permit the bleaching plant to be located remote from water sources. In such a closed system, at most only a small amount of makeup water would be needed from time to time due to the relatively small losses that might be experienced in such a closed system.

Another significant benefit of the present invention is that because of the efficiency of the overall operation, less chemicals are required for a given amount of pulp, since there is less dissolved solids in the liquid remaining in the pulp at the various bleaching and washing stages. A comparison has been made with the values given in FIG. 38 with prior art systems, and in the present system there is a significant decrease in organic solids in the various locations in the system, and a corresponding decrease in the use of chemicals.

Another efficiency is realized in the present system in that by bringing the consistency of the pulp to a high percentage level, the diffusion process in the washers is enhanced, and the bleaching is also enhanced. As indicated previously in this text, the speed at which diffusion takes place is a function a number of several factors, two of these being temperature and the turbulence in the liquid surrounding the fibers. With regard to temperature, since relatively high pressures are utilized, the operating temperature can be made higher. With regard to turbulence, with the higher percentage consistency of the pulp, and with the higher pressures involved, the passageways are relatively smaller, and there is a more rapid travel of the liquid through the pulp mat. This results in an increase in turbulence which in turn increases the rate of diffusion.

With regard to the effectiveness of bleaching, since there is less filtrate with dissolved organic solids in the pulp at any one time, the bleaching chemicals are not wasted in reacting with organic material which would in any event be discharged to the black liquor evaporator in the present invention.

It is to be understood that various modifications could be made to the present invention without departing from the basic teachings thereof. Also, it is understood that the description contained in this text is arranged to show preferred designs, and when specific procedures, dimensions and arrangements are described, these are not intended to limit the claims which define the scope of the present invention and follow this text.

What is claimed:

1. A method of bleaching pulp, comprising:

a. dewatering and washing a batch of pulp at a plurality of washing locations, said washing being accomplished by moving successive quantities of wash liquid into and through said batch of pulp while applying a sufficient pressure differential across said pulp to maintain said pulp at a consistency of at least about one part by weight of cellulose fiber to four parts by weight of liquid;

b. after dewatering and washing said pulp at each of said washing locations, delivering said pulp to a related one of a plurality of bleaching locations where said pulp is bleached;

c. after said pulp is bleached at each of said bleaching locations, dewatering said pulp to a subsequent washing location where said pulp is dewatered and washed;

d. said method being further comprising the following steps:

i. said pulp is dewatered by delivering said pulp as a slurry into a pressure chamber in a pressure vessel so as to be positioned as a pulp layer over a pressure differential table means, and said pressure differential is applied through said pressure differential table means;

ii. successive batches of pulp are delivered into the pressure vessel at each wash location and are removed from said pressure vessel while maintaining above atmospheric pressure in the pressure chamber;

iii. said pulp is discharged from said pressure vessel by positioning said pulp at a discharge location in said pressure vessel while said pulp is subjected to above atmospheric pressure in said pressure vessel, and opening said discharge location to a pressure below pressure in said pressure vessel to create a pressure differential to move said pulp through a discharge passageway portion;

iv. a bleaching agent is delivered into said pulp passing through said discharge passageway portion.

2. The method as recited in claim 1, wherein said pulp is moved through a venturi in said discharge passageway portion, and said bleaching agent is delivered into said passageway at a location adjacent to said venturi.

3. The method as recited in claim 1, wherein said bleaching agent is a gaseous bleaching agent.

4. The method as recited in claim 1, wherein the consistency of the pulp during washing is maintained at a value at least as great as about one part cellulose fiber by weight to three parts liquid.

5. The method as recited in claim 4, wherein the consistency is maintained at least as great as about one part cellulose fiber to 2 ½ parts liquid.

6. The method as recited in claim 1, wherein fresh water is used as a portion of the wash liquid at a latter part of a washing cycle of at least some of said wash locations.

7. The method as recited in claim 6, wherein portions of wash water effluent from said pulp is recycled at in said washing locations, and a portion of said effluent is delivered to an evaporating recycling means to remove dissolved solids from said effluent to yield fresh water, and said fresh water is utilized as wash liquid in subsequent washing cycles.

8. A method of bleaching pulp, comprising:

a. dewatering and washing a batch of pulp at a plurality of washing locations, said washing being accomplished by moving successive quantities of wash liquid into and through said batch of pulp while applying a sufficient pressure differential across said pulp to maintain said pulp at a consistency of at least about one part by weight of cellulose fiber to four parts by weight of liquid;

b. after dewatering and washing said pulp at each of said washing locations, delivering said pulp to a related one of a plurality of bleaching locations where said pulp is treated with a bleaching agent;

c. after said pulp is treated with said bleaching agent at each of said bleaching locations, delivering said pulp to a subsequent washing location where said pulp is dewatered and washed;

d. said method being further further comprising the following steps:

i. said pulp is dewatered and washed by delivering said pulp as a slurry into a pressure chamber in a pressure vessel so as to be positioned as a pulp layer over a pressure differential table means, and said pressure differential is applied through said pressure differential table means;

ii. successive batches of pulp are delivered into the pressure vessel at each wash location and are removed from said pressure vessel while maintaining above atmospheric pressure in the pressure chamber;

iii. said pulp is discharged from said pressure vessel by positioning said pulp at a discharge location in said pressure vessel while said pulp is subjected to above atmospheric pressure in said pressure vessel, and opening said discharge location to a pressure below pressure in said pressure vessel to create a pressure differential to move said pulp from said discharge location;

iv. said pulp is delivered from said discharge location through a venturi to accelerate said pulp and cause shredding of said pulp into smaller particles.

9. A method of bleaching pulp, comprising:

a. dewatering and washing a batch of pulp at a plurality of washing locations, said washing being accomplished by moving successive quantities of wash liquid into and through said batch of pulp while applying a sufficient pressure differential across said pulp to maintain said pulp at a consistency of at least about one part by weight of cellulose fiber to four parts by weight of liquid;

b. after dewatering and washing said pulp at each of said washing locations, delivering said pulp to a related one of a plurality of bleaching locations where said pulp is bleached;

c. after said pulp is bleached at each of said bleaching locations, delivering said pulp to a subsequent washing location where said pulp is dewatered and washed:

d. said method being further comprising the following steps:

i. said pulp is dewatered and washed by delivering said pulp as a slurry into a pressure chamber in a pressure vessel so as to be positioned as a pulp layer over a pressure differential table means, and said pressure differential is applied through said pressure differential table means;

ii. successive batches of pulp are delivered into the pressure vessel at each wash location and are removed from said pressure vessel while maintaining above atmospheric pressure in the pressure chamber;

iii. said pulp is discharged from said pressure vessel by positioning said pulp at a discharge location in said pressure vessel while said pulp is subjected to above atmospheric pressure in said pressure vessel, and opening said discharge location to a pressure below pressure in said pressure vessel to create a pressure differential to move said pulp from said discharge location to a discharge passageway portion;

iv. ozone is delivered into said discharge passageway portion to combine with pulp in said discharge passageway portion to initiate bleaching of said pulp in said discharge passageway portion.

10. The method as recited in claim 9, wherein said pulp is delivered through plurality of venturis in said discharge passageway portion, and said discharge passageway portion is of sufficient volume and length whereby substantial bleaching of said pulp by said ozone can be accomplished in said discharge passageway portion.

11. A method of bleaching pulp, comprising:

a. dewatering and washing a batch of pulp at a plurality of dewatering/washing locations by:

i. providing said batch of pulp as a pulp slurry, moving said pulp slurry into a pressure vessel and onto a pressure differential table having a support surface exposed to pressure in said pressure vessel and maintaining pressure in said pressure vessel at a sufficiently high pressure level to apply a sufficient pressure differential across said pulp slurry to dewater said pulp slurry to a consistency at least about one part by weight pulp to four parts by weight of liquid to form said batch of pulp into a pulp mat;

ii. washing said pulp mat by moving successive quantities of wash water through said pulp mat and maintaining said pressure in said pressure vessel at a sufficiently high pressure level to maintain a sufficiently high pressure differential so that said pulp mat substantially remains at said consistency (b) after dewatering and washing said pulp at each of said dewatering/washing locations, delivering said pulp having a consistency of at least about one part by weight pulp to four parts by weight of liquid, to a related one of a plurality of bleaching locations where said pulp is treated with a bleaching agent;

c. after said pulp is treated with said bleaching agent at each of said bleaching locations, said pulp is delivered to a subsequent dewatering/washing location where said pulp is deposited as a slurry onto a pressure differential table exposed to pressure in said pressure vessel, is dewatered and washed at a consistency at least as great as one part pulp fiber by weight to four parts liquid by weight and is delivered to a subsequent bleaching location where said pulp is treated with a subsequent bleaching agent whereby said pulp is washed at each dewatering/washing location with a relatively small dry solids carry over, and said bleaching can be accomplished with a quantity of bleaching agent commensurate with said dry solids carry over;

d. said batch of pulp being dewatered and washed in a pressure chamber in said pressure vessel above atmospheric pressure and said pulp being removed from said pressure chamber after dewatering and washing while maintaining above atmospheric pressure in said pressure chamber;

e. said pulp being discharged from said pressure chamber by positioning said pulp at a discharge location in said pressure chamber while said pulp is subjected to above atmospheric pressure in said pressure chamber, and opening said discharge location to a pressure below pressure in said pressure chamber to create a pressure differential to move said pulp from said discharge location.

12. The method as recited in claim 11, wherein said a pulp is moved toward said bleach location by a pressurized gaseous medium in said pressure chamber.

13. The method as recited in claim 11, wherein said bleaching agent is delivered into said pulp passing from said discharge location through a discharge passageway portion.

14. The method as recited in claim 12, wherein said pulp is moved through a venturi in said discharge passageway portion, and said bleaching agent is delivered into said discharge passageway portion at a location adjacent to said venturi.

15. The method as recited in claim 13, wherein said bleaching agent is a gaseous bleaching agent.

16. The method as recited in claim 11, wherein said pulp is moved from said discharge location through a venturi.

17. The method as recited in claim 11, wherein said pulp which is removed from the pressure chamber is delivered through a venturi to accelerate said pulp and cause shredding of said pulp into smaller particles.

18. The method as recited in claim 14, wherein said pulp is delivered through a plurality of said venturis, and said venturis are of sufficient volume and length whereby substantial bleaching of said pulp by said bleaching agent can be accomplished in said venturis.

* * * * *